US011666125B2

(12) United States Patent
Yamagata

(10) Patent No.: US 11,666,125 B2
(45) Date of Patent: Jun. 6, 2023

(54) PARASOL

(71) Applicant: YMEK CO., LTD., Tokyo (JP)

(72) Inventor: Yoshinosuke Yamagata, Tokyo (JP)

(73) Assignee: YMEK CO., LTD., Tokyo (JP)

( * ) Notice: Subject to any disclaimer, the term of this patent is extended or adjusted under 35 U.S.C. 154(b) by 0 days.

(21) Appl. No.: 17/768,994

(22) PCT Filed: Feb. 25, 2020

(86) PCT No.: PCT/JP2020/007456
§ 371 (c)(1),
(2) Date: Apr. 14, 2022

(87) PCT Pub. No.: WO2021/171361
PCT Pub. Date: Sep. 2, 2021

(65) Prior Publication Data

US 2022/0354227 A1 Nov. 10, 2022

(51) Int. Cl.
*A45B 19/04* (2006.01)
*A45B 25/14* (2006.01)
*A45B 23/00* (2006.01)

(52) U.S. Cl.
CPC ..... *A45B 19/04* (2013.01); *A45B 25/14* (2013.01); *A45B 2023/0012* (2013.01)

(58) Field of Classification Search
CPC ..... A45B 19/04; A45B 2023/0012; A45B 2023/005
See application file for complete search history.

(56) References Cited

U.S. PATENT DOCUMENTS 3,822,850 A * 7/1974 Elias ..... E04G 21/3233 248/200.1
4,433,699 A * 2/1984 Schultes ..... A45B 23/00 135/117

(Continued)

FOREIGN PATENT DOCUMENTS

CN 202858069 U 4/2013
DE 1207560 B 12/1965

(Continued)

OTHER PUBLICATIONS

International Search Report dated Jun. 2, 2020 corresponding to International Patent Application PCT/JP2020/007456 with Machine Translation.

(Continued)

*Primary Examiner* — Noah Chandler Hawk
(74) *Attorney, Agent, or Firm* — Renner, Otto, Boisselle & Sklar, LLP

(57) ABSTRACT

A parasol includes a pole of a tension rod-type between a ceiling surface and a floor surface of a building, a lower hub penetrated by the pole and moves in the vertical direction along the pole, an upper hub fixed to a predetermined position of the pole, ribs joined to the upper hub, struts provided with respect to each rib and connecting the ribs and the lower hub, a handle operation unit for moving the lower hub along the pole, and a sheet between the ribs. The pole is divided into an outer pipe, a ceiling pipe attached to an upper side of the outer pipe, and a lower side pipe attached to a lower side of the outer pipe. The length of the pole in the vertical direction is adjustable while the position of the sheet is maintained at a height within a certain range from the floor surface.

14 Claims, 47 Drawing Sheets

(56) References Cited

U.S. PATENT DOCUMENTS

| | | | | | |
|---|---|---|---|---|---|
| 5,056,753 | A * | 10/1991 | Lunau | E04G 21/1808 | 248/200.1 |
| 5,339,847 | A * | 8/1994 | Kanter | A45B 23/00 | 248/533 |
| 5,924,469 | A * | 7/1999 | Whittemore | E04G 21/30 | 248/200.1 |
| 6,196,242 | B1 * | 3/2001 | Xu | A45B 23/00 | 135/21 |
| 7,886,755 | B2 * | 2/2011 | Tung | A45B 25/14 | 135/21 |
| 10,426,236 | B1 * | 10/2019 | Huckvale | E04H 12/2238 | |
| 11,266,212 | B2 * | 3/2022 | Jin | A45B 17/00 | |
| 2010/0051074 | A1 | 3/2010 | Dan | | |
| 2010/0212705 | A1 | 8/2010 | Tung | | |
| 2021/0267328 | A1 | 9/2021 | Yamagata | | |

FOREIGN PATENT DOCUMENTS

| | | | |
|---|---|---|---|
| JP | S60-182904 | A | 9/1985 |
| JP | 4-117704 | | 4/1992 |
| JP | H05-093250 | U | 12/1993 |
| JP | 6-217813 | | 8/1994 |
| JP | 7-232644 | | 9/1995 |
| JP | 2003-061724 | A | 3/2003 |
| JP | 2003-210225 | A | 7/2003 |
| JP | 2006-43430 | A | 2/2006 |
| JP | 3212101 | U | 8/2017 |
| JP | 2018-50744 | A | 4/2018 |
| JP | 1665337 | | 8/2020 |
| WO | 2020079859 | | 4/2020 |

OTHER PUBLICATIONS

Written Opinion of the International Searching Authority dated Jun. 2, 2020 corresponding to International Patent Application PCT/JP2020/007456 with Machine Translation.

Decision to Grant in corresponding Japanese Patent Application 2020-537792 dated Feb. 25, 2021 with Machine translation.

Notice of Refusal2 in corresponding Japanese Patent Application 2020-537792 dated Jan. 6, 2021 with Machine Translation.

Notice of Refusal1 in corresponding Japanese Patent Application 2020-537792 dated Sep. 24, 2020 with Machine translation.

"Space-saving semi-circular parasol that can be used near a wall" https://item rakuten.co.jp/at-ptr/fj-c-10217-20000/?scid=af_pc_etc &sc2id=af_113_0_10001868.

* cited by examiner (EMBODIMENT1) PARASOL (EMBODIMENT1) PARASOL (EMBODIMENT1) PARASOL (EMBODIMENT1) PARASOL (EMBODIMENT1) PARASOL (EMBODIMENT1) PARASOL (EMBODIMENT1) PARASOL (A)

(B)

(EMBODIMENT2) PARASOL (EMBODIMENT2) PARASOL (EMBODIMENT3) PARASOL 1b (EMBODIMENT4)

(EMBODIMENT4)

(EMBODIMENT4)

(EMBODIMENT5) PARASOL1000

(EMBODIMENT5) PARASOL1000

(EMBODIMENT5) PARASOL1000

(EMBODIMENT5) PARASOL1000

(EMBODIMENT5) PARASOL1000

(EMBODIMENT5) PARASOL1000

(EMBODIMENT5) PARASOL1000

(EMBODIMENT5) PARASOL1000

(COMPARATIVE EXAMPLE)
PARASOL 1000

(COMPARATIVE EXAMPLE)

PARASOL 1000

(EMBODIMENT6) PARASOL 2000

(EMBODIMENT6) PARASOL 2000

(EMBODIMENT6) PARASOL 2000

(EMBODIMENT6) PARASOL 2000

(EMBODIMENT6) PARASOL 2000

(EMBODIMENT6) PARASOL 2000

(EMBODIMENT6) PARASOL 2000

(EMBODIMENT6) PARASOL 2000

(EMBODIMENT7) PARASOL 3000

(EMBODIMENT7) PARASOL 3000

(EMBODIMENT7) PARASOL 3000

(EMBODIMENT7) PARASOL 3000

(EMBODIMENT7) PARASOL 3000

(EMBODIMENT7) PARASOL 3000

(EMBODIMENT7) PARASOL 3000

(EMBODIMENT8)

(EMBODIMENT8)

(EMBODIMENT8)

(EMBODIMENT8)

(EMBODIMENT8)

(EMBODIMENT8)

(EMBODIMENT8)

(EMBODIMENT8)

PARASOL

This application is a national phase of International Application No. PCT/JP2020/007456 filed Feb. 25, 2020, which is hereby incorporated herein by reference, and this application also is related to Japanese Application No. 2020-537792 filed Feb. 25, 2020, which is also hereby incorporated herein by reference.

TECHNICAL FIELD

The present invention relates to a parasol that can be installed at the eaves of a building or the like.

BACKGROUND ART

A parasol that is installed, for example, at the eaves of a house or a store and used as a sunshade or a rain shield is known (refer to, for example, Non-Patent Document 1).

However, such parasol uses a base (a member that grips a lower end of a pole) for holding the pole in an upright position. Depending on the volume and weight of the base, the location for installing such parasol becomes limited, and labor for installing such parasol is large.

RELATED ART DOCUMENT

Non-Patent Document

Non-Patent Document 1:
"Space-saving semi-circular parasol that can be used near a wall"https://items.rakuten.co.jp/at-ptr/fj-c-10217-20000/?scid=af_pc_etc&sc2id=af_113_0_10001868

SUMMARY OF INVENTION

Problem to be Solved by Invention

It is an object of the present invention to provide a parasol that can be easily installed and used as a sunshade or a rain shield in various locations. Further, the object is also to provide a parasol that can reduce packaging size and transportation cost by making its pole into a separable type.

Means for Solving Problem

The parasol of the present invention includes a single pole of a tension rod-type between a ceiling surface and a floor surface of a building, a lower hub penetrated by the pole and configured to move in the vertical direction along the pole, an upper hub fixed to a predetermined position of the pole, two or more ribs joined to the upper hub, struts provided with respect to each of the ribs and connecting the ribs and the lower hub, a handle operation unit for moving the lower hub along the pole, and a sheet provided between the ribs. The pole is divided into at least an outer pipe, a ceiling pipe attached to an upper side of the outer pipe, and a lower side pipe attached to a lower side of the outer pipe. The length of the pole in the vertical direction is adjustable while the position of the sheet is maintained at a height within a certain range from the floor surface.

Further, the parasol of the present invention includes a single pole of a tension-rod-type for exerting force between a ceiling surface and a floor surface of a building, a sheet that is foldable and has a top view shape of a polygon when in an open state, a handle operation unit coupled to the pole, an upper arm coupled to the pole and supporting the sheet from an upper side, a lower arm having one end attached to the handle operation unit and supporting the sheet from a lower side, a support cylinder provided at a center of the sheet on a lower side of the sheet, plural ribs extending radially and oscillatably supported by an upper end part of the support cylinder, struts having an end in its length direction that oscillatably support an intermediate portion of the lower arm in the length direction and an intermediate portion of the ribs in the length direction, a ring member provided at a lower end of the support cylinder, and a string member that has one end part coupled to the ring member and another end part coupled to the handle operation unit via the inside of the support cylinder and the inside of the lower arm. The sheet is opened and closed by moving the ring member coupled to the string member upward and downward by performing a winding operation of the string member with the handle operation unit. The pole is divided into at least an outer pipe, a ceiling pipe attached to the upper side of the outer pipe, and a lower side pipe attached to the lower side of the outer pipe. The length of the pole in the vertical direction is adjustable while the position of the sheet is maintained at a height within a certain range from the floor surface.

Effect of Invention

The parasol of the present invention can be easily installed in many places and used as a sunshield or rain shield. By making the pole into a separable type, packaging size and transportation cost can be reduced.

MODE FOR CARRYING OUT INVENTION

Hereinafter, the present invention will be described in detail with reference to the drawings. The present invention is not limited to the embodiments illustrated below.

Embodiments of the present invention are aimed to solve the problems of a conventional sunshade apparatus, such as being able to adjust the pole that holds the parasol body into various lengths, and providing a parasol capable of fixing a pole at various buildings and installation locations by using a tension rod-type pole. Further, it is an object to reduce packaging size by making the pole into a separable type and reduce transportation costs. Further, it is an object to provide a parasol that does not block the entrance and exit of a building.

Embodiment 1

Figure 1:
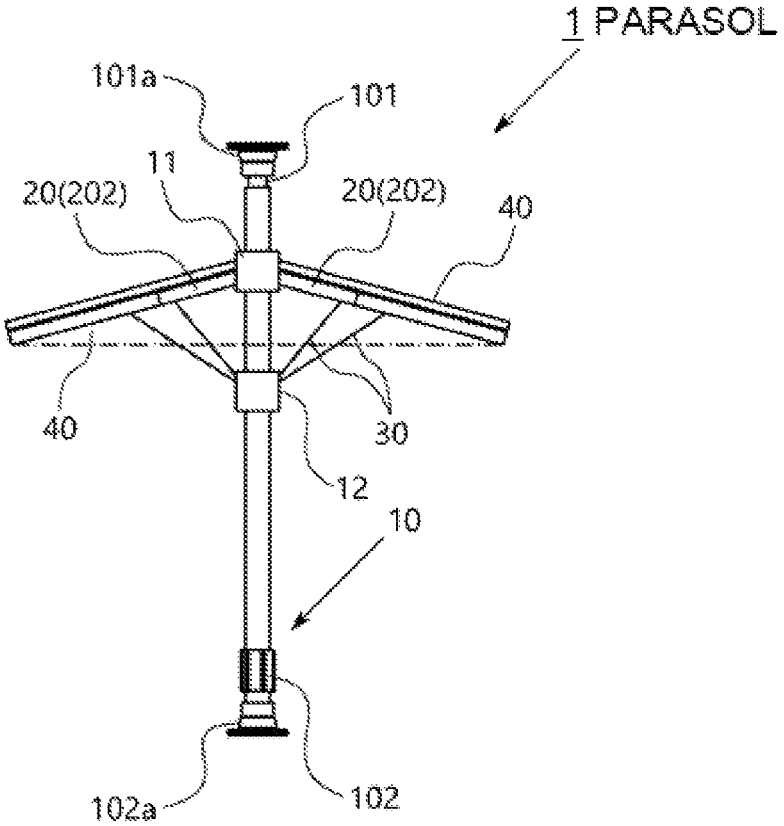
FIG. 1 is a rear view of a parasol (Embodiment 1).
Figure 2:
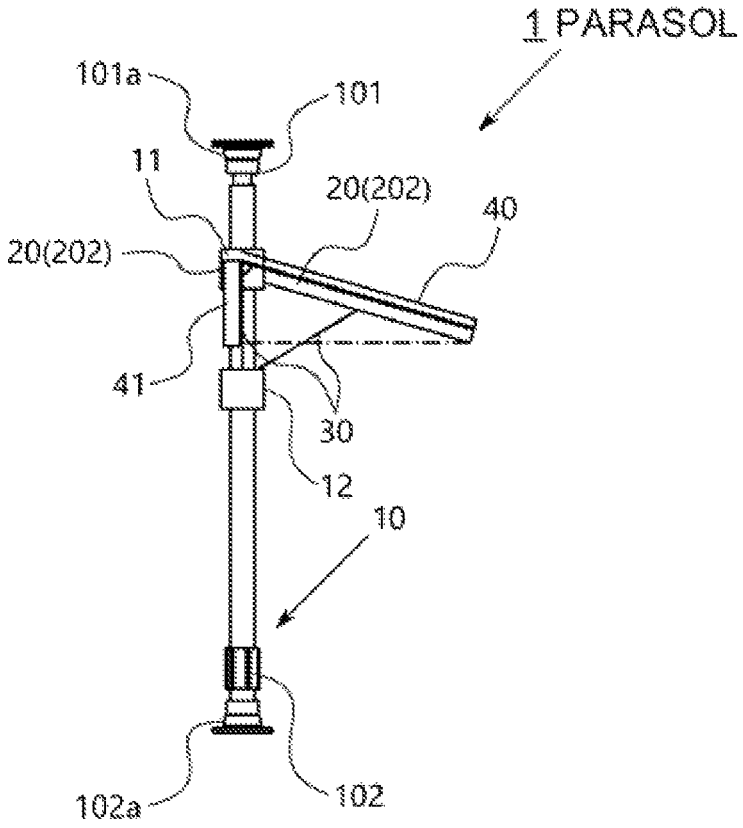
FIG. 2 is a side view of a parasol (Embodiment 1).
Figure 3:
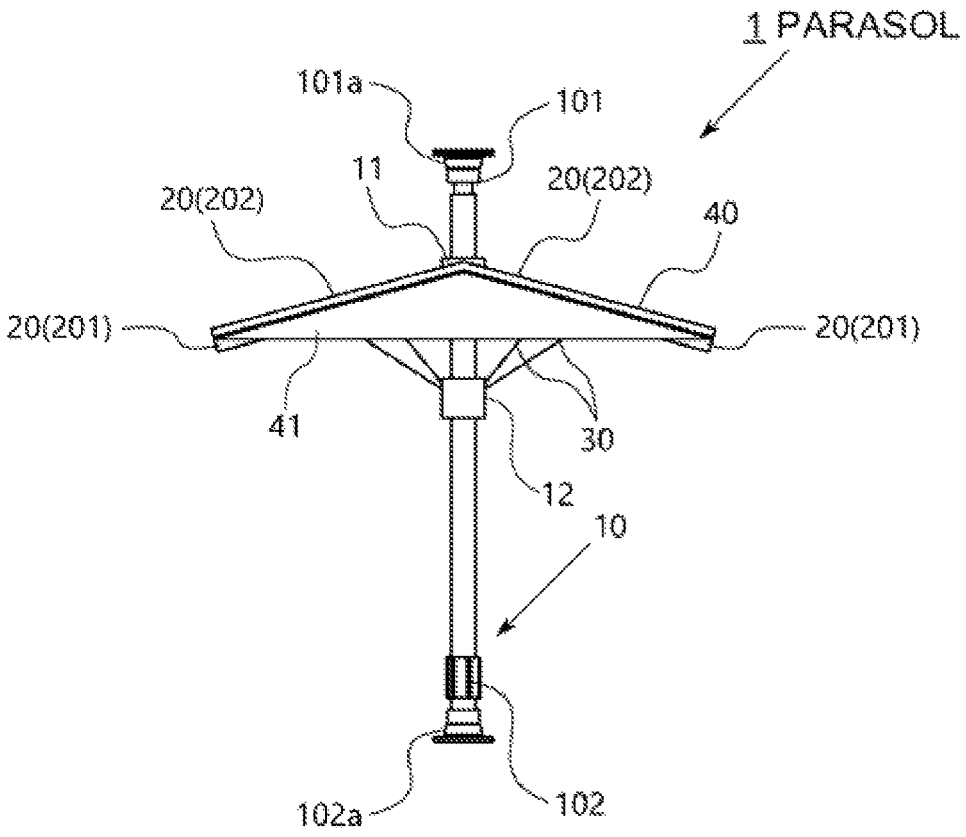
FIG. 3 is a front view of a parasol (Embodiment 1).
Figure 4:
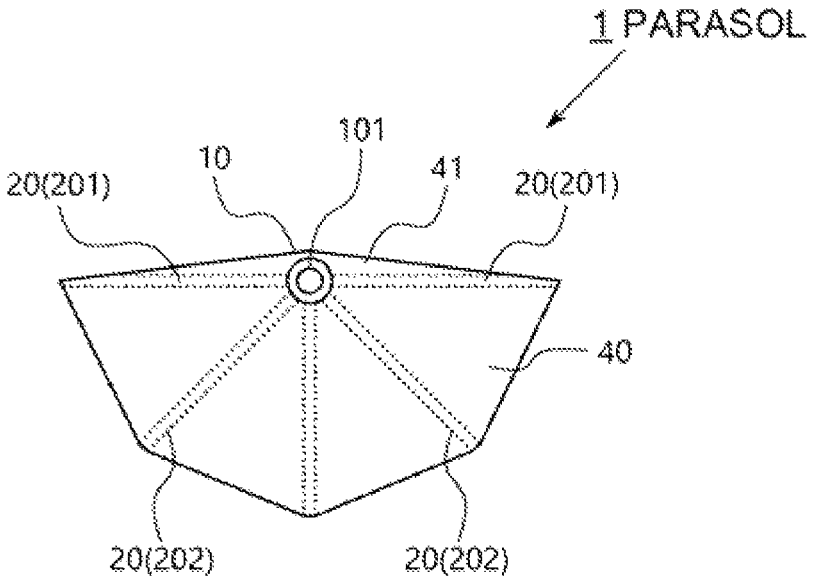
FIG. 4 is a top view of a parasol (Embodiment 1).

FIG. 1 is a rear view of a parasol 1 according to the present embodiment, FIG. 2 is a side view, FIG. 3 is a front view, FIG. 4 is a top view. As shown in FIG. 1 and FIG. 2, the parasol has one pole 10 extending in a vertical direction. The pole 10 is a cylindrical pillar having a hollow inside, and is made of, for example, iron or aluminum. A ring-shaped upper hub 11 penetrates through the pole 10 and is fixed thereto at the vicinity of the upper portion of the pole 10. Below the upper hub 11, a ring-shaped lower hub 12 is provided to penetrate through the pole 10 and move in the vertical direction along the longitudinal direction of the pole 10. The upper hub 11 and the lower hub 12 are made of, for example, a synthetic resin.

The ends of five ribs 20, each having equal length, are joined to the upper hub 11. Each rib 20 is provided to be rotatable in the vertical direction and non-rotatable in the horizontal direction. Note that the number of the ribs 20 may be designed as any number as long as the number is 3 or more.

The lower hub 12 and an intermediate part of each rib 20 are connected with each other by one strut 30. When the lower hub 12 is moved along the pole 10, the rib 20 and the strut 30 rotate in the vertical direction in conjunction with the movement. The rib 20 and the strut 30 are made of, for example, stainless steel, aluminum, or plated iron, or the like.

The pole 10 is provided with a protruding portion 13 that restricts a downward movement of the lower hub 12. FIGS. 1 and 2 show a state in which the downward movement of the lower hub 12 is restricted by engaging the lower hub 12 with the protruding portion 13 located below the lower hub 12. The protruding portion 13 serves as a locking member that restricts the downward movement of the lower hub 12. The protruding portion 13 has a slope having its upper end portion protruding in the horizontal direction and having an inclined surface inclined toward the pole 10 from the protruding upper end to its lower end portion.

A slit (not illustrated) extending in the vertical direction is formed on the outer peripheral surface of the pole 10. The protruding portion 13 is urged to protrude through the slit and outward of the pole 10 by way of an elastic mechanism (not illustrated).

In a state where the lower hub 12 shown in FIGS. 1 and 2 is engaged with the protruding portion 13, the protruding portion 13 enters the pole 10 when force is applied to the protruding portion 13 from the outside in the direction toward the pole 10. Thereby, the engagement of the lower hub 12 and the protruding portion 13 is released to enable the lower hub 12 to move to a position lower than the protruding portion 13. By moving the lower hub 12 to a position lower than the protruding portion 13, the rib 20 and the strut 30 can be positioned closely to the pole 10, so that space can be saved in a case of installing or transporting the parasol 1.

In a case of moving the lower hub 12 upward when the lower hub 12 is below the protruding portion 13, the protruding portion 13 is pressed by the cylindrical inner wall of the lower hub 12 and enters into the pole 10 when the lower hub 12 reaches the position of the protruding portion 13. This allows the lower hub 12 to be moved upward to a position above the protruding portion 13. When the lower hub 12 is moved to a position higher than the protruding portion 13, the protruding portion 13 protrudes from the inside of the pole 10 to the outside, so that the lower hub 12 is engaged with the protruding portion 13, and each rib 20 is arranged at a fixed position.

Figure 5:
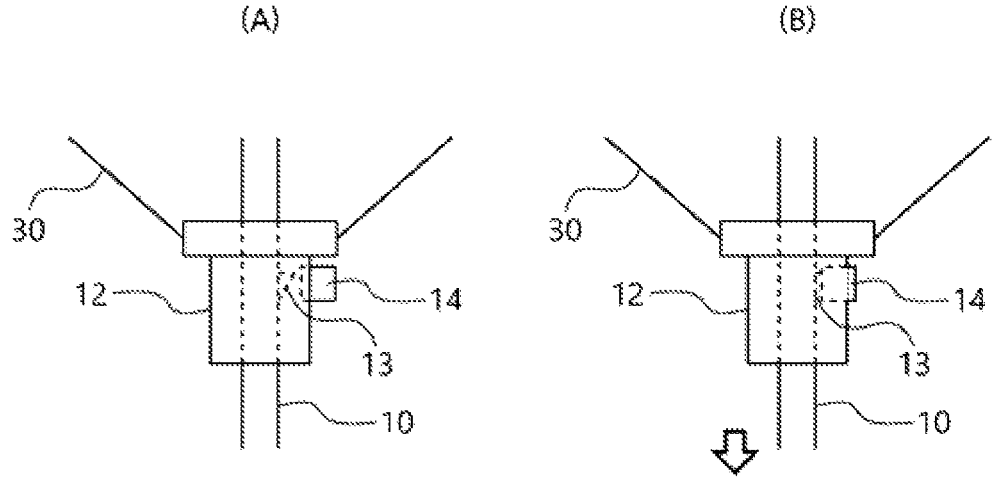
FIG. 5 is an enlarged view for explaining the lower hub and protruding portions (Embodiment 1).

It is to be noted that the relationship between the lower hub 12 and the protruding portion 13 is not limited to that illustrated in the drawings. FIG. 5 is an enlarged view for explaining the lower hub and protruding portion. The parasol 1 is larger than a typical umbrella, and the lower hub 12 is also larger than that of a typical umbrella. Accordingly, as shown in FIG. 5(A), the protruding portion 13 locks the lower hub 12 at the inside of the lower hub 12 instead of at a lower end of the lower hub 12.

In this case, a push button 14 for pushing the protruding portion 13 into the pole 10 is provided on the lower hub 12. As shown in FIG. 5(B), the push button 14 is pushed to push the protruding portion 13 into the pole 10, so that the lower hub 12 can be moved.

Figure 6:
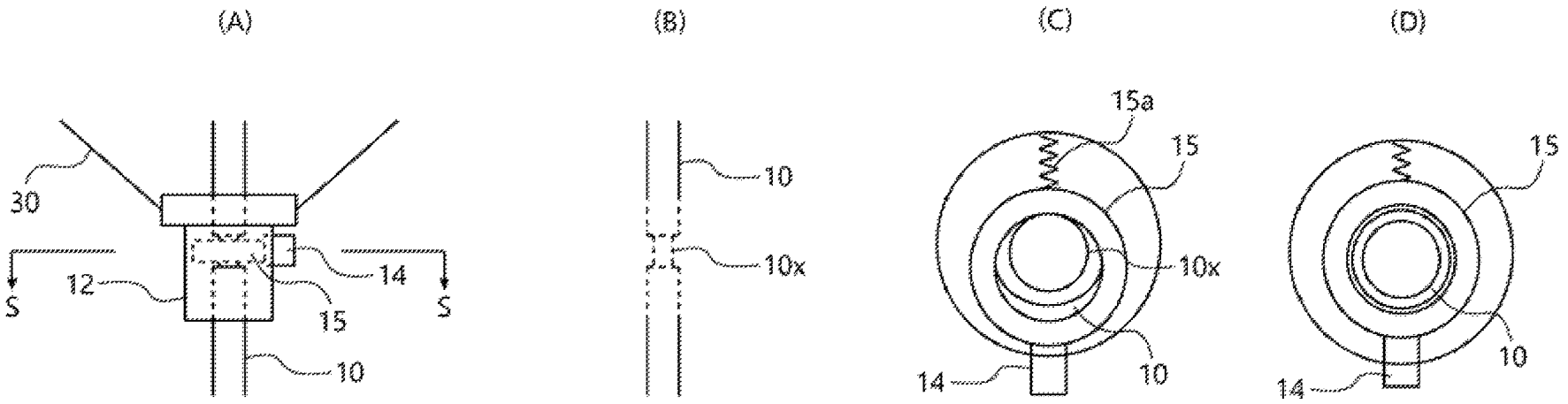
FIG. 6 is an enlarged view illustrating another structure of a lower hub (Embodiment 1).

FIG. 6 is an enlarged view illustrating another structure of the lower hub. As shown in FIG. 6(A), a disk portion 15 is provided inside the lower hub 12. The disk portion 15 has a hole portion in its center to allow the pole 10 to penetrate therethrough.

The pole 10 has a small diameter portion 10*x* as shown in FIG. 6(B). FIG. 6 (C) is a cross-sectional view taken along line S-S of FIG. 6(A) in a state where the lower hub 12 is locked. The disk portion 15 is urged downward in the drawing by a spring 15*a*. Thereby, the disk portion 15 enters the small diameter portion 10*x* and functions as a locking member that restricts downward movement of the lower hub 12.

By pressing the push button 14, the disk portion 15 can be moved and allow the pole 10 to penetrate through its hole portion as shown in FIG. 6(D) and allow the locking between the lower hub 12 and the disk portion 15 to be released, so that the lower hub 12 can move downward.

Figure 7:
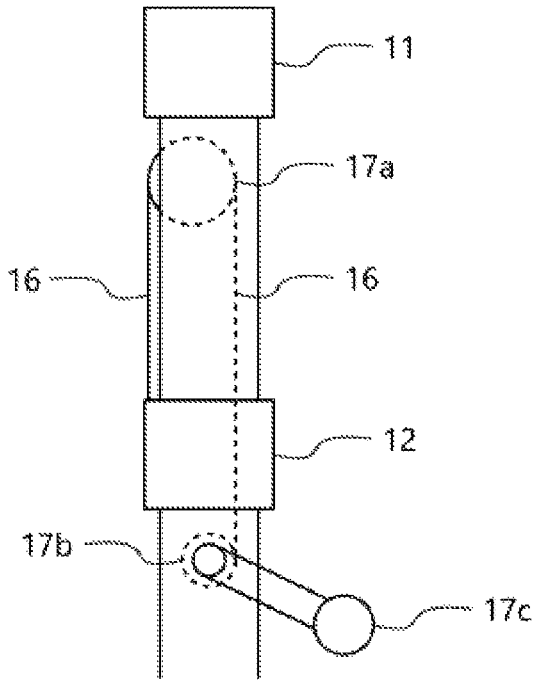
FIG. 7 is a diagram illustrating another structure for moving a lower hub (Embodiment 1).

FIG. 7 is a diagram illustrating another structure for moving the lower hub. A wire 16 is connected to the lower hub 12, and the lower hub 12 moves upward by pulling the wire 16 upward. By not pulling the wire 16 upward and allowing it be a free length, the lower hub 12 moves downward by its own weight.

The wire 16 circles around a pulley 17*a* and is wound around a reel 17*b*. The reel 17*b* can be rotated by operating a handle 17*c* provided on the outside of the pole 10. By winding the wire 16 to the reel 17*b* by operating the handle 17*c*, the lower hub 12 can be moved upward. Further, the lower hub 12 can be moved downward by releasing the wire 16 from the reel 17*b*.

If the lower hub 12 is moved upward to lock the lower hub 12 with the parasol opened, the wire 16 serves as a locking member that restricts downward movement of the lower hub 12.

Further, the pole 10 may be provided with a stopper (a protrusion for locking the lower hub) to prevent the lower hub 12 from excessively moving upward.

The ribs 20 include two end rib parts 201 that are placed at an angle of approximately 180 degrees from a top view. Besides the end rib parts, the ribs 20 also include three middle rib parts 202. As shown in FIG. 3, the two end rib parts 201 form a straight line, and the three middle rib parts 202 are provided only on one side of the straight line formed by the two end rib parts 201. The middle rib part 202 is arranged in order at an equal angle (in this embodiment, 45 degrees) from one of the end rib part 201 to another other end rib part 201. Note that the number of the middle rib parts 202 is not limited to three, as long as the number of the middle rib parts 202 is one or more.

A sheet 40 is provided between the ribs 20. As shown in FIG. 3, the sheet 40 is provided on one side with respect to the straight line formed by the two end rib parts 201. In this embodiment, a single ply of the sheet 40 covers the entire end rib part 201 and the middle rib part 202. During the coverage, alignment is performed so that the two end rib parts 201 are disposed at positions corresponding to the diameter of the sheet 40 and the ends of the middle rib parts 202 are disposed at positions corresponding to the circumference of the sheet 40. Various cloths used for tents may be used as the material of the sheet 40. The sheet 40 may be subjected to ultraviolet ray blocking treatment, waterproof coating, water-repellent treatment or the like.

Here, since the sheet 40 is provided to be inclined, the ribs 20 (end rib parts 201 and the middle rib parts 202) are on the opposite side of the sheet 40. In the drawings, the sheet 40 is illustrated to be transparent to allow the ribs 20 (end rib parts 201 and middle rib parts 202) to be visible. The lower edge of the sheet 40 is indicated by a single-dot chain line. Obviously, the sheet 40 need not necessarily be transparent such that the ribs 20 (end rib parts 201 and middle rib parts 202) are not visible.

Note that the sheet 40 is not limited to being formed with one ply of sheet but may be formed by using four fan-shaped sheets with a center angle of 45 degrees. In this case, the edge parts of each fan-shaped sheet corresponding to the diameter of the sector of each fan-shaped sheet are connected to each rib 20 along its longitudinal direction.

Further, a sheet 41 may be provided between two end rib parts 201 (see FIG. 2). As shown in FIG. 3 (unlike FIGS. 1 and 2, the sheet 41 illustrated to be opaque), the sheet 41 covers the back side and is matched with the sheet 40 to encompass the periphery of the parasol 1.

Telescopic portions 101 and 102 are provided on the upper and lower sides of the pole 10, respectively. When installing the pole 10 as a tension rod-type at the eaves of a building or the like, the length of the pole 10 can be adjusted to be equal to the distance between the ceiling surface and the floor surface by extending and contracting the telescopic portions 101 and 102.

Publicly known telescopic structures can be used as the telescopic structure of the telescopic portions 101 and 102. For example, a structure shown in FIG. 8(A) may be used. Although the drawing illustrates the telescopic portion 102 on the lower side, the telescopic portion 101 on the upper side may also be illustrated similarly. A female screw 102*b* provided on the telescopic portion 102 and a male screw 10*y* provided on the pole 10 are screwed together, and the length that the telescopic portion 102 protrudes from the support 10 (height of the parasol 1) is adjusted by rotating the telescopic portion 102.

Figure 8:
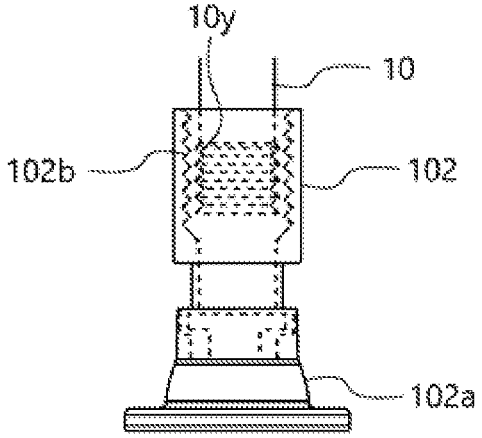
FIG. 8 is a diagram showing a telescopic portion and a pad portion (Embodiment 1).
Figure 8:
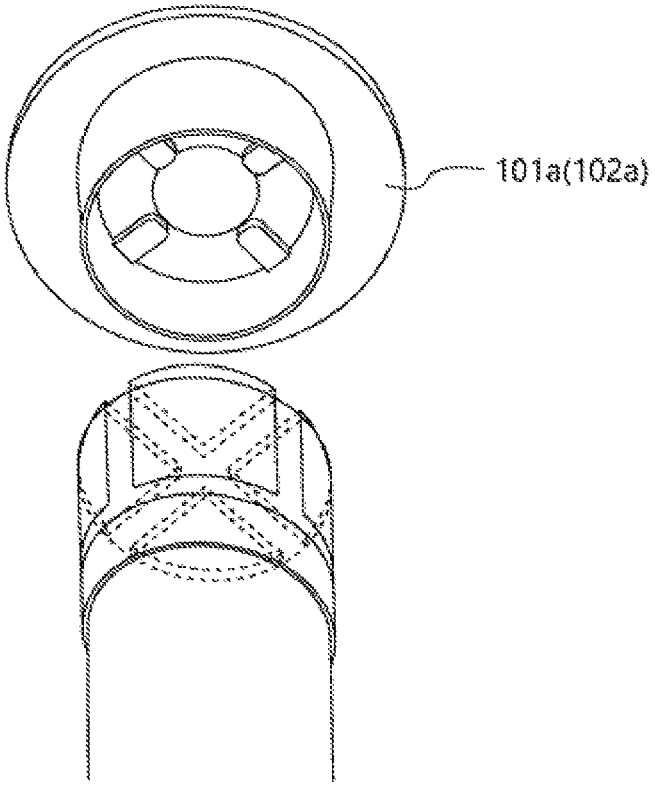

In FIG. 8A, disk-shaped pads 101*a* and 102*a* are provided at the distal ends of the telescopic portions 101 and 102. The pad 102*a* is freely rotatable with respect to (a main body of) the telescopic portion 102 without a screw. With this structure, the height of the parasol 1 can be adjusted by rotating the telescopic portion 102 while keeping the pad 102*a* in contact with and fixed to the ground. Note that the pad 102*a* need not have a disk shape as long as the lower surface of the pad 102*a* is flat. The pad 102*a* may have a hemispherical shape or another shape.

The telescopic portion 101 on the upper side is provided above the position of the sheet 40 and the upper hub 11. Therefore, when installing the parasol 1 at the eaves, first, the connection position of the outer pipe and the inner pipe of the pole 10 is adjusted to a desired length. Then, the length of the pole 10 can be adjusted to be equal to the distance between the ceiling surface of the eaves of the building and the floor surface the building by using the telescopic portion 102 on the lower side. Note that the adjustment of the connection position of the outer pipe and the inner pipe will be described in further detail in Embodiment 4 below.

Here, both the telescopic portions 101 and 102 do not necessarily need to be provided. For example, only the telescopic portion 102 on the lower side may be provided, and only the pad 101*a* may be provided on the upper side. It is sufficient to keep a substantially constant length above the sheet 40 and adjust the length of the pole 10 by using only the telescopic portion 102 on the lower side.

Here, in the case where only the pad 101*a* is provided on the upper side, the pad 101*a* may be formed as the same component as the pad 102*a* from the standpoint of ease of manufacturing. By doing so, both the pad 101*a* and the pad 102*a* are rotatable. Since there may be a danger that the pole 10 (and the parasol 1) is accidentally rotated, it is preferable to fix the pad 101*a* to the pole 10, for example, by fastening with a screw to stop the rotation of the pole 10. Alternatively, as shown in FIG. 8B, by providing a convex connection surface on the pad 101*a* and providing a corresponding concave connection surface on the pole 10, the convex connection surface and the concave connection surface can engage with each other, so that the pole 10 can be prevented from rotating.

The procedure for installing the parasol 1 under the eaves of a building will be described. The parasol 1, prior to being installed, has the lower hub 12 positioned on the lower side of the protruding portion 13 and has the rib 20 and the strut 30 positioned closely to the pole 10.

First, after adjusting the length of the pole 10 to a desired length by adjusting the connection position of the outer pipe and the inner pipe of the pole 10, the length of the pole 10 is adjusted to be equal to the distance between the ceiling surface of the eaves of the building and the floor surface by using the telescopic portion 102 on the lower side.

Then, depending on the purpose of use or preference, the distance between the ceiling surface of the eaves of the building and the sheet 40 may be decided such that, for example, the sheet 40 is positioned close to the ceiling surface under the eaves or positioned to be sufficiently spaced from the ceiling surface. The length of the telescopic portion 101 on the upper side of the pole 10 is adjusted in accordance with the decided distance between the ceiling surface and the sheet 40. Note that the distance between the ceiling surface and the sheet 40 may be fixed and the telescopic portion 101 on the upper side need not be provided.

Then, the length of the telescopic portion 102 on the lower side of the pole 10 is adjusted according to the distance between the ceiling surface of the eaves and the floor surface, so that the pole 10 is installed between the ceiling surface and the floor surface in a tensioned rod state.

Then, the sheet 40 is opened by sliding the lower hub 12 upward along the pole 10 to the upper side of the protruding portion 13 and causing each rib 20 to become a horizontal state and lock the lower hub 12 to the protruding portion 13. Thereby, the installation of the parasol 1 is completed.

Thus, in a case of installing the parasol 1 under the eaves of a building or the like, the parasol 1 can be easily installed without labor by simply adjusting the length of the pole 10 to a desired length by adjusting the connecting position of the outer pipe and the inner pipe of the pole 10 and performing further adjustment with the telescopic portions 101, 102 (or only with the telescopic portion 102) and then installing the pole 10 between the ceiling surface and the floor surface and moving the lower hub 12 upward to lock the lower hub 12 to the protruding portion 13.

Embodiment 2

Figure 9:
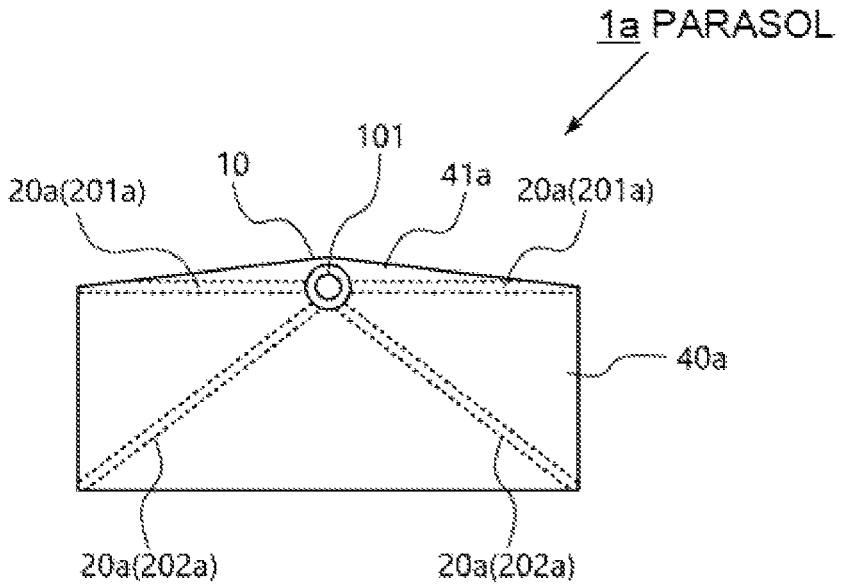
FIG. 9 is a top view of a parasol (Embodiment 2).

Next, embodiment 2 is described. Details described above for embodiment 1 are similarly applied. Differences from embodiment 1 are mainly described, and detail description of similar parts will be omitted. FIG. 9 is a top view of the parasol 1*a* according to the present embodiment.

Ribs 20*a* of the parasol 1*a* according to the present embodiment include two end rib parts 201*a* and two middle rib parts 202*a*. In the state where the parasol is opened and the lower hub 12 is positioned toward the upper side, four points formed by the tips of the two end rib parts 201*a* and the two middle rib parts 202*a* are arranged at the four vertices of the rectangle from the top view shown in FIG. 9. All the end rib parts 201*a* and the middle rib parts 202*a* are covered with a rectangular sheet 40*a* having four vertices which are the tips of the two end rib parts 201*a* and the two middle rib parts 202*a*.

In this way, despite that the parasol 1*a* has only a single pole 10, the shape of the sheet 40*a* can be a wide rectangular shape owing to the configuration in which four points, which are the tips of the two end rib parts 201*a* and the two middle rib parts 202*a*, are arranged at the four vertices of the rectangle from the top view.

Here, since the sheet 40*a* is provided to be inclined, the ribs 20*a* (end rib parts 201*a* and the middle rib parts 202*a*) are on the opposite side of the sheet 40*a*. In the drawings, the sheet 40*a* is illustrated to be transparent to allow the ribs 20*a* (end rib parts 201*a* and middle rib parts 202*a*) to be visible. The lower edge of the sheet 40*a* is indicated by a single-dot chain line. Obviously, the sheet 40*a* need not necessarily be transparent such that the ribs 20*a* (end rib parts 201*a* and middle rib parts 202*a*) are not visible.

Figure 10:
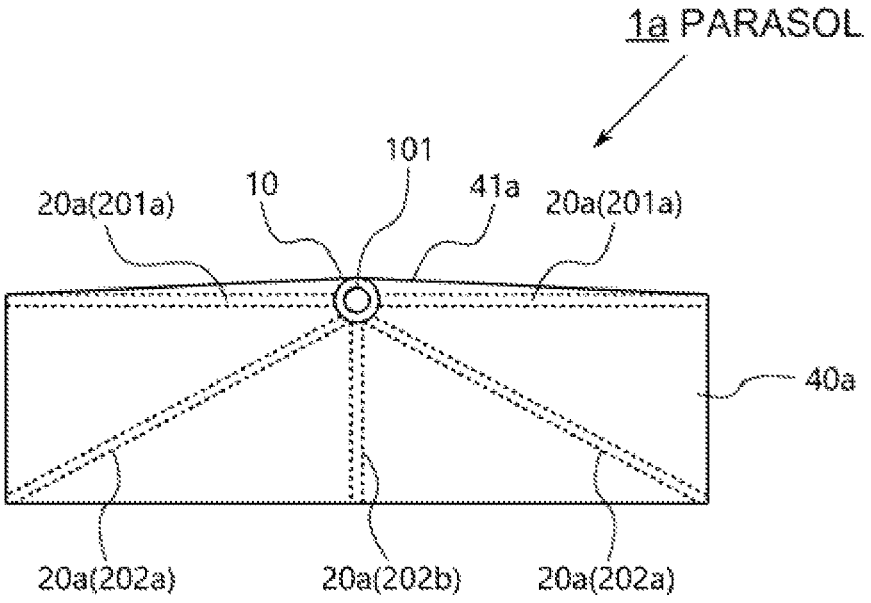
FIG. 10 is a top view of a parasol (Embodiment 2).

In order to prevent the sheet 40*a* from sagging, in a case where the parasol 1 is long in the lateral direction as shown in, for example, FIG. 10, a single middle rib part 202*b*, extending in the horizontal direction and perpendicular to the end rib part 201, may be provided in a state where the lower hub 12 is locked to the protruding portion 13. In this case, a strut 30 that connects the middle rib part 202*b* and the lower hub 12 is additionally provided.

Embodiment 3

Figure 11:
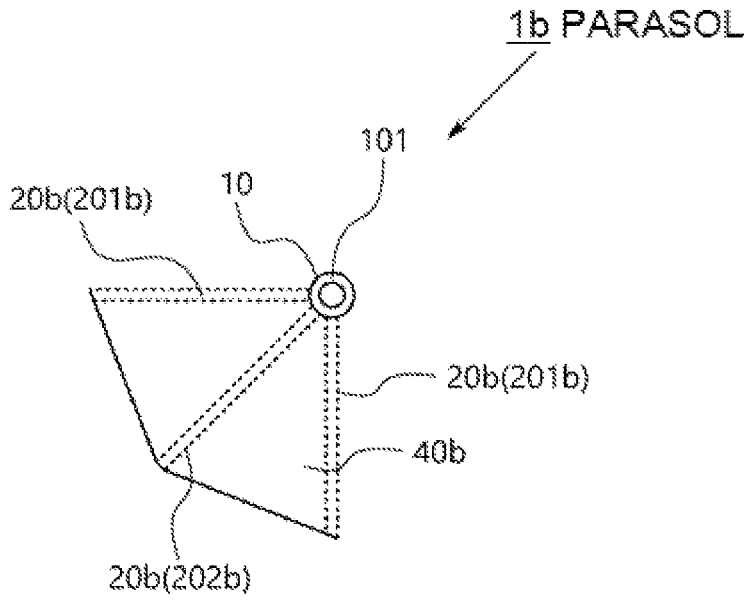
FIG. 11 is a top view of a parasol (Embodiment 3).

Next, embodiment 3 is described. Details described above for embodiments 1 and 2 are similarly applied. Differences from embodiments 1 and 2 are mainly described, and detail description of the similar parts will be omitted. FIG. 11 is a top view of a parasol 1*b* according to the present embodiment.

Ribs 20*b* of the parasol 1*b* according to the present embodiment include two end rib parts 201*b* and one middle rib part 202*b*. The two end rib parts 201*b* are arranged at an angle of 90 degrees. In the state where the parasol is opened and the lower hub 12 is positioned toward the upper side, the parasol has a quarter-circle shape from a top view as shown in FIG. 11.

Thus, owing to the quarter-circular shape from a top view, the parasol 1*b* can be installed at a corner of a building.

Embodiment 4

Next, embodiment 4 is described. Embodiment 4 relates to an adjustment mechanism for adjusting the length of the pole and may be applied to any of the parasol in embodiments 1, 2, 3 and the below-described embodiments 5 and 6. The configurations other than those of the pole 10 are the same as those of embodiments 1, 2 and 3. Description is centered on the pole 10, and detail description on other parts will be omitted.

Figure 12:
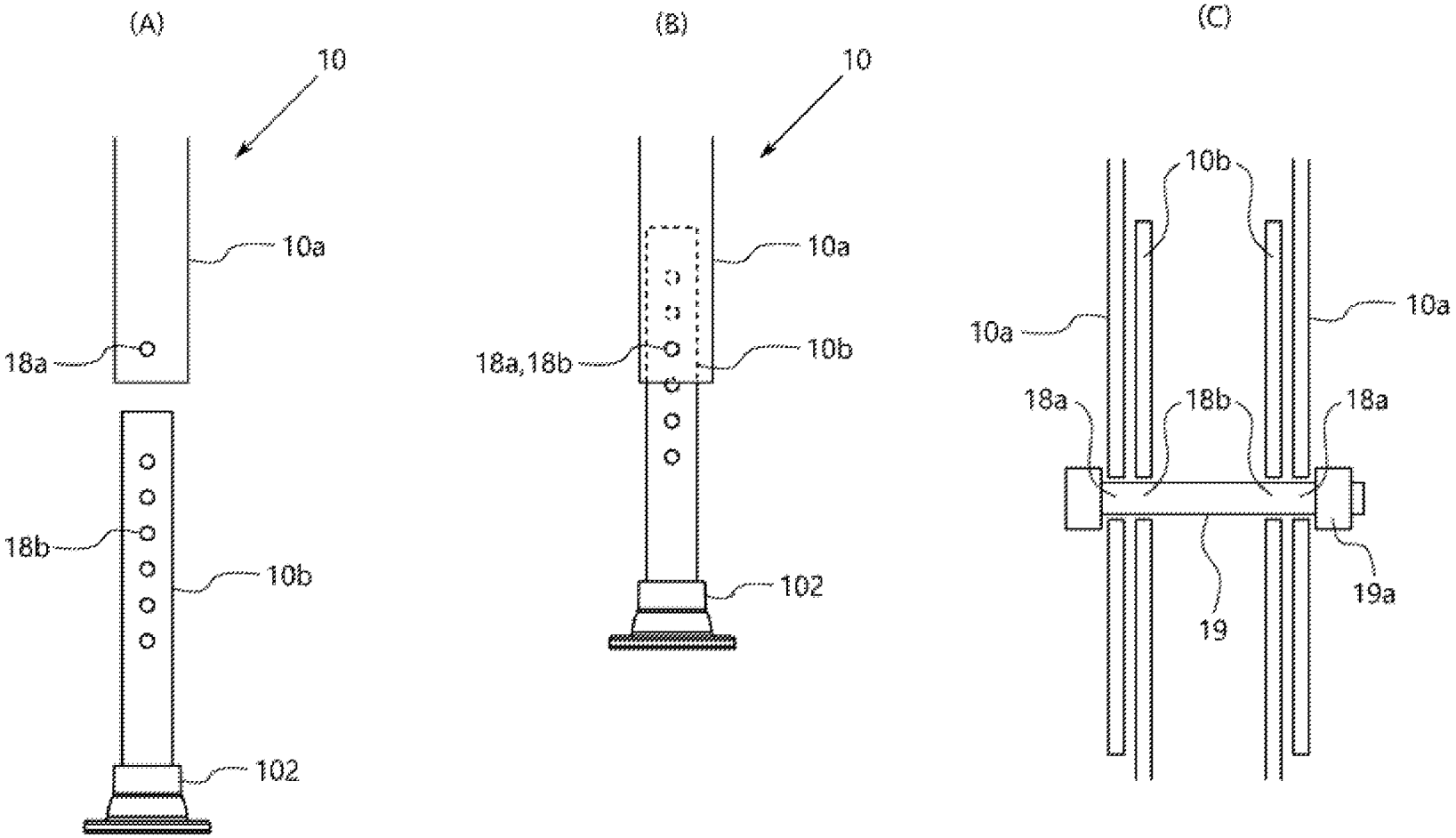
FIG. 12 is a diagram showing an arrangement of hole portions and a configuration of a pole (Embodiment 4).

FIG. 12 is a diagram showing a first adjustment mechanism of the pole 10 for adjusting length. With the adjustment mechanism shown in FIG. 12, the pole 10 can have its length significantly adjusted (e.g. 50 cm) by extending and shortening thereof (however, in some cases, adjustment need not necessarily be performed). FIG. 12(A) shows the pole 10 including an outer pipe 10*a* and an inner pipe 10*b* in which a hole portion 18*a* is provided in the outer pipe 10*a* and hole portions 18*b* are provided in the inner pipe 10*b*, respectively.

Figure 14:
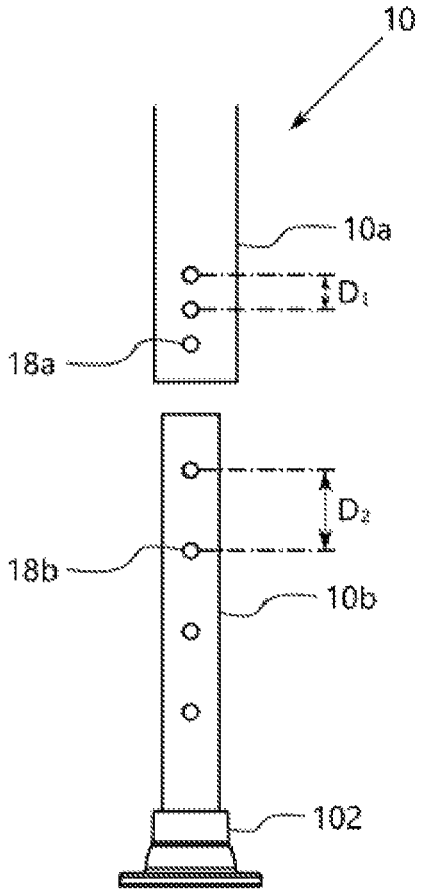
FIG. 14 is a diagram showing an arrangement of a hole portion and a configuration of a pole (Embodiment 4).

The inner pipe 10*b* is inserted into the outer pipe 10*a* to adjust the length of the inner pipe 10*b* extending from the outer pipe 10*a* (see FIG. 12(B)). Then, one of the plural hole portions 18*b* is matched with and fixed to the hole portion 18*a*. Thereby, the length can be adjusted by matching any of the plural hole portions 18*b* to the hole portion 18*a*. Alternatively, the hole portion 18*a* may be provided in plurals as illustrated in FIG. 14 and a single hole portion 18*b* may be provided.

Once the hole portion 18*b* that is to be matched to the hole portion 18*a* is determined, the length (vertical position of the hole portion 18*b*) is fixed by inserting the bar 19 into the hole portion 18*a* and the hole portion 18*b* as illustrated in FIG. 12(C) (sectional view showing the hole portions). For example, the bar 19 may be a bolt and may be stabilized by a nut 19*a*.

In this case, the protruding portion 13 or the handle 17*c* is provided on the outer pipe 10*a*. Since the position of the lower hub 12 (the position of the protruding portion 13) is defined when the parasol is in the opened state, it may be difficult to provide the protruding portion 13 or the handle 17*c* on the movable inner pipe 10*b*.

Here, the lower hub 12 is allowed to move about the periphery of the pole 10 at the upper side of the pole 10. Since the inner pipe 10*b* is inserted into the outer pipe 10*a* when extending and contracting the pole 10 itself, it is preferable that the upper side of the pole 10 serve as the outer pipe 10*a*.

FIG. 12 is a view showing the first adjustment mechanism of the pole 10 for adjusting the length whereas in the second adjustment mechanism shown in FIG. 13(A), a partial inner pipe 10*c* is provided, and the inner pipe 10*b* of FIG. 12(A) is formed by two partial inner pipes 10*b* and 10*c*. Accordingly, with the second adjustment mechanism of the pole 10, the length of the pole 10 is adjusted by extending and contracting the outer pipe 10*a*, the partial inner pipe 10*b*, and the partial inner pipe 10*c* that constitute the pole 10.

The partial inner pipe 10*c* has a reduced diameter at its lower end and can be inserted into the partial inner pipe 10*b*. Further, the upper side of the partial inner pipe 10*b* and the partial inner pipe 10*c* have the same diameter and both have hole portions 18*b* and 18*c*. That is, not only is it possible to use only the partial inner pipe 10*b* as the inner pipe (as in FIG. 12(B)) but also the partial inner pipe 10*c* may be inserted into the partial inner pipe 10*b*, such that the partial inner pipe 10*b* and the partial inner pipe 10*c* together can be used as the inner pipe. FIG. 13(B) shows a state where the partial inner pipe 10*b* and the partial inner pipe 10*c* are used together as the inner pipe.

The significance of the partial inner pipe 10*c* will be described. In the case shown in FIG. 12, the depth (that is, the adjustable amount of the length of the pole 10) to enable the outer pipe 10*a* to be inserted into the inner pipe 10*b* would be constrained due to, for example, the reel 17*b*. Here, in the case where the partial inner pipe 10*b* and the partial inner pipe 10*c* are used together as the inner pipe, the partial inner pipe 10*c* can be removed and allow only the partial inner pipe 10*b* to be used as the inner pipe if the outer pipe 10*a* is desired to be deeply inserted. Thereby, the outer pipe 10*a* can be further inserted to the extent equivalent to the length of the partial inner pipe 10*c*. That is, owing to the partial inner pipe 10*c*, it is possible to increase the amount in which the length of the pole 10 can be adjusted.

The partial inner pipe 10*c* is inserted into the outer pipe 10*a* as shown in FIG. 13C. Although it is possible to only use the partial inner pipe 10*b* as the inner pipe by removing the partial inner pipe 10*c* in which only a minute portion of the tip of the partial inner pipe 10*b* is inserted as shown in FIG. 13(C), this is not preferable. This is because the insertion depth of the partial inner pipe 10*b* is shallow, and the fixing with respect to the outer pipe 10*a* would not be sufficient. Thus, it is preferable to remove the partial inner pipe 10*c* in a case where there is a sufficient amount of insertion depth of the partial inner pipe 10*b*.

In this case, it would be necessary to modify the connection between the partial inner pipe 10*b* and the partial inner pipe 10*c*. Alternatively, it is possible to connect by using a bar 19 as in FIG. 12(C). However, the bar 19 (including the nut 19*a*) may protrude from the partial inner pipe 10*b* at the connecting portion. By this protruding portion, the partial inner pipe 10*b* may be prevented from being inserted into the outer pipe 10*a*. Therefore, it is preferable that the connection be made in a manner without any components from protruding outward, such as by way of engaging the partial inner pipe 10*c* with an expanding spring member extending from the partial inner pipe 10*c*. Note that connection is also possible by using the bar 19 if the connecting portion is sufficiently lowered by deeply inserting the partial inner pipe 10*c* into the partial inner pipe 10*b*.

Note that the partial inner pipe 10*c* is not limited to one but two or more may be used, so that the amount of adjusting the length of the pole 10 can be further increased.

Figure 13:
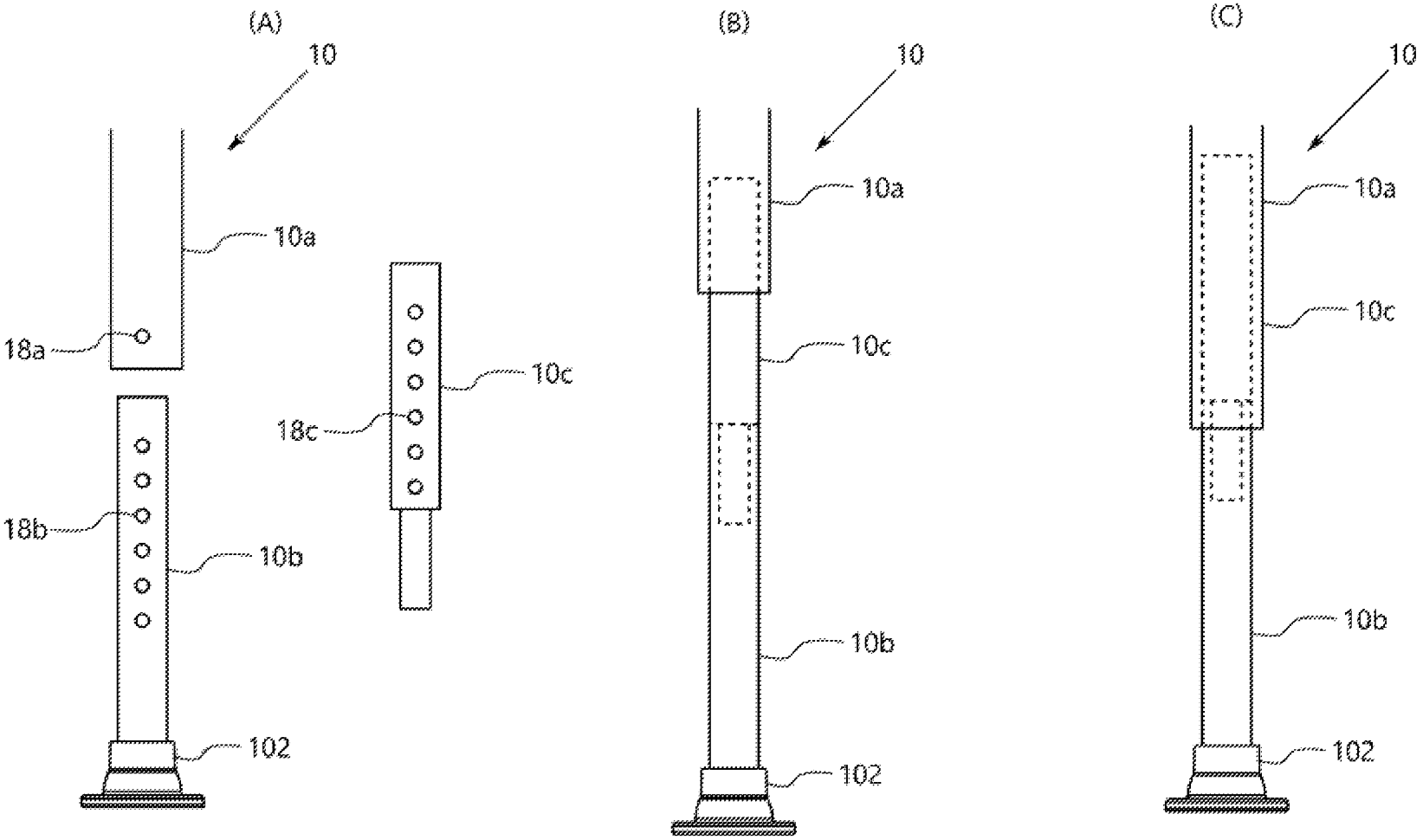
FIG. 13 is a diagram showing an arrangement of a hole portion and a configuration of a pole (Embodiment 4).

FIG. 14 is a diagram showing the arrangement of the hole portions. The hole portion 18*a* which is illustrated as a single hole in FIGS. 12 and 13 is provided as three holes. Here, the interval D2 of the hole portions 18*b* is three times the interval D1 of the hole portions 18*a*.

It is possible to set the length of the pole 10 by selecting the hole portion 18*a* and the hole portion 18*b* for inserting the bar 19 (connecting member) in increments of D1. In a case where "L" is the insertion length upon matching the hole portion 18*b* to the lowermost hole portion 18*a*, the insertion length can be set to L+D1, L+2D1 by matching the hole portion 18*b* to the other hole portions 18*a*. The insertion length "L+3D1" can be realized by selecting another hole portion 18*b*. That is, it is possible to set the length of the pole 10 in increments of D1. For example, supposing that D1=2 cm, D2=6 cm, the length of the pole 10 can be set in increments of 2 cm.

Generally, the hole portions 18*a* are not limited to three, as long as D2=nD1 where the number of the hole portions is n. The number of hole portions 18*a*, 18*b*, may be determined by considering, for example, the material and strength of the pole 10.

Here, D1 is further described. First, the pole 10 itself is extended or shortened to match an approximate length in increments of D1. Then, a finer adjustment of the length can be made with the telescopic portion 101 and 102 (or the telescopic portion 102 only). That is, if D1 is less than the length adjustable by the telescopic portion 102, the length of the pole 10 can be any given length.

Embodiment 51

Next, embodiment 5 is described. Details described above for embodiments 1 to 4 are similarly applied. Differences between the pole 100 of the present embodiment and the pole 10 of embodiments 1 to 4 are mainly described, and detail description of the similar parts will be omitted. Note that the pole 100 of the present embodiment may be applied to any of the parasols 1 of embodiments 1 to 3.

The conventional shade/rain shield apparatuses, such as a parasol or an awning, often provide an umbrella at a relatively high position (position distanced far from the ground) such as at the eaves of a building to create a shade outdoors or serve as a sunshade of the building for preventing indoor temperature from rising or for providing a rain shielding effect. However, although conventional shade apparatuses can provide sunshade/rain shielding functionality at high positions, they are not designed to ensure sunshade/rain shielding functionality at relatively low positions. Many of those are not expected to ensure a sun/rain shielding function at a low position (a position where the distance near to the ground), such as shielding from the sun/rain in a case of working while sitting on the floor, shielding pets such as dogs from the sun/rain, or shielding bicycles and motorcycles from the sun/rain. As an example, there is a parasol that uses a base (a member that grasps the lower end of a pole) to hold the pole in an upright position. This parasol, however, cannot provide a sun/rain shielding function at a low position because the umbrella is fixed to the pole so that the umbrella is positioned 2.5 meters from the ground. Therefore, it is desirable to have a sunshade/rain shield apparatus with a structure that can provide a sun/rain shielding function from a high position (a position where the distance is far from the ground) to a low position while maintaining stability with the tension (pressing) force between the floor and the ceiling, such that it can be used to accommodate a wide range of applications. In other words, in addition to being able to accommodate various installation locations by the functions described in embodiments 1 to 4, a sunshade/rain shielding apparatus that can adjust the height of the umbrella according to the application from a high position to a low position is desirable.

In addition, in many cases, a sunshade/rain shield apparatus of the tension rod-type has problems such as enlargement of packing material at the stage of transporting due to, for example, a long pole being formed with a length corresponding to the height of the eaves, etc. and due to the sunshade/rain shield apparatus being formed with an increased size. Further, the cost increases as the strength performance is improved. Further, the transporting costs increases as the size of the package increases. Such problems may apply to the above-described pole 10 in embodiment 4. The pole 10 in the above-described embodiments 1 to 4 mainly include the outer pipe 10*a* and the inner pipe 10*b* inserted into the outer pipe 10*a* (see FIG. 12).

Further, with the pole 10 illustrated in FIG. 13(B), a configuration allowing the pole 10 to be longer is used. Specifically, with the pole 10, the inner pipe 10*b* is divided into two partial inner pipes 10*b* and 10*c*, and the pole 10 mainly includes an outer pipe 10*a*, a partial inner pipe 10*c* inserted into the outer pipe 10*a*, and a partial inner pipe 10*b* which is inserted through the partial inner pipe 10*c* (see FIG. 13).

On the other hand, the below-described pole 100 of embodiment 5 not only includes the outer pipe 110*a* and the partial inner pipes 110*b* and 110*c* but also includes a ceiling pipe 110*d* attached to the upper end of the outer pipe 110*a*. The pole 100 is used by combining the outer pipe 110*a*, the partial inner pipe 110*b*, the partial inner pipe 110*c* (the partial inner pipes 110*b*, 110*c* also serving as a "lower side pipe" herein), and the ceiling pipe 110*d*, and suitably adjusting thereof in accordance with the distance between the ceiling and the floor in which the pole 100 is extended. Further, similar to the outer pipe 10 of embodiments 1 to 4, the pole 100 of embodiment 5 also has a length adjustment function corresponding to the height from the floor to the ceiling. However, the outer pipe 110*a* to which a handle operation unit having a lever is attached is different from the outer pipe 110*a* of embodiments 1 to 4 (see FIG. 15 to FIG. 22) in that the outer pipe 110*a* is shorter than the outer pipe 110*a* of embodiments 1 to 4. Further, although the pipe constituting the pole of the present embodiment is different from the pipe constituting the pole of embodiments 1 to 4, the basic operation for installing the pole of the tension rod-type is the same as that of the embodiments 1 to 4. That is, the adjustment operation is the same in that the length of the pole is adjusted to a desired length by adjusting the connection portion of, for example, the outer pipe and the inner pipe of the pole, and then using the telescopic portion to adjust the length of the pole to match the distance between the floor surface and the ceiling surface of the eaves of a building.

That is, the parasol 1000 of the fifth embodiment enables smaller packaging and less transportation cost while maintaining the advantages of the parasol 1 of the first to fourth embodiments such as stability by tension force and easy installation. Further, with the below-described pole 100 of the fifth embodiment, the pole 100 is firmly tensioned (urged) between the ceiling surface and the floor surface while preventing the sheet 40 from excessively rising to a high position by providing a ceiling pipe 110*d* that is separate from the outer pipe 110*a*. Thereby, an ideal sunshade effect or the like can be attained.

Figure 15:
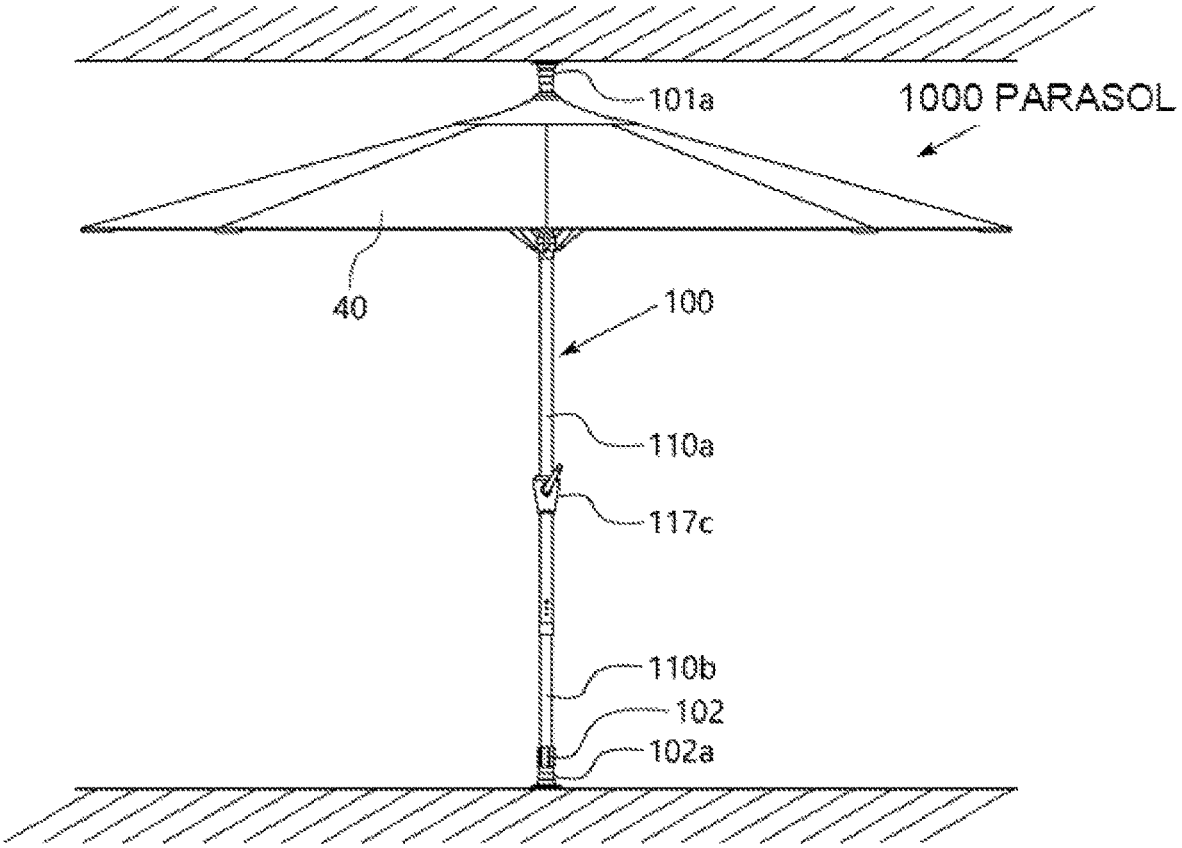
FIG. 15 is a front view of a parasol in which a pole including an outer pipe and a partial inner pipe is in its shortest state (Embodiment 5).

FIG. 15 is a front view of the parasol 1000 with the shortest state of the pole 100 including the outer pipe 110*a* and the partial inner pipe 110*b*. FIG. 15 shows an embodiment in which the pole 10 is adjusted to a length suitable for a case where the distance between the ceiling and the floor is shortest. Here, "the shortest state of the pole 100 including the outer pipe 110*a* and the partial inner pipe 110*b*" refers to a state in which the hole portion of the outer pipe 110*a* (in the case of plural hole portions, the hole portion located farthest from the floor) is fixed to the hole portion located nearest from the floor among the hole portions of the inner pipe 110*b*. In the present embodiment, a handle operation unit 117*c* having a handle is attached to the outer pipe 110*a*. Because the mechanism for operating the handle of the handle operation unit 117*c* by winding a wire on a reel and moving a lower hub upward is the same as that described with reference to FIG. 7, detailed description thereof will be omitted.

Note that, the handle operation unit 117*c* including the handle is attached to the outer pipe 110*a* because it would be difficult to provide the handle operation unit 117*c* including the handle to the movable inner pipe 110*b* in a manner similar to the above-described embodiments. However, with the pole 100 of the present embodiment, the outer pipe 110*a* are to be made shorter. Accordingly, the inner pipe 110*b* and the inner pipe 110*c* are also made to be shorter. Thus, although the maximum length of these pipes becomes shorter, a ceiling pipe 110*d* serves to compensate for the shortened length, so that the maximum length of the pole 100 can be equal to or greater than that of the pole 10 of embodiments 1 to 4. Further, because the partial outer pipe 110*a*, the partial inner pipe 110*b*, and the partial inner pipe 110*c* can be shortened by the usage of the ceiling pipe 110*d*, the space inside the outer pipe 110*a* attained by the shortening allows a more robust and larger handle operation unit 117*c* to be attached to the outer pipe 110*a*.

Figure 16:
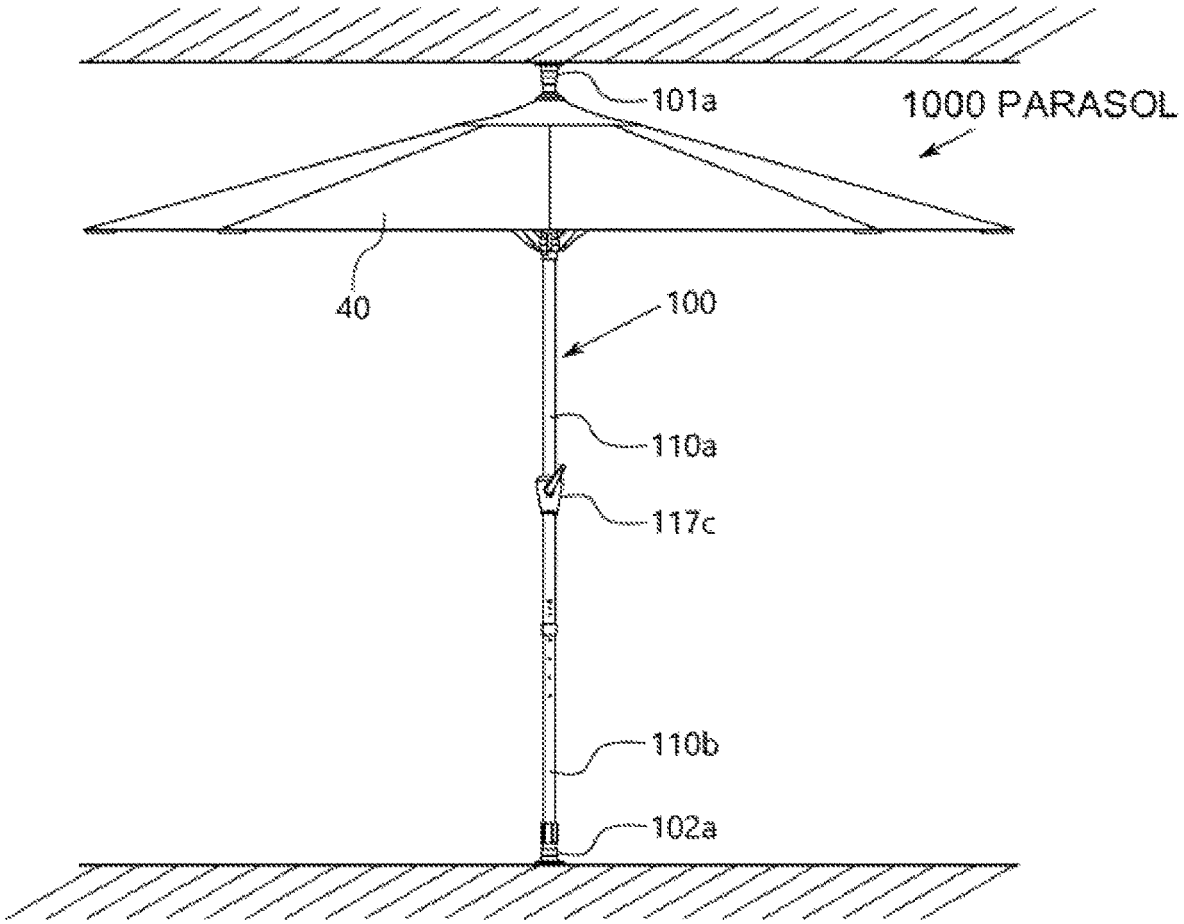
FIG. 16 is a front view of a parasol 1000 in which a pole including an outer pipe and a partial inner pipe is in its longest state (Embodiment 5).

FIG. 16 is a front view of the parasol 1000 with the longest state of the pole 100 including the outer pipe 110*a* and the partial inner pipe 110*b*. Here, the "longest state of the pole 100 including the outer pipe 110*a* and the partial inner pipe 110*b*" refers to a state in which the hole portion of the partial outer pipe 110*a* (in the case of plural hole portions, the hole portion located closest to the floor) is fixed to the hole portion located farthest from the floor among the hole portions of the partial inner pipe 110*b*.

Figure 17:
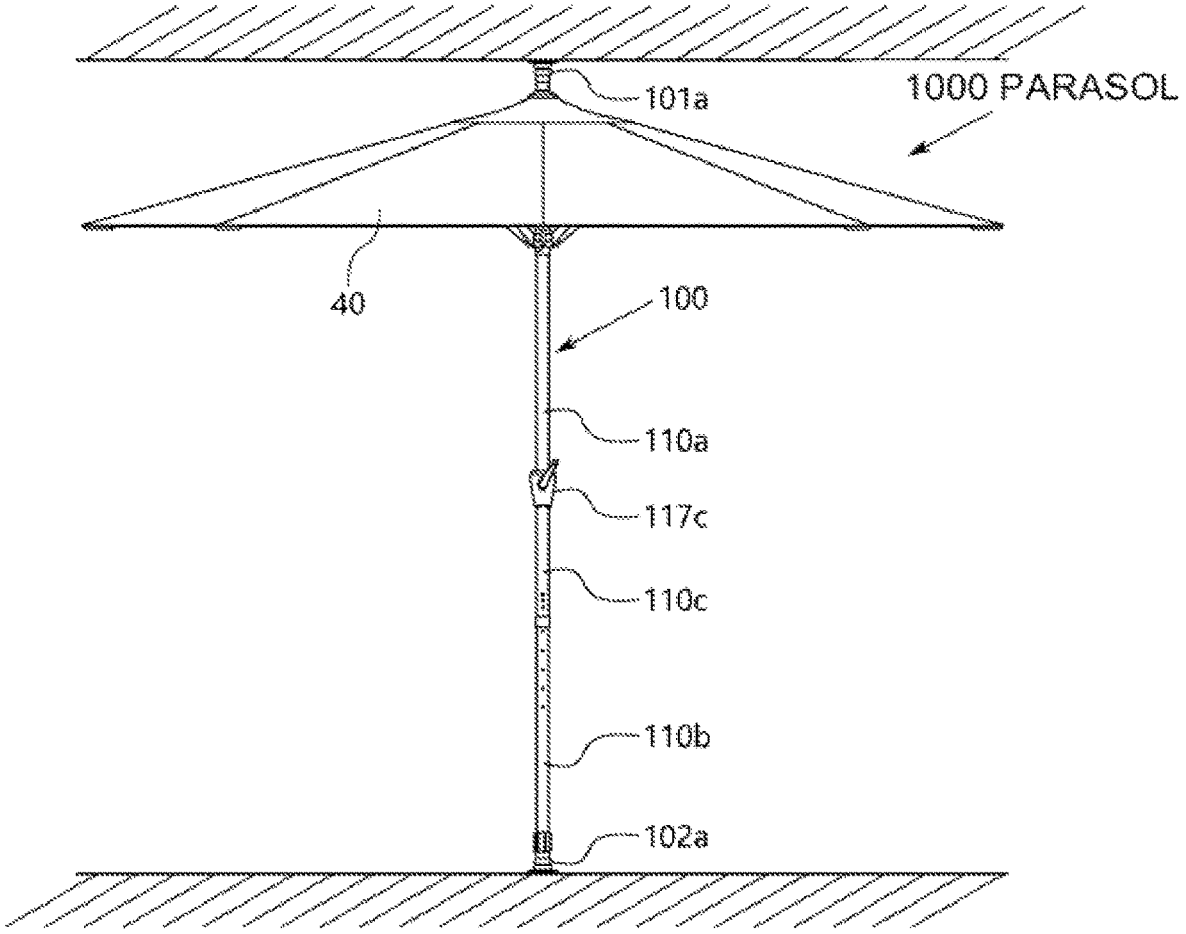
FIG. 17 is a front view of a parasol in which a pole including an outer pipe, a partial inner pipe, and another partial inner pipe is in its shortest state (Embodiment 5).

FIG. 17 is a front view of the parasol 1000 with the shortest state of the pole 100 including the outer pipe 110*a*, the partial inner pipe 110*b*, and the partial inner pipe 110*c*. Here, as in the example of FIG. 13C, the partial inner pipe 110*c* is inserted into the partial inner pipe 110*b*, and the partial inner pipe 110*b* and the partial inner pipe 110*c* are used together as the inner pipe. The connection between the partial inner pipe 110*b* and the partial inner pipe 110*c* may be performed with a connection method that uses no outwardly protruding member as described above (e.g., by engaging the partial inner pipe 110*b* with an expansion spring member (not shown) extending from the partial inner pipe 110*c*). Alternatively, an expansion spring member may be provided at the upper end of the partial inner pipe 110*b*, and the partial inner pipe 110*b* and the partial inner pipe 110*c* may be pressed together by the elastic force of the expansion spring member. Further, the "shortest state of the pole 100 including the outer pipe 110*a*, the partial inner pipe 110*b*, and the partial inner pipe 110*c*" refers to a state in which the outer pipe 110*a* and the partial inner pipe 110*c* are fixed by matching the hole portion (in the case of plural hole portions, the hole portion located farthest from the floor) of the outer pipe 110*a* with the hole portion located nearest from the floor among the hole portions of the partial inner pipe 110*c*.

Figure 18:
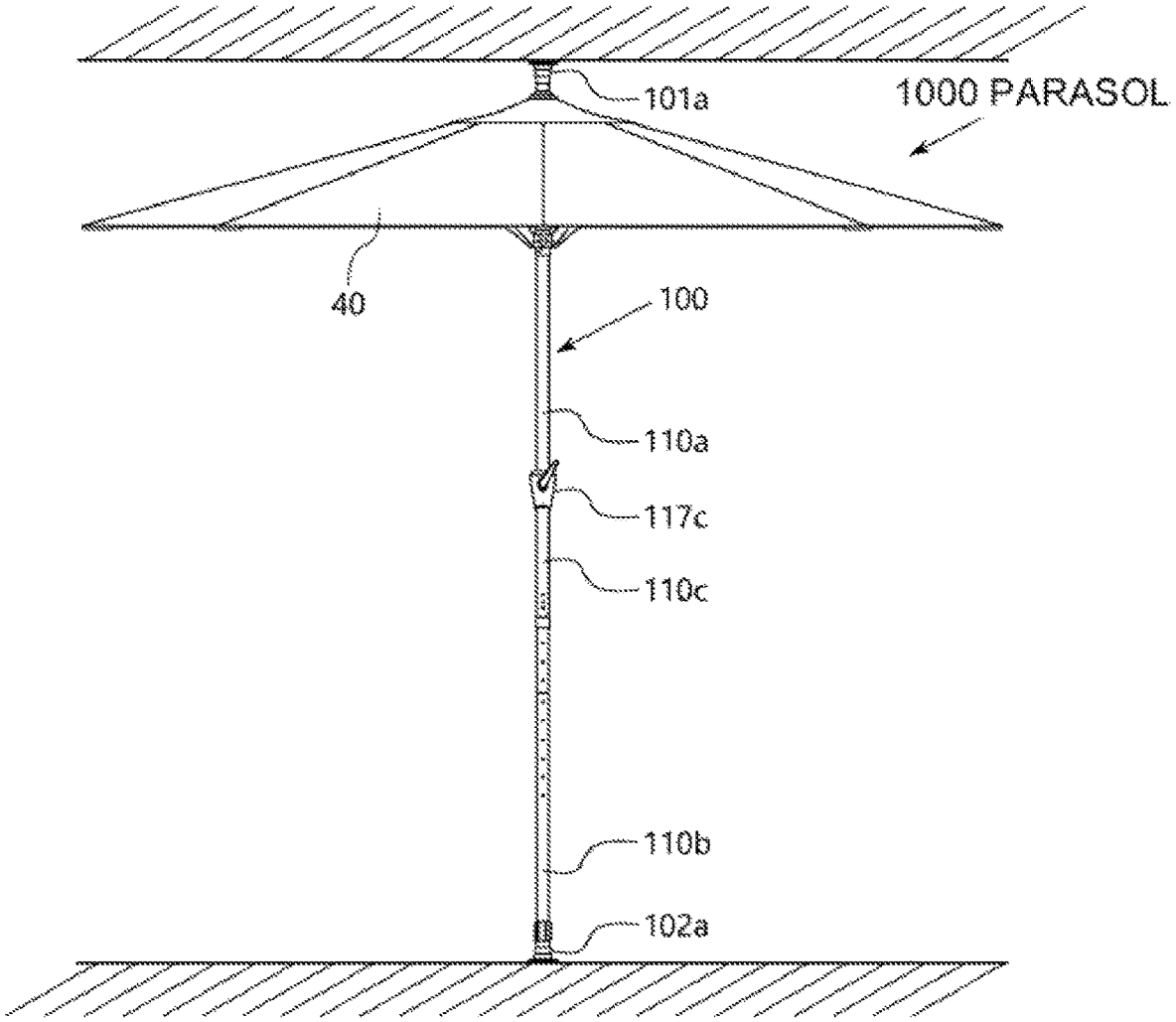
FIG. 18 is a front view of a parasol in which a pole including an outer pipe, a partial inner pipe, and another partial inner pipe is in its longest state (Embodiment 5).

FIG. 18 is a front view of the parasol 1000 with the longest state of the pole 100 including the outer pipe 110*a*, the partial inner pipe 110*b*, and the partial inner pipe 110*c*. Here, the "longest state of the pole 100 including the outer pipe 110*a*, the partial inner pipe 110*b*, and the partial inner pipe 110*c*" refers to a state in which the hole portion of the outer pipe 110*a* (in the case of plural hole portions, the hole portion located closest to the floor) is fixed to the hole portion located farthest from the floor among the hole portions of the partial inner pipe 110*c*.

Figure 19:
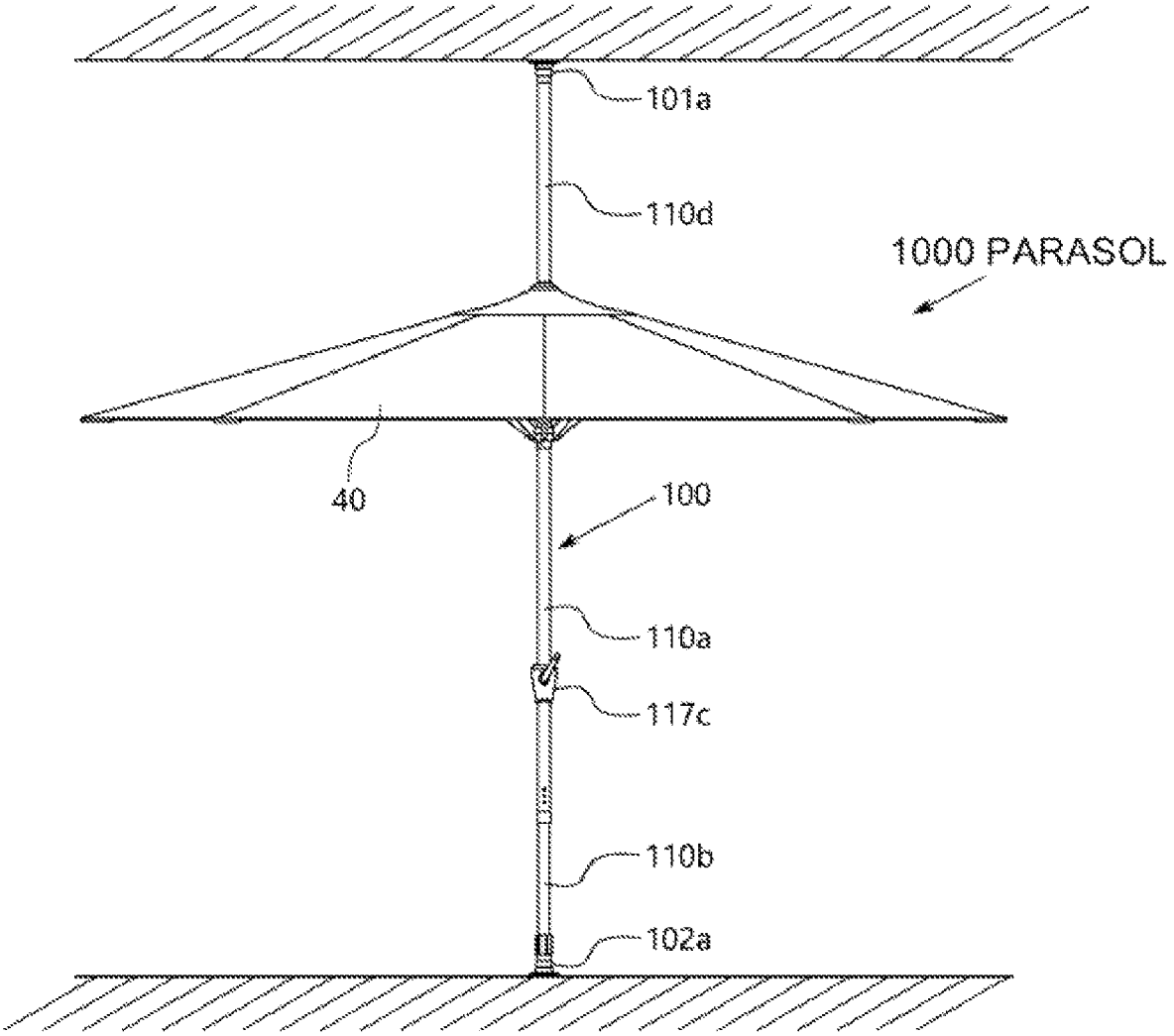
FIG. 19 is a front view of a parasol in which a pole including an outer pipe, a partial inner pipe, and a ceiling pipe is in its shortest state (Embodiment 5).

FIG. 19 is a front view of the parasol 1000 with the shortest state of the pole 100 including the outer pipe 110*a*, the partial inner pipe 110*b*, and the ceiling pipe 110*d*. Here, the "shortest state of the pole 100 including the outer pipe 110*a*, the partial inner pipe 110*b*, and the ceiling pipe 110*d*" refers to a state in which the upper end of the outer pipe 110*a* and the lower end of the ceiling pipe 110*d* are connected to each other, and the hole portion of the outer pipe 110*a* (in the case of plural hole portions, the hole portion located farthest from the floor) is fixed to the hole portion located nearest from the floor among the hole portions of the inner pipe 110*b*. Here, since the adjustment of the length of the pole 100 is performed by setting the positions of the hole portion of the outer pipe 110*a* and the hole portion of the partial inner pipe 110*b*, the ceiling pipe 110*d* is formed to have a predetermined length and is not formed having plural hole portions for the purpose of length adjustment unlike the inner pipe 110*b*. However, a hole portion is provided in each of the upper end of the outer pipe 110*a* and the lower end of the ceiling pipe 110*d*, and the ceiling pipe 110*d* is inserted into the outer pipe 110*a*. Then, the hole portion of the ceiling pipe 110*d* to be matched with the hole portion of the outer pipe 110*a* is determined, and a bar is inserted into the hole portion of the outer pipe 110*a* and the hole portion of the ceiling pipe 110*d*, so that the length (position of the hole portions in the vertical direction) is fixed as in the same manner as in FIG. 12C (cross-sectional view showing the hole portions). For example, the bar may be a bolt may be stabilized by a nut 19*a*.

FIGS. 19 to 22 illustrate a configuration having the ceiling pipe 110*d* interposed between the ceiling and the outer pipe 110*a* and engaging a convex connection surface of the pad 101*a* with a concave connection surface of the ceiling pipe 110*d* (as shown in FIG. 8B), so that the pole 100 can be prevented from rotating.

Figure 20:
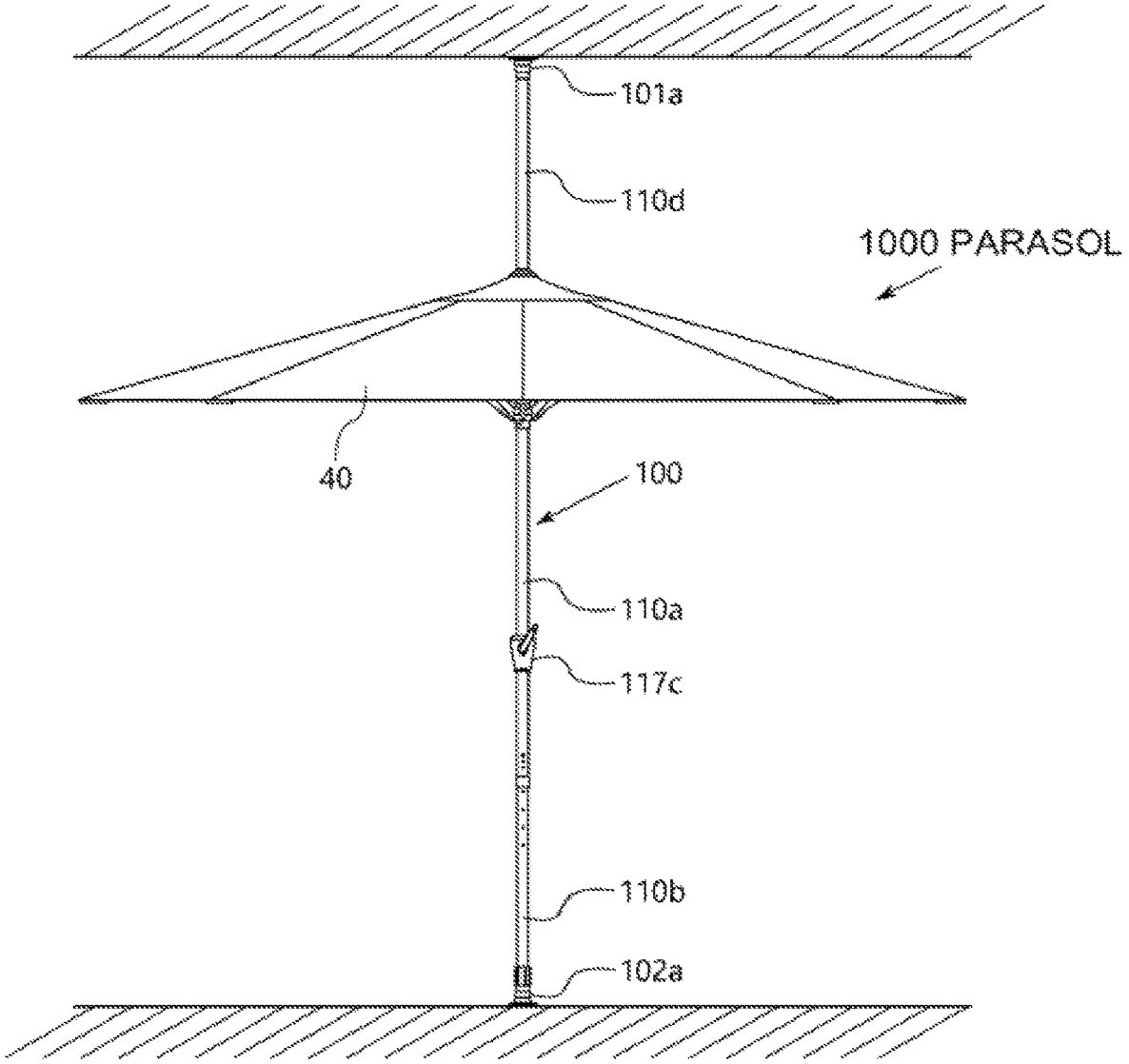
FIG. 20 is a front view of a parasol in which a pole including an outer pipe, a partial inner pipe, and a ceiling pipe is in its longest state (Embodiment 5).

FIG. 20 is a front view of the parasol 1000 with the longest state of the pole 100 including the outer pipe 110*a*, the partial inner pipe 110*b*, and the ceiling pipe 110*d*. Here, the "longest state of the pole 100 including the outer pipe 110*a*, the partial inner pipe 110*b*, and the ceiling pipe 110*d*" refers to a state in which the upper end of the outer pipe 110*a* and the lower end of the ceiling pipe 110*d* are connected to each other, and the hole portion of the outer pipe 110*a* (in the case of plural hole portions, the hole portion located closest to the floor) is matched and fixed to the hole portion located farthest from the floor among the hole portions of the inner pipe 110*b*.

Figure 21:
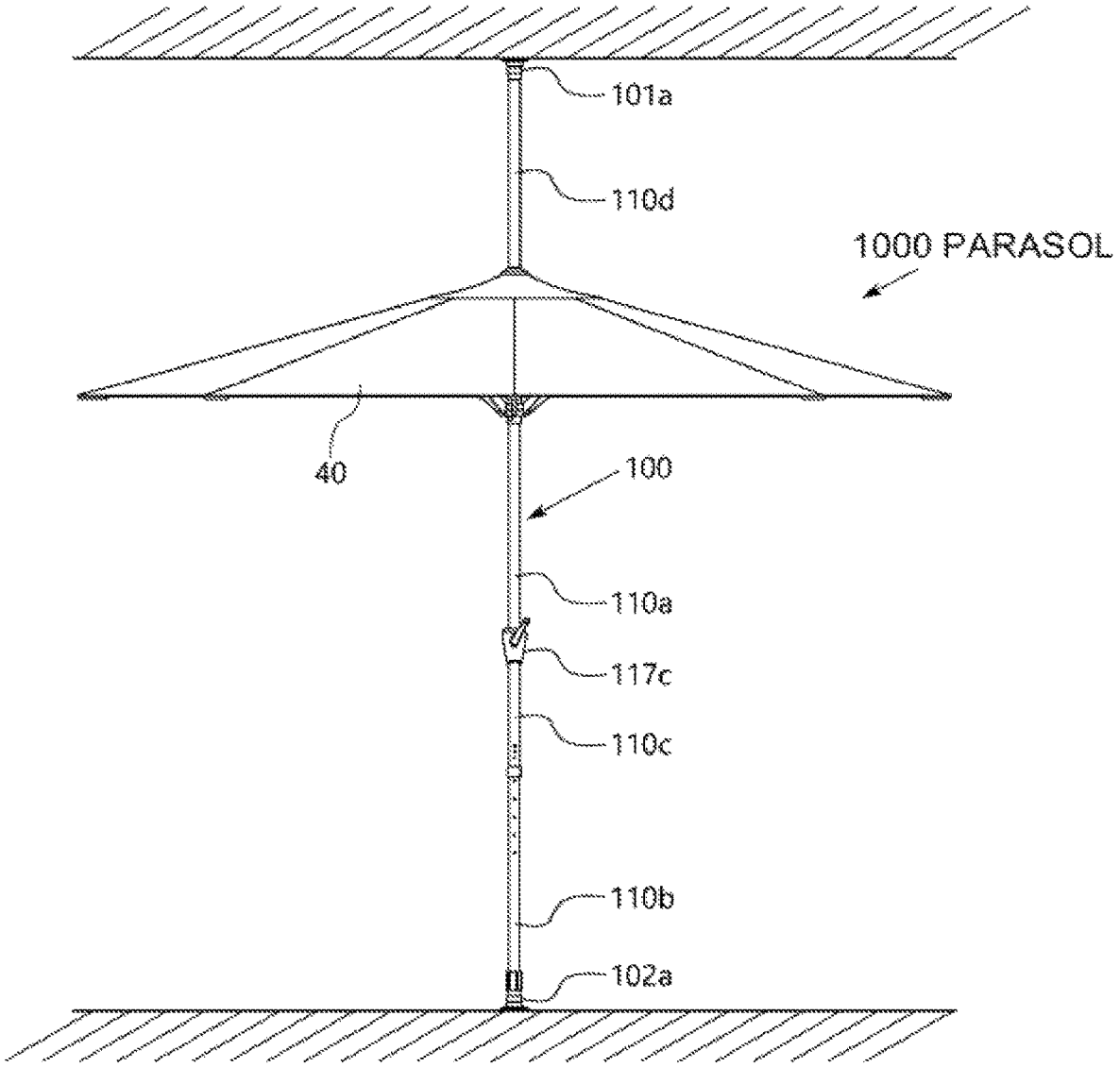
FIG. 21 is a front view of a parasol in which a pole including an outer pipe, a partial inner pipe, a partial inner pipe, and a ceiling pipe is in its shortest state (Embodiment 5).

FIG. 21 is a front view of the parasol 1000 with the shortest state of the pole 100 including the outer pipe 110*a*, the partial inner pipe 110*b*, the partial inner pipe 110*c*, and the ceiling pipe 110*d*. Similar to FIG. 17, the partial inner pipe 110*c* is inserted into the partial inner pipe 110*b*, and the partial inner pipe 110*b* and the partial inner pipe 110*c* are used together as the inner pipe. Then, the "shortest state of the pole 100 including the partial inner pipe 110*b*, the partial inner pipe 110*c*, and the ceiling pipe 110*d*" refers to a state in which the upper end of the outer pipe 110*a* is connected to the lower end of the ceiling pipe 110*d*, and the hole portion of the outer pipe 110*a* (in the case of plural hole portions, the hole portion located farthest from the floor) is matched to the hole portion located closest to the floor among the hole portions of the partial inner pipe 110*c*, so that the outer pipe 110*a* and the partial inner pipe 110*c* are fixed to each other.

Figure 22:
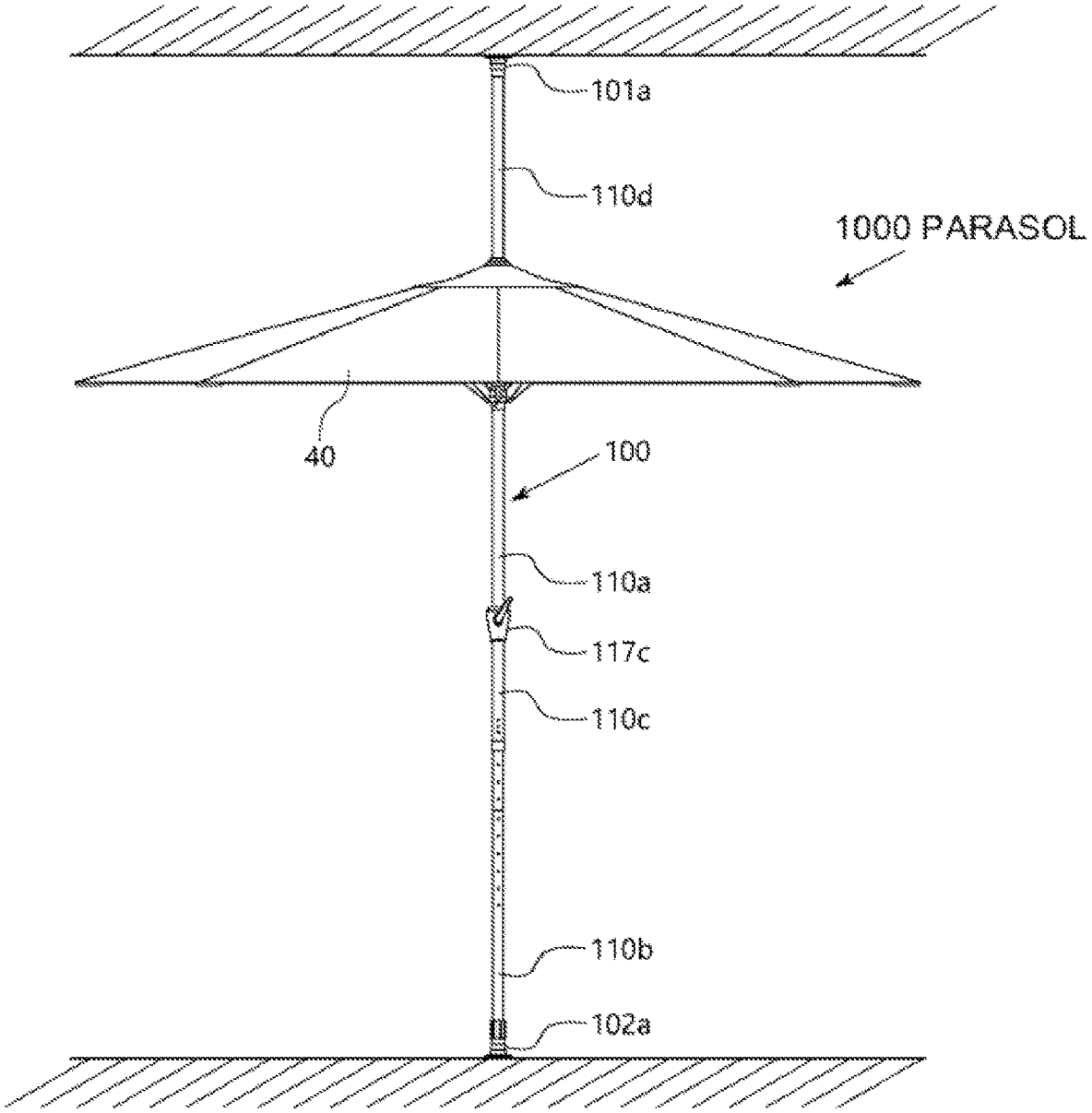
FIG. 22 is a front view of a parasol in which a pole including an outer pipe, a partial inner pipe, a partial inner pipe, and a ceiling pipe is in its longest state (Embodiment 5).

FIG. 22 is a front view of the parasol 1000 with the longest state of the pole 100 including the outer pipe 110*a*, the partial inner pipe 110*b*, the partial inner pipe 110*c*, and the ceiling pipe 110*d*. Here, the "longest state of the pole 100 including the outer pipe 110*a*, the partial inner pipe 110*b*, the partial inner pipe 110*c*, and the ceiling pipe 110*d*" refers to a state in which the upper end of the outer pipe 110*a* and the lower end of the ceiling pipe 110*d* are connected, and the hole portion of the outer pipe 110*a* (in the case of plural hole portions, the hole portion located closest to the floor) is matched to the hole portion located farthest from the floor among the hole portions of the partial inner pipe 110*c*, so that the outer pipe 110*a* and the partial inner pipe 110*c* are fixed to each other.

As described above, by providing the ceiling pipe 110*d* shown in FIGS. 19 to 22, it is possible to prevent the sheet 40 from unnecessarily rising to a high position while firmly tensioning (urging) the pole 100 between the ceiling surface and the floor surface. Accordingly, an ideal sun and rain shielding effect or the like can be ensured by installing the sheet 40 at a desired height. Further, as shown in FIGS. 15 to 22 of the present embodiment, although the length of the pole 100 is adjusted according to the height from the floor to the ceiling, the length of the outer pipe 110*a* to which the handle operation unit 117*c* is attached remains the same. In addition, with the parasol 1000 of the present embodiment, it can be said that the length adjustment of the pole 100 is realized without changing the length of the outer pipe 110*a* that is the longest among the outer pipe 110*a*, the partial inner pipe 110*b*, the partial inner pipe 110*c*, and the ceiling pipe 110*d* constituting the pole 10.

Note that, in this embodiment, the length of the ceiling pipe 110*d* is fixed and not changeable, and the ceiling pipe 110*d* is formed with a predetermined length from the ceiling surface. Alternatively, in order to prevent the sheet 40 from rising to a position higher than necessary and adjust the sheet 40 to a desired height, one or more holes may be provided at the upper end of the outer pipe 110*a* and the lower end of the ceiling pipe 110*d*, respectively, so that the length of the ceiling pipe 110*d* can be adjustable in a manner similar to the adjustment of the outer pipe and the inner pipe shown in FIG. 14. Although it is possible to increase the adjustable amount of the length of the pole 10 by using not only one but two or more of the partial inner pipe 110*b*, the partial inner pipe 10*c*, and the ceiling pipe 110*d*, the pole 100 of the present embodiment is constituted by four pipes, namely, the outer pipe 110*a*, the partial inner pipe 110*b*, the partial inner pipe 110*c*, and the ceiling pipe 110*d* from the viewpoint of reducing the number of parts/components of the parasol 1000.

Comparative Example

Figure 23:
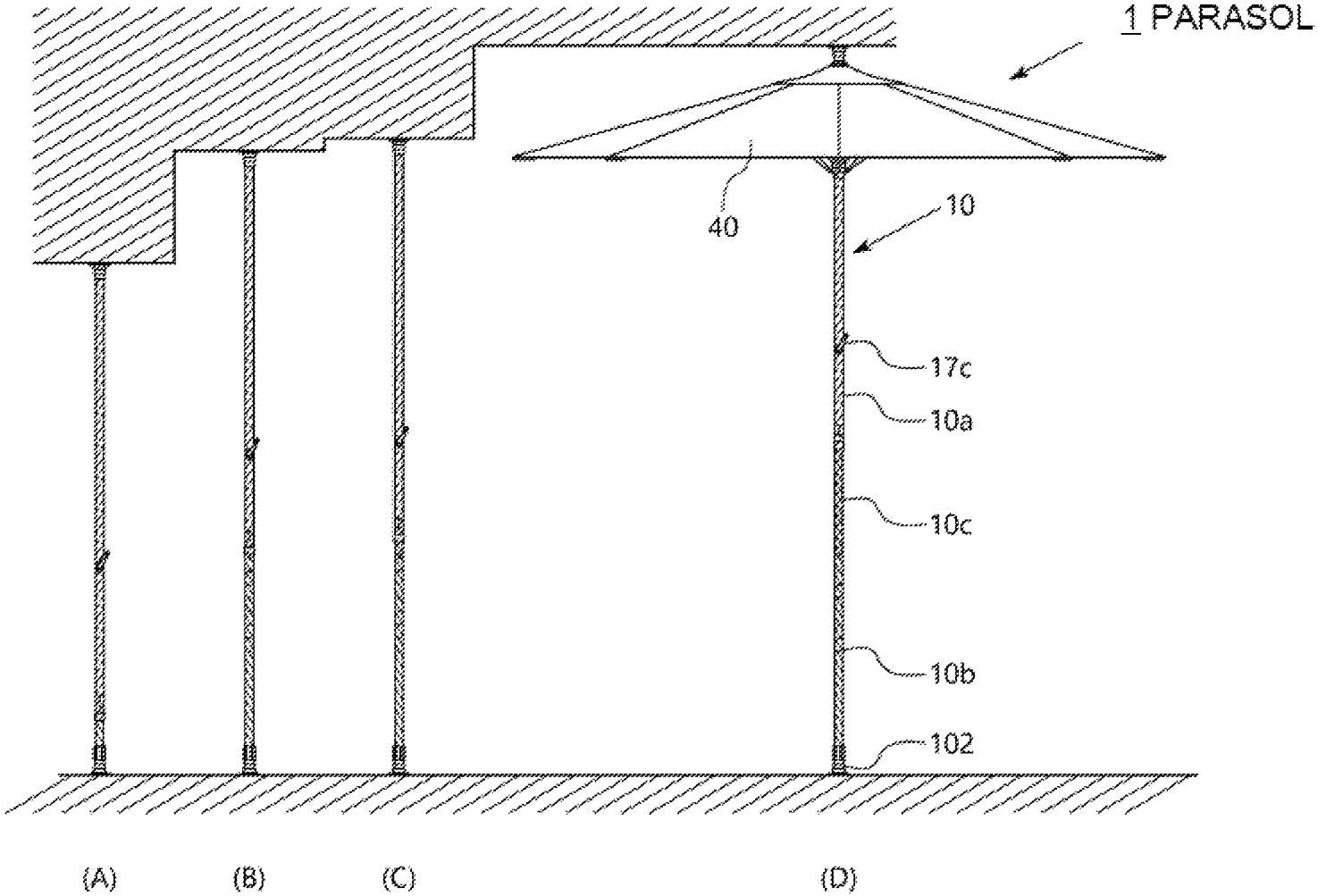
FIG. 23 is a diagram of a parasol including a pole for explaining the length of the pole, an open position of the parasol, and the relationship between the dimensions of the packaging material.

Next, with reference to FIG. 23, the parasol 1 including the pole 10 is described as a comparative example for explaining the relation of the length of the pole, the opening position of the parasol, and the dimensions of the packaging material. For the convenience of explanation, the sheet 40 is omitted in (A) to (C) of FIG. 23, and the outer pipe 10*a*, the partial inner pipe 10*b*, and the partial inner pipe 10*c* are illustrated with different hatchings, respectively.

(A) of FIG. 23 shows the pole 10 including the outer pipe 10*a* and the inner pipe 10*b* in which the pole 10 is adjusted to its shortest state. In the case where the pole 10 in the shortest state, the hole portion 18*a* of the outer pipe 10*a* (in the case of plural hole portions 18*a*, the hole portion 18*a* located farthest from the floor) is matched and fixed to the hole portion 18*b* of the partial inner pipe 10*b* among the hole portions 18*b* closest from the floor. In the example of (A) of FIG. 23, the distance from the floor to the ceiling is approximately 200 cm, and the length of the outer pipe 10*a* is approximately 183 cm.

(B) of FIG. 23 shows the longest state of the pole 10 including the outer pipe 10*a* and the partial inner pipe 10*b*. In the case where the pole 10 is in its longest state, the hole portion 18*a* of the outer pipe 10*a* (when the case of plural hole portions 18*a*, the hole portion 18*a* located closest from the floor) is matched and fixed to the hole portion 18*b* farthest from the floor among the hole portions 18*b* of the partial inner pipe 10*b*. In the example of (B) of FIG. 23, the distance from the floor to the ceiling is approximately 250 cm. However, similar to that of (A) of FIG. 23, the length of the outer pipe 10*a* is approximately 183 cm.

(C) of FIG. 23 shows the pole 10 including the outer pipe 10*a*, the partial inner pipe 10*b*, and the partial inner pipe 10*c* in which the pole 10 is adjusted to its shortest state. In the case where the pole 10 is in the shortest state, the hole portion 18*a* of the outer pipe 10*a* (in the case of plural hole portions 18*a*, the hole portion 18*a* located farthest from the floor) is matched and fixed to the hole portion 18*c* closest from the floor among the hole portions 18*c* of the partial inner pipe 10*c*. In the example of (C) of FIG. 23, the distance from the floor to the ceiling is approximately 252 cm. However, similar to that of FIG. 15, the length of the outer pipe 10*a* is approximately 183 cm.

(D) in FIG. 23 shows the pole 10 including the outer pipe 10*a*, the partial inner pipe 10*b*, and the partial inner pipe 10*c* in which the pole 10 is in its longest state. In the case where the pole 10 is in its longest state, the hole portion 18*a* of the outer pipe 10*a* (in the case of plural hole portions 18*a*, the hole portion 18*a* located closest from the floor) is matched and fixed to the hole portion 18*c* farthest from the floor among the hole portions 18*b* of the partial inner pipe 10*c*. In the example of (D) of FIG. 23, the distance from the floor to the ceiling is approximately 300 cm. However, similar to that of (A) of FIG. 23, the length of the outer pipe 10*a* is approximately 183 cm.

As described above, in the comparative examples of (A) to (D) of FIG. 23, the height of the pole 10 is adjusted between approximately 200 cm and 300 cm, and the adjustment range is approximately 100 cm.

Here, the current conditions of packing and transporting of the sunshade/rain shield of a tension rod-type parasol is briefly described. In many cases, the sunshield/rain shield apparatus of the tension rod-type has disadvantages such as enlargement of packing material due to, for example, the long pole formed with a length corresponding to the height of eaves, etc. at the transporting stage and due to the sunshade/rain shield apparatus being formed with an increased size. Further, the cost increases as the strength performance is improved. Further, the transporting costs increases as the size of the package increases. In many cases, the transporting cost of goods is determined not only by weight specifications but by the size used for packaging (post-assembly dimensions) of the cardboard boxes and other packaging containers which is equivalent to the total of the three sides including the length, width and depth of the packaging containers. When large goods are transported like a parasol, the external dimensions of a cardboard box or the like that packages it therein have a large influences on cost. In order to accommodate the outer pipe 10*a* (183 cm in length) that enables the pole to tensioned in a space of approximately 200 cm to 300 cm as in (A) to (D) of FIG. 23, the dimension of the outer shape of the packaging container that is generally used has its three sides totaling to approximately 200 cm to 300 cm (more specifically, 215 cm (190 cm+12.5 cm+12.5 cm). Further, in many cases, the transporting cost increase as the external dimensions of the packaging containers become larger. Therefore, the external dimensions of the packaging containers are desired to be reduced as much as possible to reduce transporting fees.

Therefore, the pole 100 of embodiment 5 is devised to ensure a sufficient tension strength, prevent the parasol from being excessively raised, and enable installment at a desired position even if the range of the height from the floor to the ceiling is wide while also preventing the size and cost of the packaging container from increasing together with the increase in the size of the parasol.

Figure 24:
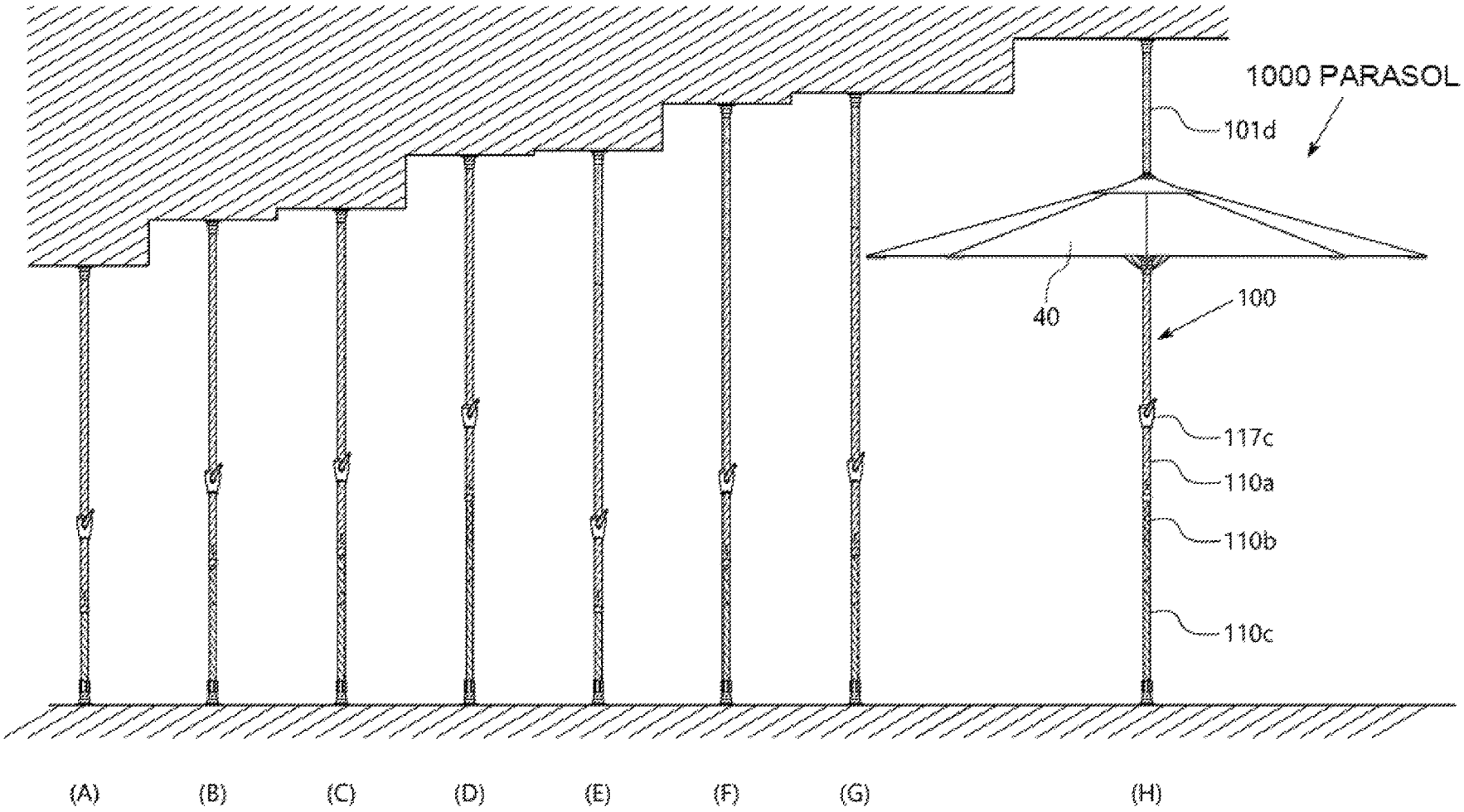
FIG. 24 is a diagram for explaining the adjustment of the length of the pole.

First, the adjustment of the length of the pole 100 is described with reference to FIG. 24. (A) of FIG. 24 shows a state in which the pole 100 including the outer pipe 110*a* and the partial inner pipe 110*b* is adjusted to its shortest state. In this case where the pole 100 is in its shortest state, the hole portion of the outer pipe 110*a* (in the case of plural hole portions, the hole portion located farthest from the floor) is matched and fixed to the hole portion closest to the floor among the hole portions of the inner pipe 110*b*. In the example of (A) of FIG. 24, the distance from the floor to the ceiling is approximately 199 cm, and the length of the outer pipe 110*a* is approximately 165 cm.

(B) of FIG. 24 shows a state in which the pole 100 including the outer pipe 110*a* and the partial inner pipe 110*b* is adjusted to its longest state. In this case where the pole 100 is in its longest state, the hole portion of the outer pipe 110*a* (in the case of plural hole portions, the hole portion located closest to the floor) is matched and fixed to the hole portion located farthest from the floor among the hole portions of the inner pipe 110*b*. In the example of (B) of FIG. 24, the distance from the floor to the ceiling is approximately 231 cm. However, similar to that of (A) of FIG. 24, the length of the outer pipe 110*a* is approximately 165 cm.

(C) of FIG. 24 shows a state in which the pole 100 including the outer pipe 110*a*, the partial inner pipe 110*b*, and the partial inner pipe 110*c* is adjusted to its shortest state. In this case where the pole 10 is in its shortest state, the hole portion of the outer pipe 110*a* (in the case of plural hole portions, the hole portion located farthest from the floor) is matched and fixed to the hole portion closest to the floor among the hole portions of the partial inner pipe 110*c*. In the example of (C) of FIG. 24, the distance from the floor to the ceiling is approximately 233 cm. However, similar to that of (A) of FIG. 24, the length of the outer pipe 110*a* is approximately 165 cm.

(D) of FIG. 24 shows a state in which the pole 100 including the outer pipe 110*a*, the partial inner pipe 110*b*, and the partial inner pipe 10*c* is adjusted to its longest state. In this case where the pole 100 is in its longest state, the hole portion of the outer pipe 110*a* (in the case plural hole portions, the hole portion closest to the floor) is matched and fixed to the hole portion farthest from the floor among the hole portions of the partial inner pipe 110*c*. In the example of (D) of FIG. 24, the distance from the floor to the ceiling is approximately 261 cm. However, similar to that of (A) of FIG. 24, the length of the outer pipe 110*a* is approximately 165 cm.

(E) of FIG. 24 shows a state in which the pole 100 including the outer pipe 110*a*, the partial inner pipe 110*b*, and the ceiling pipe 110*d* is adjusted to a length that is second to that of (D) of FIG. 24. In this case where the pole 100 is in its shortest state, the upper end of the outer pipe 110*a* and the lower end of the ceiling pipe 110*d* are connected to each other, and the hole portion closest to the floor among the plural hole portions of the outer pipe 110*a* is matched and fixed to the hole portion located third from the floor among the hole portions of the inner pipe 110*b*. In the example of (E) of FIG. 24, the distance from the floor to the ceiling is approximately 263 cm. However, similar to that of (A) of FIG. 24, the length of the outer pipe 110*a* is approximately 165 cm.

(F) of FIG. 24 shows a state in which the pole 100 including the outer pipe 110*a*, the partial inner pipe 110*b*, and the ceiling pipe 110*d* is adjusted to its longest state. In this case where the pole 100 is in its longest state, the upper end of the outer pipe 110*a* and the lower end of the ceiling pipe 110*d* are connected, and the hole portion of the outer pipe 110*a* (in the case of plural hole portions, the hole portion closest to the floor) is matched and fixed to the hole portion farthest from the floor among the hole portions of the inner pipe 110*b*. In the example of (F) of FIG. 24, the distance from the floor to the ceiling is approximately 281 cm. However, similar to that of (A) of FIG. 24, the length of the outer pipe 110*a* is approximately 165 cm.

(G) of FIG. 24 shows a state in which the pole 100 including the outer pipe 110*a*, the partial inner pipe 110*b*, the partial inner pipe 110*c*, and the ceiling pipe 110*d* is adjusted to its shortest state. In this case where the pole 100 is in its shortest state, the upper end of the outer pipe 110*a* and the lower end of the ceiling pipe 110*d* are connected to each other, and the hole portion of the outer pipe 110*a* (in the case of plural holes, the hole portion farthest from the floor) is matched and fixed to the hole portion nearest from the floor among the hole portions of the partial inner pipe 110*c*. In the example of (G) of FIG. 24, the distance from the floor to the ceiling is approximately 283 cm. However, similar to that of (A) of FIG. 24, the length of the outer pipe 110*a* is approximately 165 cm.

(H) of FIG. 24 shows a state in which the pole 100 including the outer pipe 110*a*, the partial inner pipe 110*b*, the partial inner pipe 10*c*, and the ceiling pipe 110*d* is adjusted to its longest state. In this case where the pole 100 is in its longest state, the upper end of the outer pipe 110*a* and the lower end of the ceiling pipe 110*d* are connected to each other, and the hole portion of the outer pipe 110*a* (in the case of plural hole portions, the hole portion closest to the floor) is matched and fixed to the hole portion farthest from the floor among the hole portions of the partial inner pipe 110*c*. In the example of (H) of FIG. 24, the distance from the floor to the ceiling is approximately 311 cm. However, similar to that of (A) of FIG. 24, the length of the outer pipe 110*a* is approximately 165 cm. Here, even if the distance from the floor to the ceiling is approximately 300 cm or more as in the comparative example of (D) of FIG. 23, the pole 100 of the present embodiment can prevent the sheet 40 from being raised to a position higher than necessary to the extent corresponding to the length of the ceiling pipe 110*d*.

Thus, in comparison with the pole 10 of the above-described comparative examples, the pole 100 of the present embodiment enables its height to be adjusted a wider range (approximately 112 cm starting from approximately 199 cm to 311 cm). Therefore, the parasol 1000 including the pole 100 can accommodate a wider variety of installation locations, the eaves of buildings or the like. Further, the outer pipe 110*a* having a shortened length not only enables a wider range of height adjustment of the pole 10 but also enables packaging size to be further reduced, and thereby reduce transportation cost. Further, the use of the ceiling pipe 110*d* reduces the length for inserting the partial inner pipe into the outer pipe 110*a* and allows more space attained for the outer pipe 110*a*. Thereby, a more robust and larger handle operation unit 117*c* can be attached to the outer pipe 110*a*. Further, by providing the ceiling pipe 110*d*, the pole 100 can be firmly tensioned (urged) between the ceiling surface and the floor surface while preventing the sheet 40 from being raised to a position higher than necessary and allowing the sheet 40 to be set at a desired height. Thereby, an ideal sunshade effect or the like can be attained.

Embodiment 6

Next, embodiment 6 is described. Embodiment 6 relates to a parasol having a structure different from the parasol described above. Differences from embodiments 1 to 5 are mainly described, and detail description of similar parts will be omitted where appropriate.

The parasol in this embodiment is a square type parasol having a square shape from a top view. Alternatively, the parasol may have a polygon shape from a top view. The square type parasol includes a center pole-type and a corner pole-type which differ depending on the position where the pole is attached to the parasol. The parasol of the center pole-type is described in this embodiment, and the parasol of the corner pole-type is described in embodiment 7 below.

Figure 25:
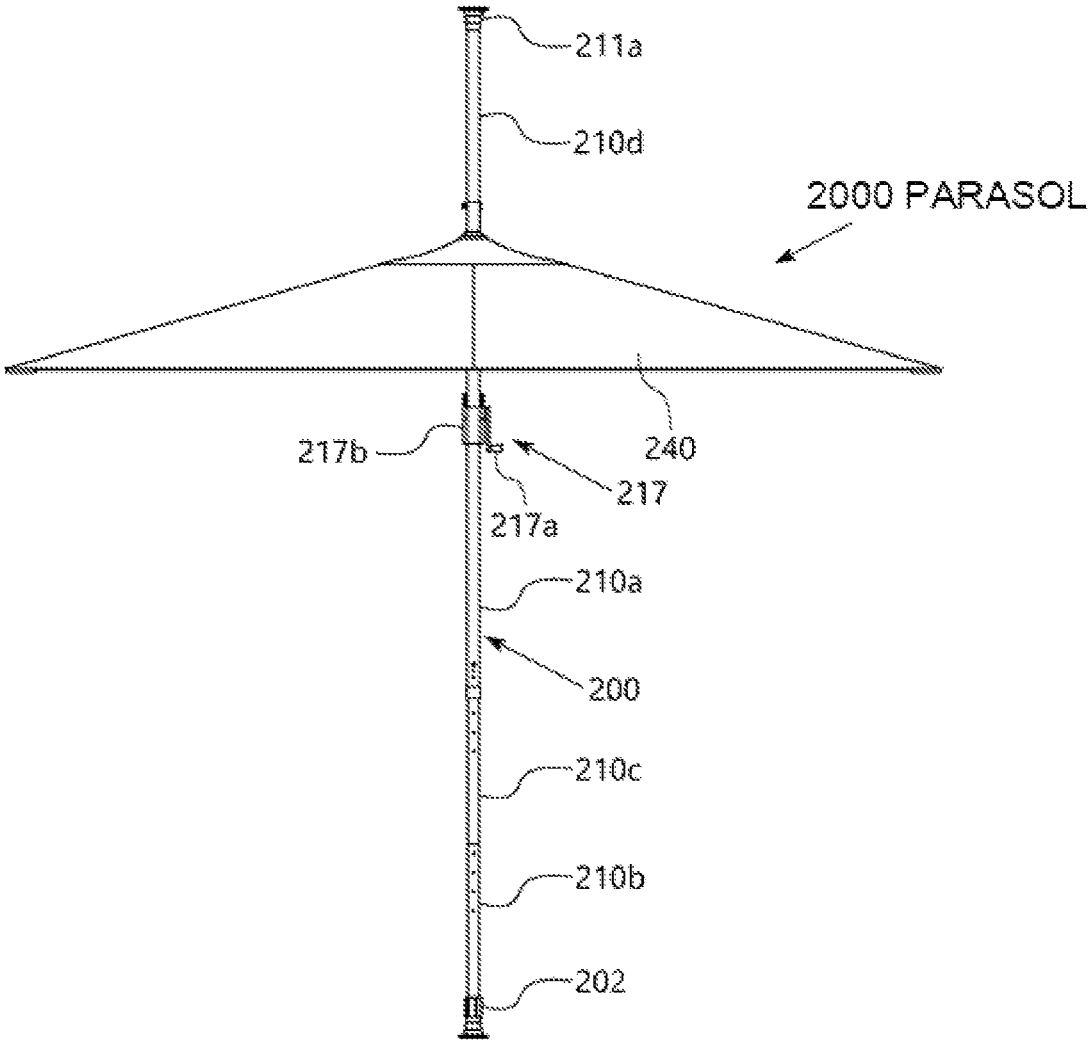
FIG. 25 is a front view of a parasol of another embodiment (Embodiment 6).
Figure 26:
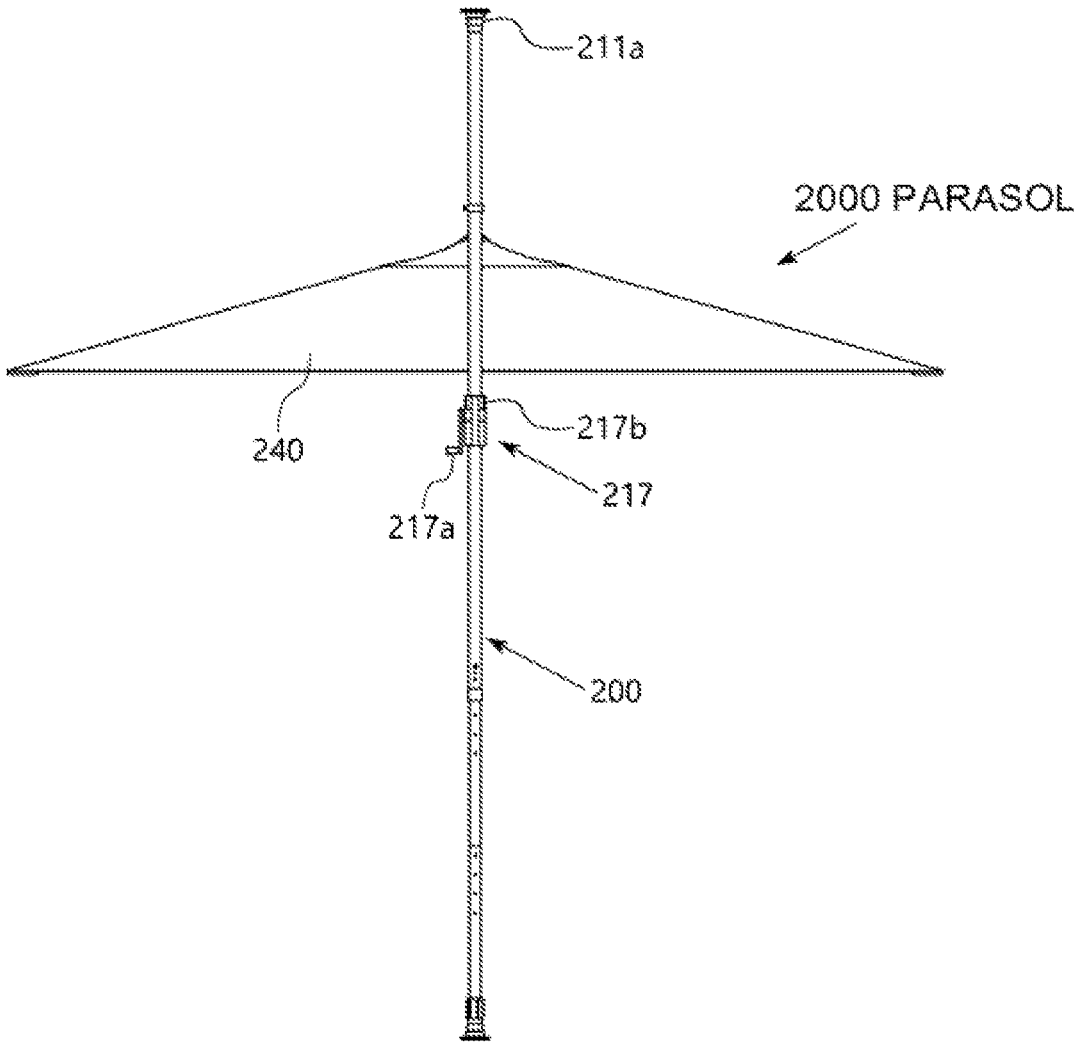
FIG. 26 is a rear view of a parasol of another embodiment (Embodiment 6).
Figure 27:
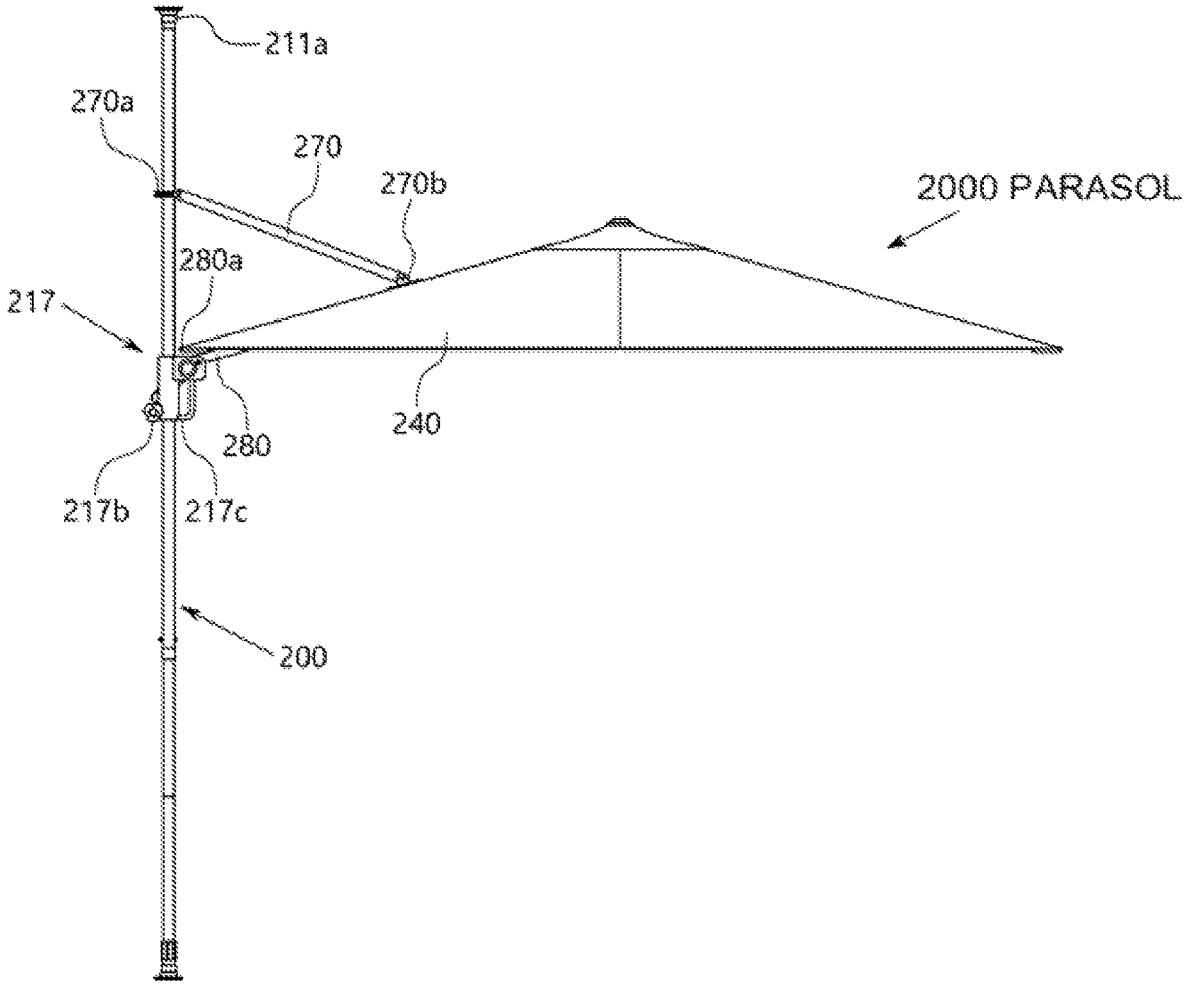
FIG. 27 is a side view of a parasol of another embodiment (Embodiment 6).
Figure 28:
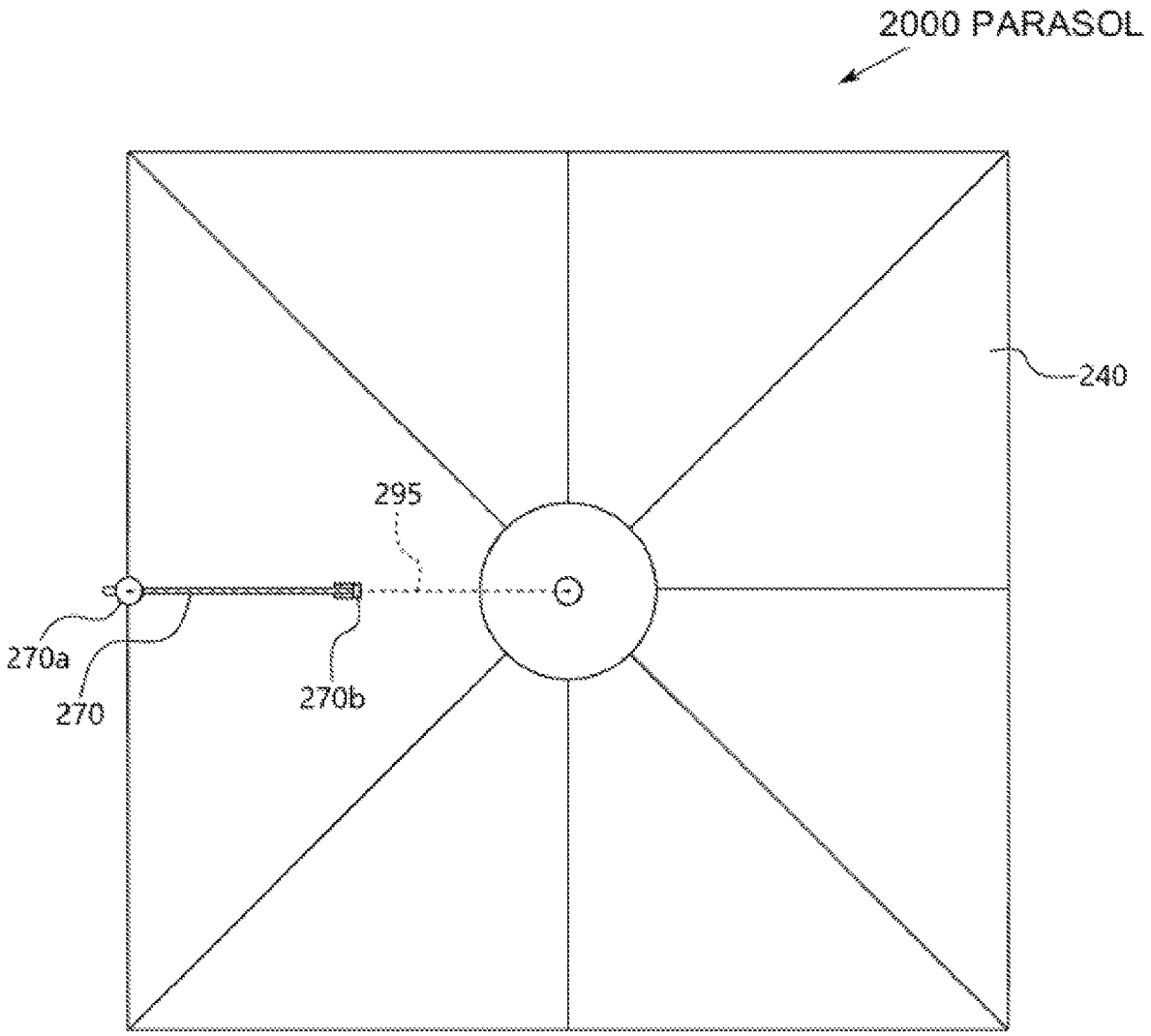
FIG. 28 is a top view of a parasol of another embodiment (Embodiment 6).
Figure 29:
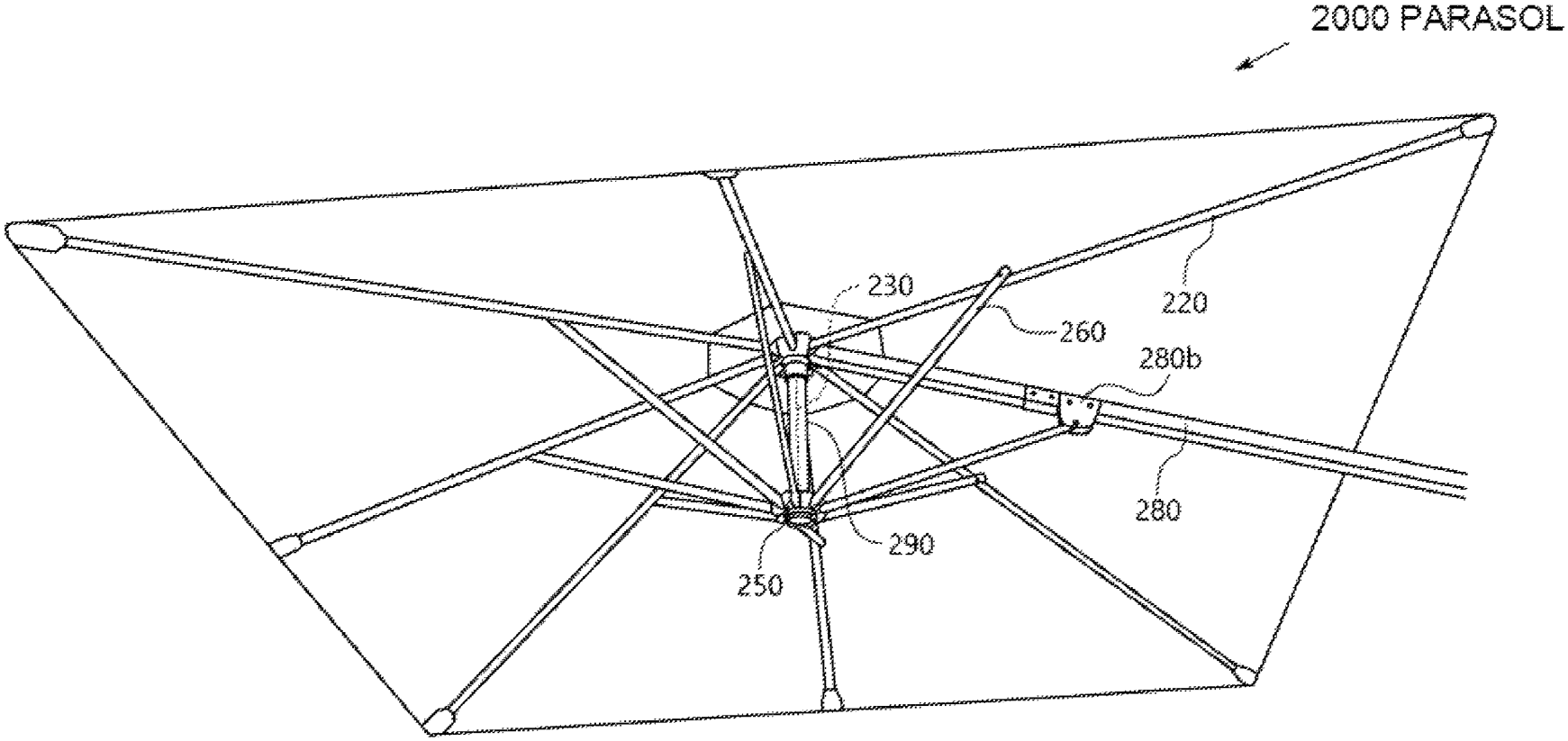
FIG. 29 is a bottom view of a parasol of another embodiment (Embodiment 6).
Figure 30:
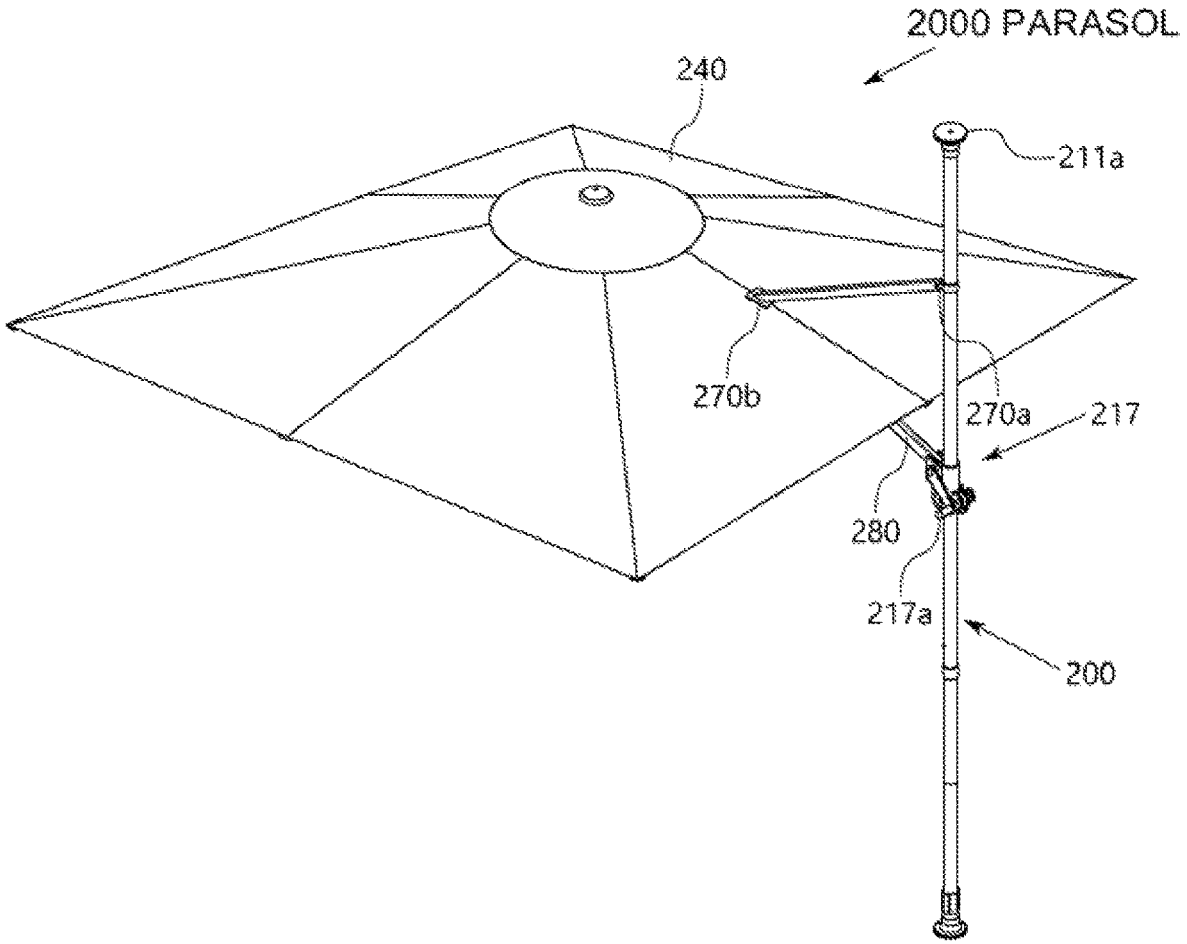
FIG. 30 is a perspective view of a parasol of another embodiment (Embodiment 6).
Figure 31:
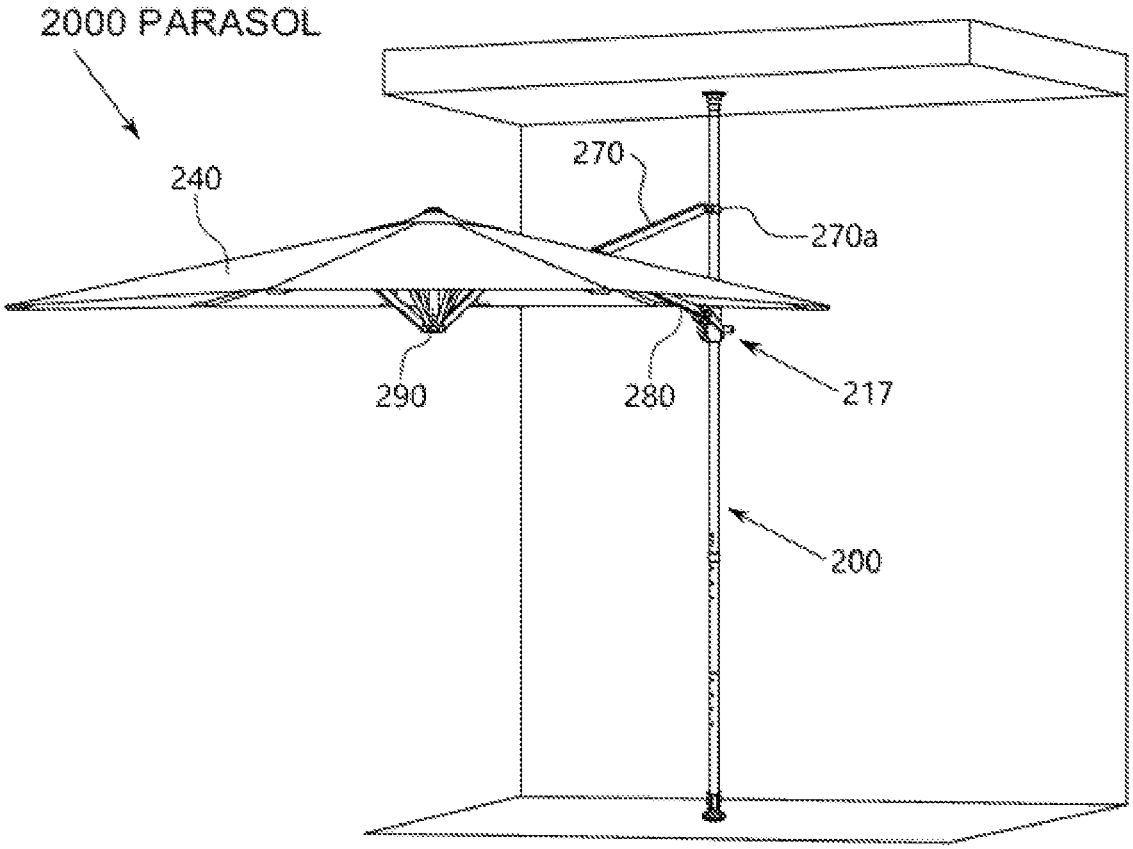
FIG. 31 is a reference diagram of the usage state of a parasol of another embodiment (Embodiment 6).
Figure 32:
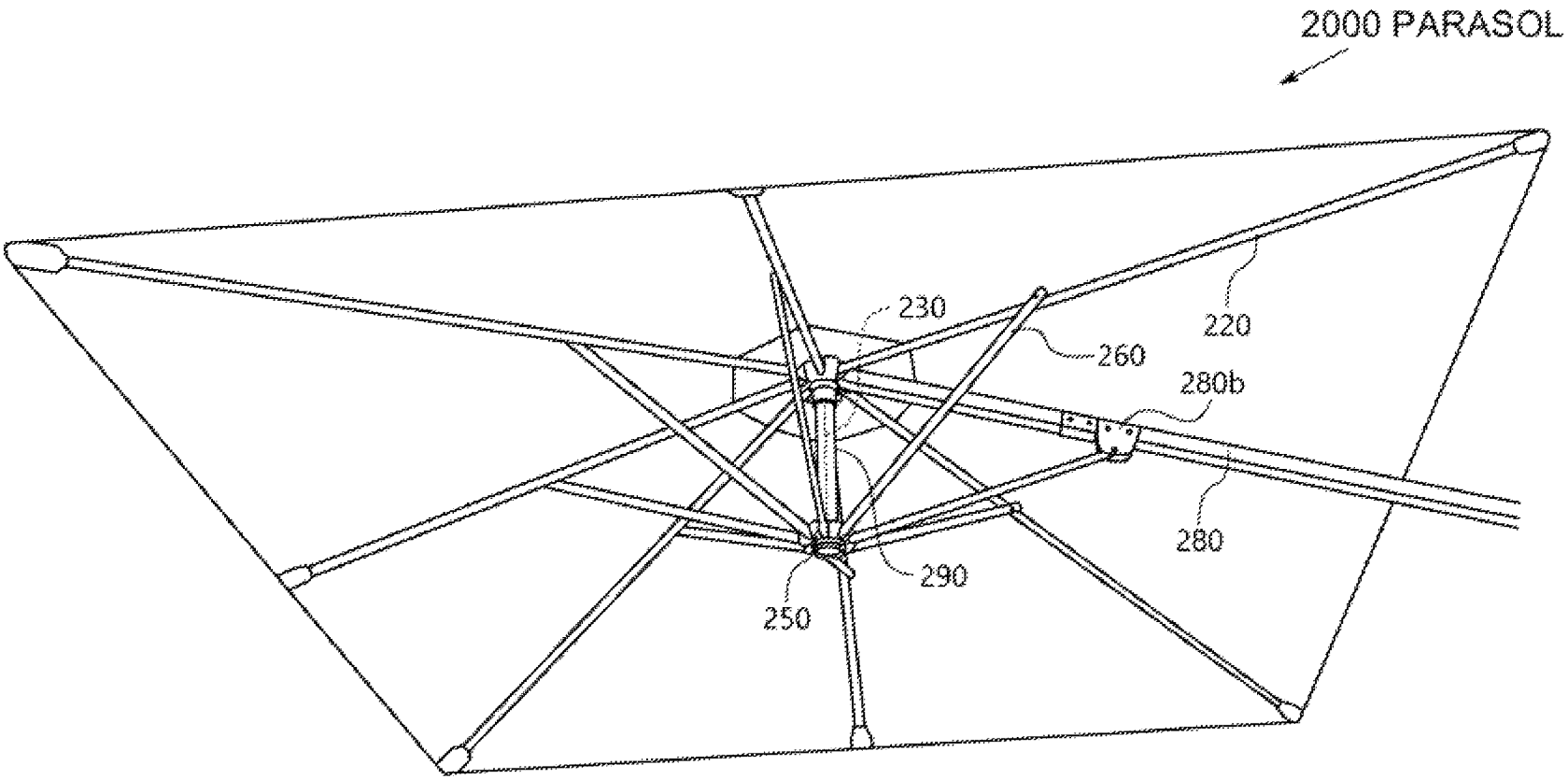
FIG. 32 is an enlarged view of an opening/closing mechanism of a parasol of another embodiment (Embodiment 6).

FIG. 25 is a front view of the parasol 2000 according to the present embodiment. FIG. 26 is a rear view, FIG. 27 is a side view, FIG. 28 is a top view, FIG. 29 is a bottom view, FIG. 30 is a perspective view, FIG. 31 is a reference diagram of a state when used, FIG. 32 is an enlarged view of the opening/closing mechanism of the parasol. The parasol 2000 of this embodiment basically includes a sheet 240 that is foldable, an upper arm 270 for supporting the sheet 240 from above, a lower arm 280 for supporting the sheet 240 from below, a handle operation unit 217 for opening and closing the sheet 240, and a pole 200 to which the upper arm 270 and the handle operation unit 217 are coupled.

Similar to embodiments 1 to 5, the parasol 2000 is also provided with a pole 200 that extends in the vertical direction as shown in FIGS. 25 to 27. The pole 200 has substantially the same configuration as the pole 100 including the height adjustment mechanism of embodiment 5 except for the handle operation unit 217 attached to the pole 200 and the operation of the members/components related to the opening/closing mechanism of the parasol. Thus, similar to the pole 100 of embodiment 5, the pole 200 is a hollow cylindrical pole formed of, for example, iron or aluminum. Further, similar to the pole 100 of the fifth embodiment, the length of the pole 200 can be adjusted by two partial inner pipes 210*b*, 210*c* (the partial inner pipes 210*b*, 210*c* also serving as a "lower side pipe" herein) and a ceiling pipe 210*d* along with the outer pipe 210*a*.

Unlike the raising/lowering movement of the above-described embodiments in which the lower hub moves along the pole in coordination with the ribs and the struts, the opening/closing mechanism of the parasol 2000 of this embodiment raises and lowers a ring body provided at the lower end of a support cylinder 290 to open and close the parasol 2000. As shown in FIGS. 27 and 32, the opening/closing mechanism of the parasol 2000 includes plural ribs 220 (in this embodiment, seven ribs) and one lower arm 280 that are oscillatably supported at the upper end portion of the support cylinder 290 and radially extend therefrom, the sheet 240 stretched across the upper surfaces of the ribs, an upper arm 270 having one end 270*a* attached to the pole 200 and another end 270*b* attached to the sheet 240, struts 260 each of which having one end in its length direction that oscillatably supports a middle section of the lower arm 280 or a corresponding rib 220 in the length direction, a ring body 250 that pivotally supports the other end of the strut 260 in its length direction, and a string member 230 (e.g., rope) that has one end portion coupled to the ring body 250 and another end portion that is coupled to the handle operation unit 217 via the inside of the support cylinder 290 and the inside of the lower arm 280.

Specifically, the rope 230 having one end coupled to a winding member in the handle operation unit 217 via the inside of the support cylinder 290 and the inside of the lower arm 280 is wound by performing a forward rotation operation with the handle of the operation unit 217. Then, the ring body 250 is raised by winding the string member 230 having its other end coupled to the ring body 250. Thereby, the parasol 2000 is opened. Then, as shown in FIG. 32, the parasol 2000 becomes a fully open state when the ring body 250 reaches a position contacting the lower end of the support cylinder 290. On the other hand, performing a reverse operation of the handle of the operation unit 217 in this state allows the string member 230 to be released from the winding member inside the handle operation unit 217 and lower the ring body 250 with respect to the support cylinder 290. Accordingly, the parasol 2000 becomes closed by lowering the ring body 250.

In the state where the parasol 2000 of the present embodiment is opened, the top view shape of the sheet 240 is a square, and the pole 200 is provided at a position corresponding to a midpoint of one side of the square. In the state where the parasol 2000 is opened as illustrated in FIGS. 27 and 28, the other end 270*b* of the upper arm 270 extending from the pole 200 is attached to surface of the sheet 240 at the vicinity of a midpoint on a predetermined radius line 295 of the square shape of the sheet 240. In the present embodiment, "predetermined radius line" refers to a line extending from the center of the top view square of the sheet 240 and being perpendicular to one side of the top view square of the sheet 240. In the state where the parasol 2000 is opened as shown in FIGS. 27 and 29, a portion 280*b* of the lower arm 280 located in the vicinity of the midpoint of the lower arm 280 extending from one end 280*a* coupled to the pole 200 to the other end 280*c* is provided on a rear surface side of the sheet 240 and attached to be located in the vicinity corresponding to the position where the other end 270*b* of the upper arm 270 is attached to the surface of the sheet 240 on the opposite side of the sheet 240.

Figure 40:
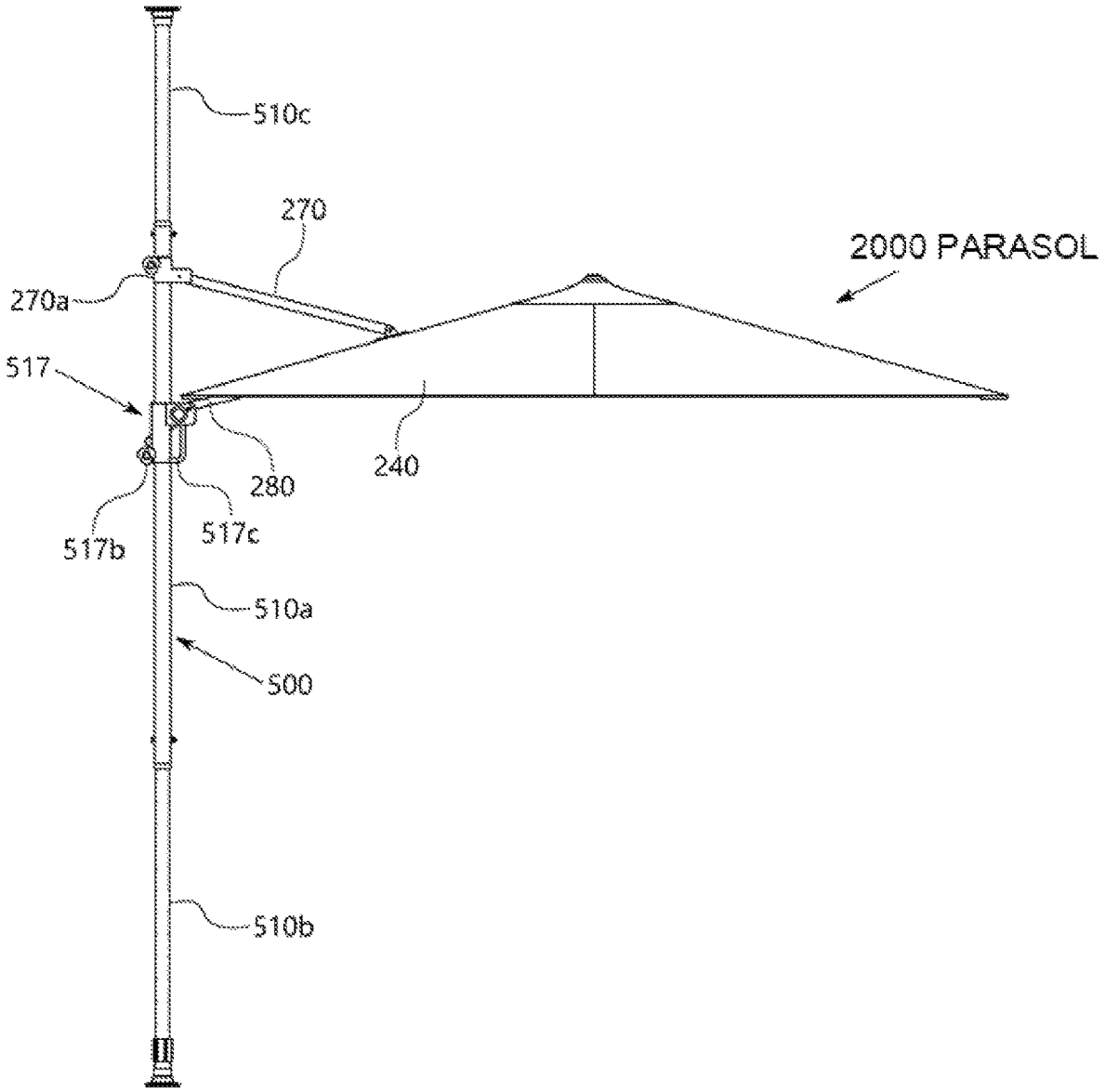
FIG. 40 is an exploded view of a column of a parasol of another embodiment (Embodiment 8).

The method of connecting the upper arm 270 and the pole 200 is not limited in particular, and a commonly used connecting mechanism may be appropriately employed. For example, the upper arm 270 and the pole 200 may be connected with a ring-shaped clamp that is used for attachment to a seat post of a bicycle saddle or the like. Although other connecting methods can be used to connect the upper arm 270 and the pole 200, it is preferred to use the clamp for connection in view of the ability to connect without the use of any tools. Further, it is preferable to use a connecting component that can be adjusted according to the diameter and shape of the pipes constituting the pole, so that the upper arm 370 and the handle operation unit can slide along the vertical direction of the pole 300. Alternatively, for example, a lever-type clamp, a hold-type clamp, or a hand-tighten bolt (as shown in FIG. 40 of the below-described embodiment 8) can be used as a connecting component.

Further, although the height of the parasol 2000 can be adjusted with the pipes constituting the pole 200 such as the outer pipe 210*a*, the height of the parasol 2000 can also be adjusted by attaching the upper arm 270 and the lower arm 280 to the pole 200 in a slidable manner along the pole 200. Thereby, the upper arm 270 and the lower arm 280 not only enable height adjustment of the parasol 2000 but also enable adjustment of the tilt angle of the parasol 2000. That is, the parasol 2000 not only can be supported horizontally with respect to the ground (floor surface) as illustrated in FIG. 27 but can also be supported in a tilted (inclined) state.

As shown in FIG. 29 and FIG. 32, seven ribs 220 and one lower arm 280 are provided to extend radially from the support cylinder 290 as their center, and eight struts 260 are provided in correspondence with the ribs 220 and the lower arm 280. The ribs 220 and the struts 260 are formed of, for example, stainless steel, aluminum, iron-plating or iron-coating or the like.

As shown in FIG. 28 and FIG. 29, the sheet 240 is square from a top view shape when the parasol 2000 is opened. However, while maintaining the same structure, it is also possible to adopt other shapes of the sheet from the top view, such as circular, rectangular, hexagonal, octagonal, dodecagonal shape or the like. Further, in the present embodiment, the length of one side of the square-shaped sheet 240 is 200 cm from the viewpoint of preventing the enlargement and cost increase of the packaging container in association with the enlargement of the above-described parasol. However, the area of the sheet 240 may be reduced or increased depending on, for example, the installation location and application of the parasol 2000.

Since the top view shape of the sheet 240 is a square, the ribs 220 formed on the diagonal lines of the square are orthogonal to each other and equal in length. Therefore, the ribs 220 extending in respective directions are formed with the same members. This contributes to simplifying the manufacturing thereof. Since the material and the number of plys of the sheet 240 are common to those of the sheet 40 of the above-described embodiments 1 to 5, a detailed description thereof will be omitted.

Further, the parasol 2000 of the present embodiment includes a handle operation unit 217 having the following configuration instead of the handle operation unit 117*c* of the above-described embodiments 1 to 5.

As shown in FIGS. 25 to 31, the handle operation unit 217 of embodiment 6 includes a lever portion 217*a* for performing a string winding operation by being rotated, a lock portion 217*b* (e.g., a handle bolt that can be tightened by hand) for fixing the position of the handle operation unit 217 that is slidable along the pole 200, and a grip portion 217*c* provided on the side below the sheet 240 for being gripped when performing a winding operation or an operation of adjusting the position of the handle operation unit 217. By providing the grip portion 217*c* on the side below the sheet 240, the user can grasp the grip portion 217*c* even when the pole 200 is installed at a position extremely close to a wall of a building or the like and slide the handle operation unit 217 upward while grasping the grip portion 217*c*. When the handle operation unit 217 is moved to a desired position, the lock portion 217*b* is rotated to lock (fix) the position of the handle operation unit 217. Then, the parasol 2000 can be easily opened by rotating the lever portion 217*a*.

Specifically, as shown in FIG. 27, the handle operation unit 217 has a first side surface and a second side surface on the opposite side of the first side surface. The handle operation unit 217 includes the lever portion 217*a* provided on the first side surface, the lock portion 217*b* provided on the second side surface for fixing the position of the handle operation unit 217, and the grip portion 217*c* interposed between the first side surface and the second side surface and provided on the side of the handle operation unit 217 towards the sheet 240.

Therefore, even when the pole 200 is installed at a position extremely close to the wall of a building or the like, the user can stand on the side of the sheet 240 to easily perform the winding operation and the position adjustment of the handle operation unit 217 because the grip portion 217*c* is provided on the side towards the sheet 240. In the present embodiment, the grip portion 217*c* is formed in a letter L shape. However, the grip portion 217*c* may be formed into other shapes as long as the grip portion 217*c* is provided on the side of the sheet 240 (the side of the upper and lower arms) and formed extending from the handle operation unit 217 to the extent of being grasped.

Here, the usage of the parasol 2000 of the present embodiment is briefly described. Generally, in a case of opening the umbrella part of a parasol, the parasol is configured to have the umbrella portion open about the pole of the parasol. Therefore, the pole may sometimes obstruct a task performed below the umbrella portion or installment of a table or the like. In addition, parasols are often installed outdoors, such as in a veranda of a building or a courtyard. However, depending on the structure of the building and the shape and structure of the umbrella portion of the parasol, the parasol may need to be installed near an entrance of the building and could obstruct entry/exit due to, for example, the pole that supports the parasol. On the other hand, as shown in FIG. 31, the parasol 2000 of the present embodiment has a structure that opens away from the pole 200. Further, because the parasol 2000 requires no weight component to support the pole 200 from the floor surface, the pole 200 can be prevented from obstructing the entry or exit from a building. This expands the locations at which the parasol 2000 can be installed.

In addition to maintaining the advantages of the parasol 1 according to embodiments 1 to 5 such as the stability provided by tension force, the ease of installation, the adjustability of height, and the reduction of the packaging cost, the above-described parasol 2000 according to embodiment 6 enables the installation locations to be expanded owing to its structure of opening away from the pole 200.

Embodiment 7

Next, embodiment 7 is described. The parasol of embodiment 7 is a corner pole-type parasol. The corner pole-type parasol is similar to embodiment 6 in that it is a parasol having a square shape from a top view. However, the corner pole-type parasol is different from embodiment 6 in that the pole is provided on one of the vertices of any corner of the square. Although the top view shape is a square in the present embodiment, the top view shape may be a polygon, such that the pole is provided on one of the vertices of any corner of the polygon.

Figure 33:
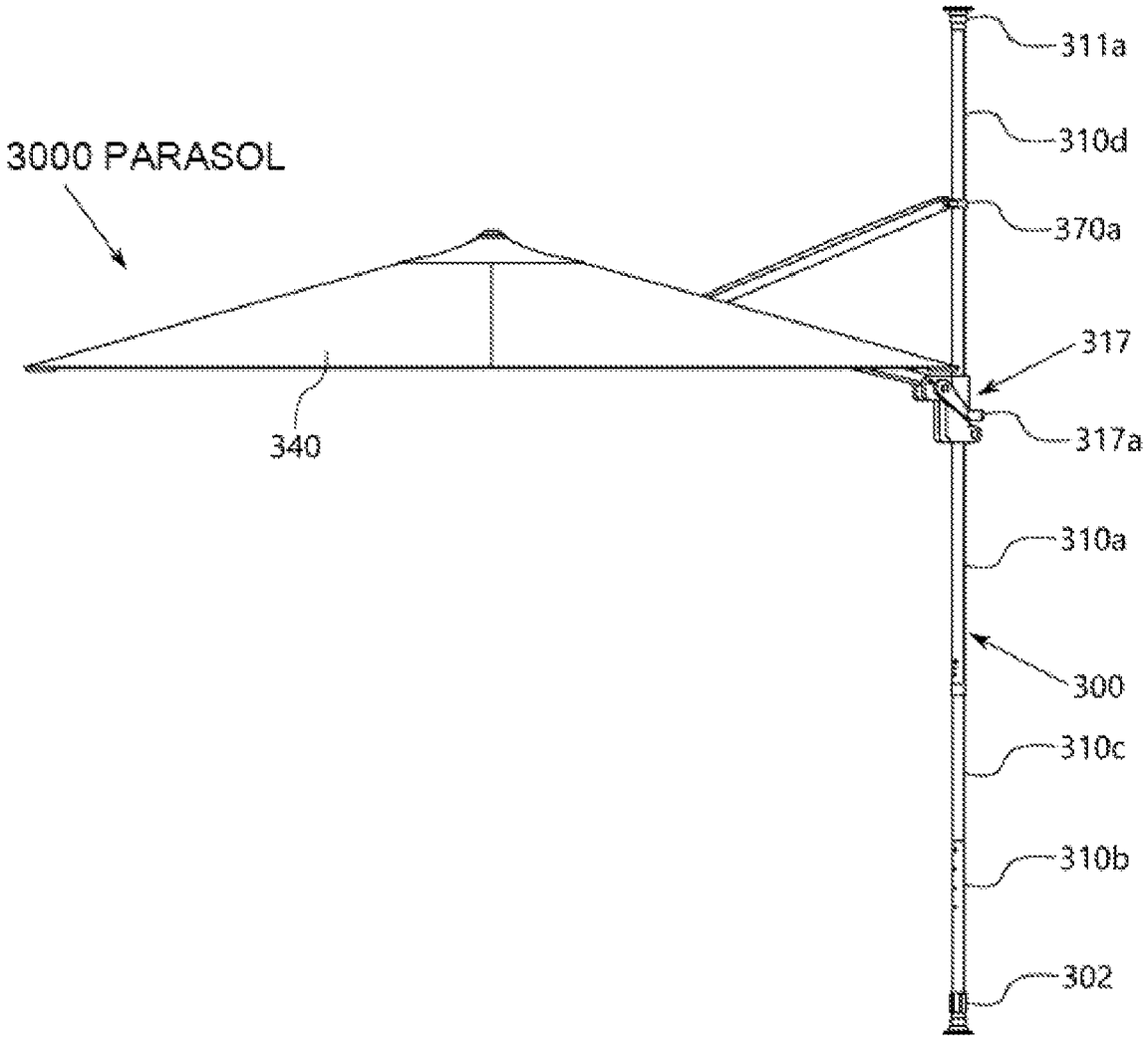
FIG. 33 is a front view of a parasol of another embodiment (Embodiment 7).
Figure 34:
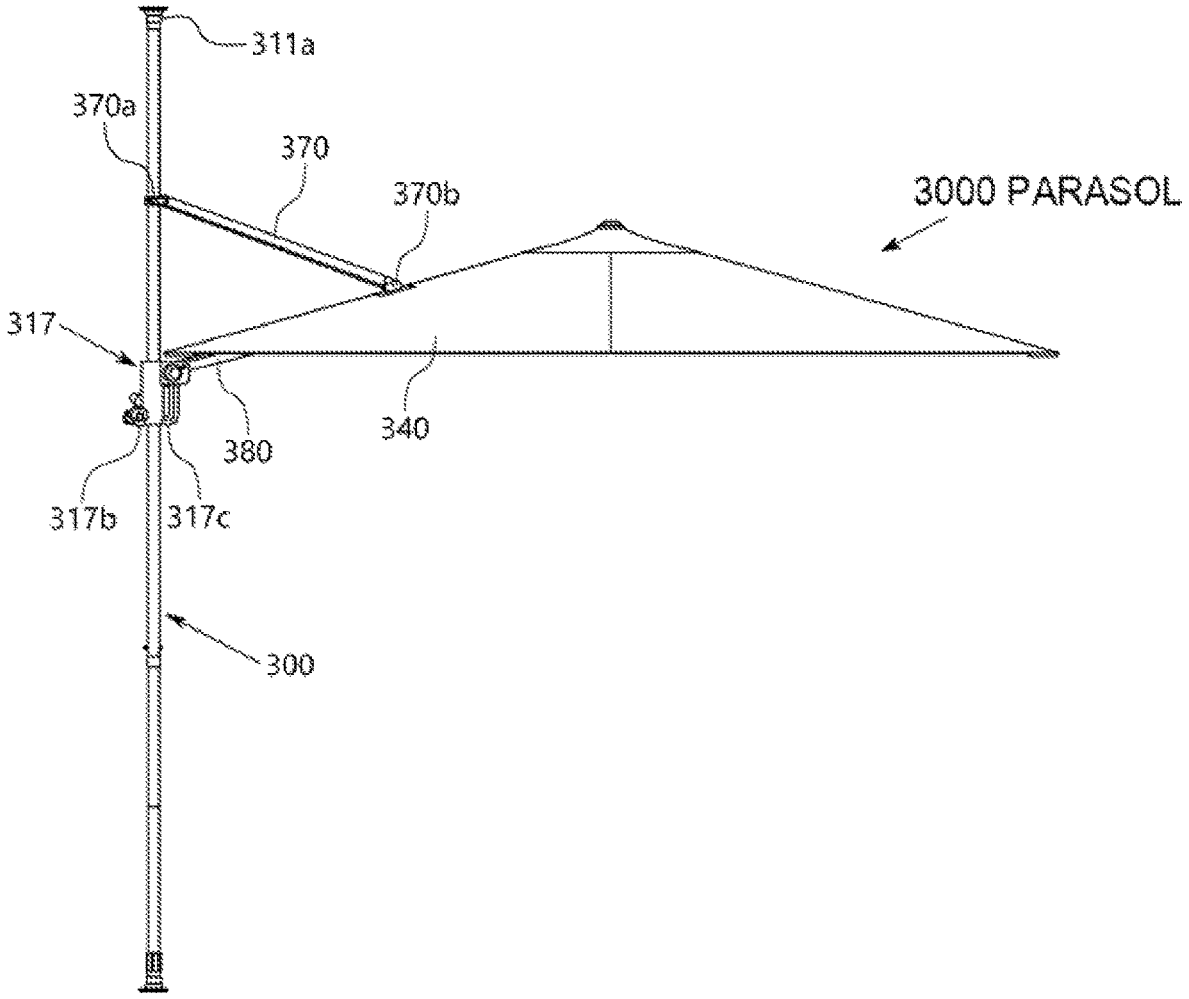
FIG. 34 is a rear view of a parasol of another embodiment (Embodiment 7).
Figure 35:
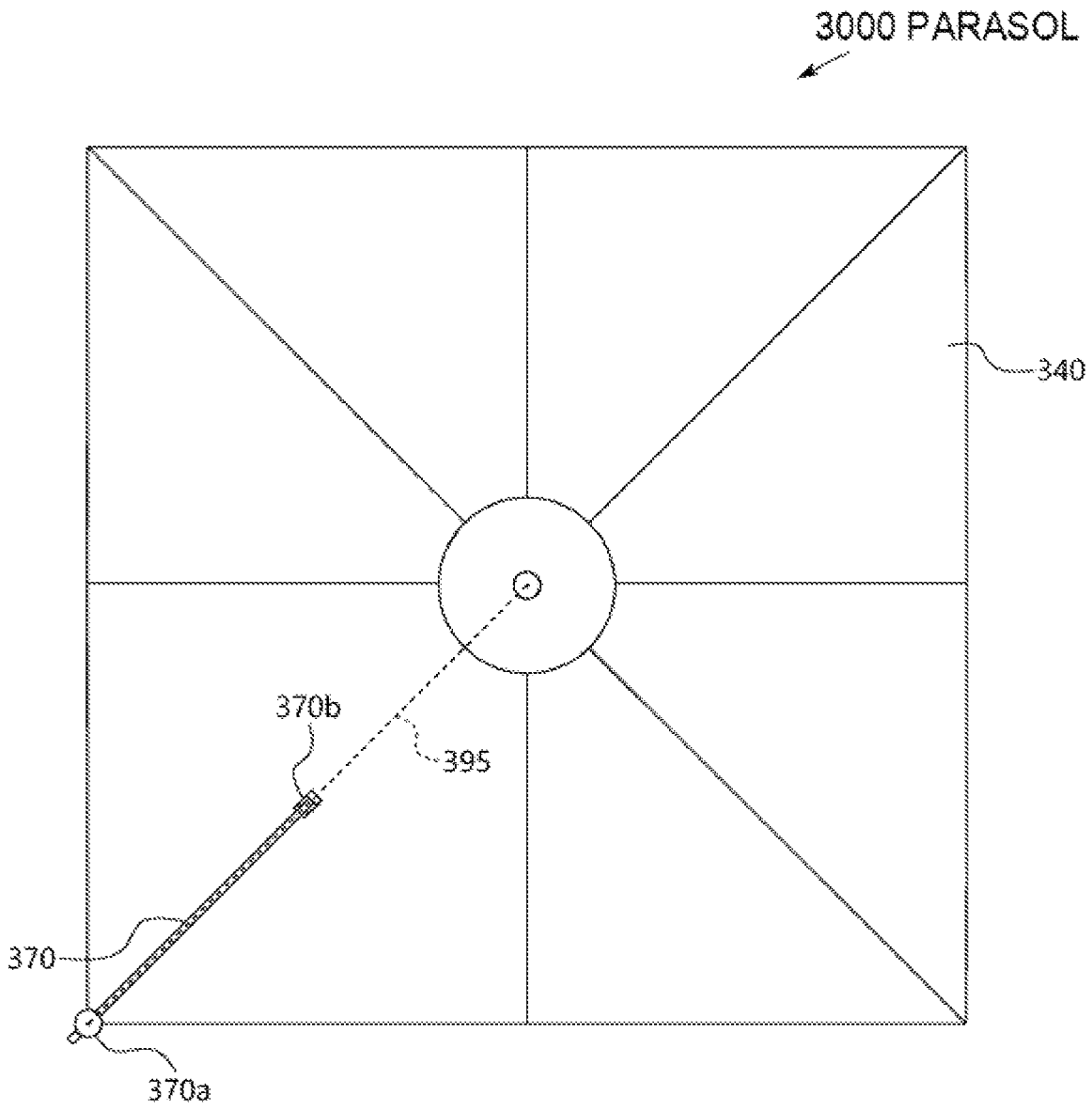
FIG. 35 is a top view of a parasol of another embodiment (Embodiment 7).
Figure 36:
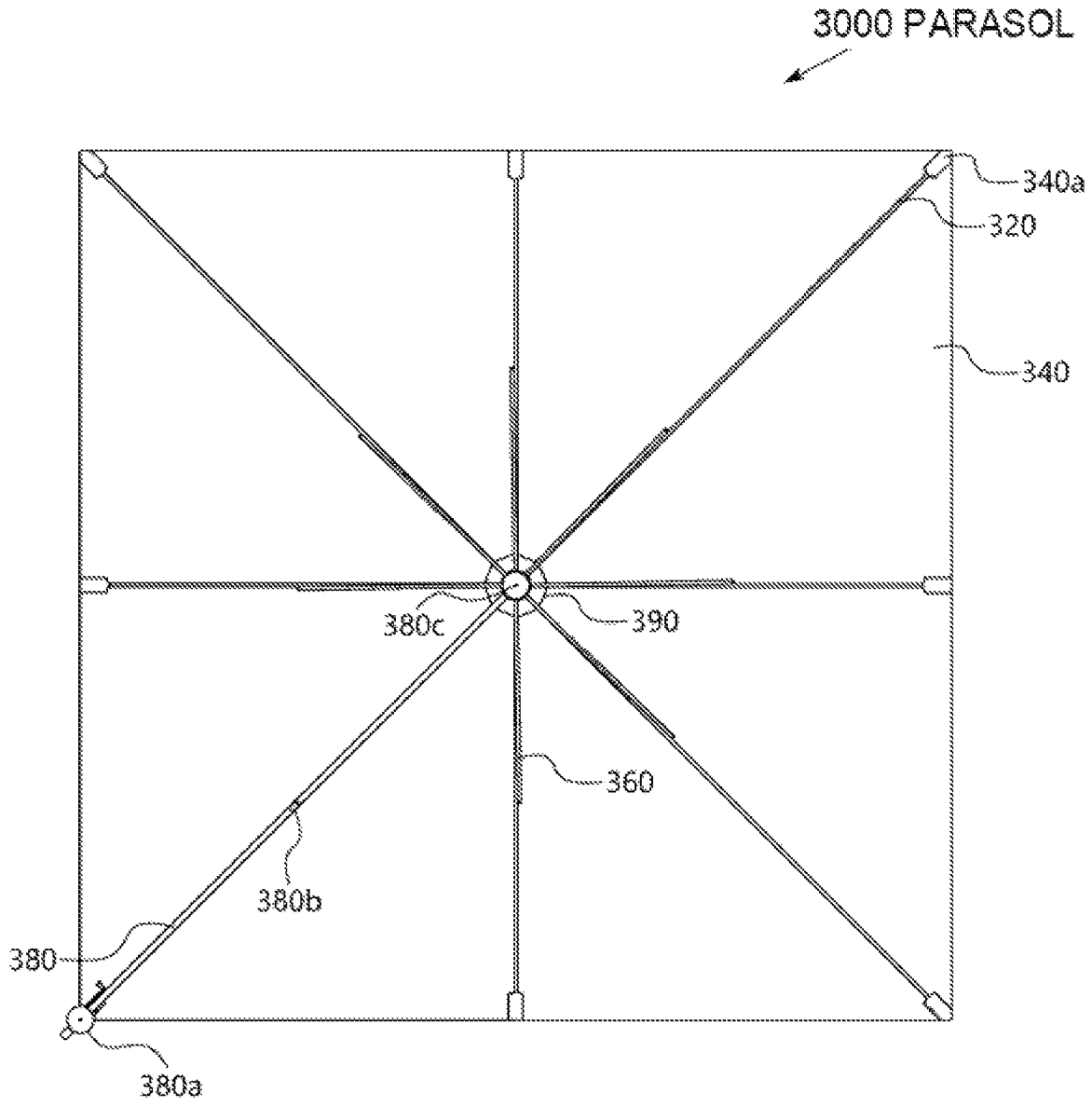
FIG. 36 is a bottom view of a parasol of another embodiment (Example 7).
Figure 37:
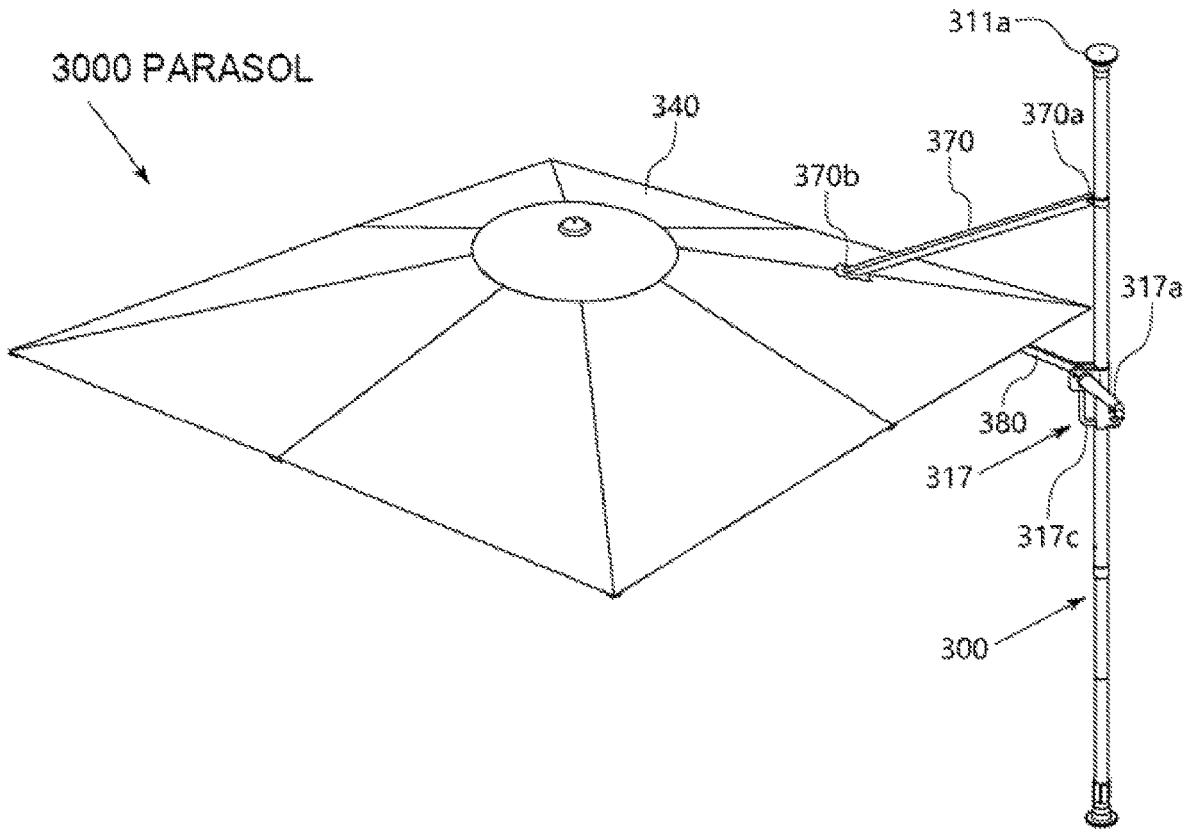
FIG. 37 is a perspective view of a parasol of another embodiment (Embodiment 7).
Figure 38:
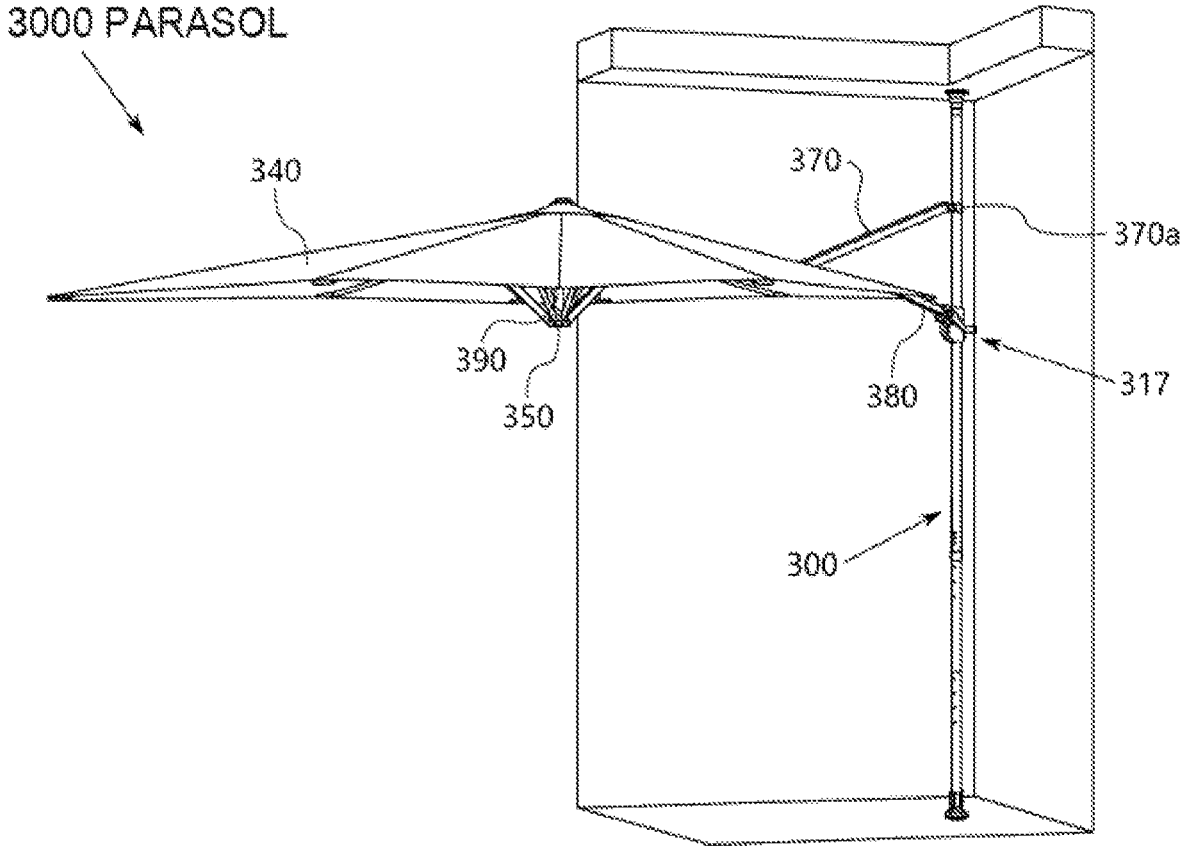
FIG. 38 is a reference diagram of the usage state of a parasol of another embodiment (Embodiment 7).
Figure 39:
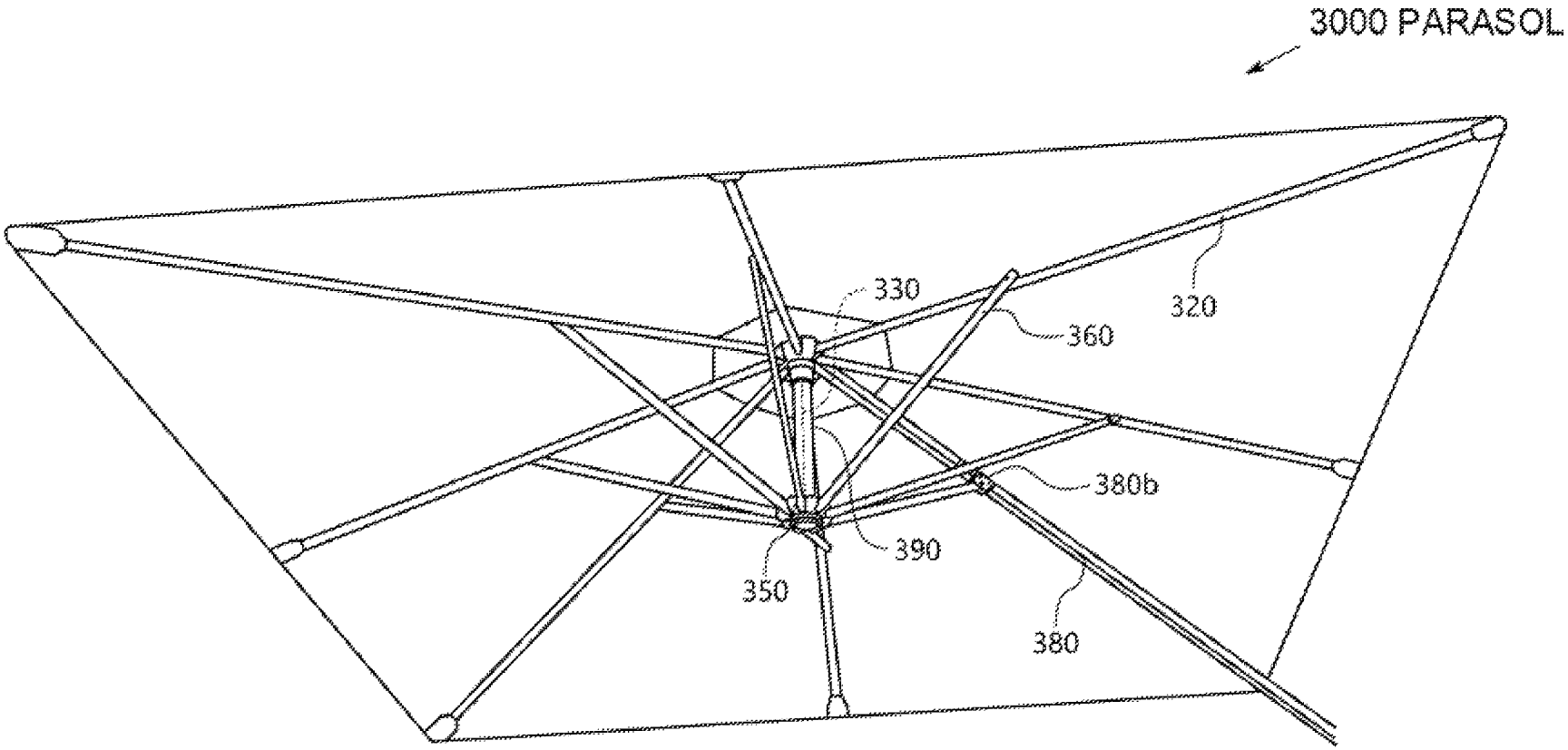
FIG. 39 is an enlarged view of an opening/closing mechanism of a parasol of another embodiment (Embodiment 7).

FIG. 33 is a front view of the parasol 3000 according to the present embodiment. FIG. 34 is a rear view. FIG. 35 is a top view, FIG. 36 is a bottom view. FIG. 37 is a perspective view. FIG. 38 is a reference diagram of the usage state, FIG. 39 is an enlarged view of the opening/closing mechanism of the parasol. The parasol 3000 of the present embodiment has basically the same configuration as the parasol 2000 of embodiment 6. That is, the parasol 2000 basically includes a foldable sheet 240, an upper arm 270 for supporting the sheet 240 from the upper side, a lower arm 280 for supporting the sheet 240 from the lower side, a handle operation unit 217 for performing an opening/closing operation of the sheet 240, and the handle operation unit 217 to which the upper arm 270 and the handle operation unit 217 are coupled.

Similar to embodiments 1 to 5, the parasol 3000 is also provided with a single pole 300 extending in the vertical direction as shown in FIGS. 33-39. The pole 300 has substantially the same configuration as the pole 100 including the height adjustment mechanism of embodiment 5 except for the handle operation unit 217 attached to the pole 300 and the operation of the members/components related to the opening/closing mechanism of the parasol. Therefore, similar to the pole 100 of embodiment 5, the pole 300 is a hollow cylindrical pole formed of, for example, iron or aluminum. Further, similar to the pole 100 of embodiment 5, the height of the pole 300 can be adjusted by two partial inner pipes and a ceiling pipe along with the outer pipe 310*a*.

Similar to embodiment 6, the opening/closing mechanism of the parasol 3000 of this embodiment opens and closes the parasol 3000 by raising and lowering the ring body 350 provided on the lower end of the support cylinder 390 via the ribs 320 and the struts 360. As shown in FIGS. 33 and 39, the opening/closing mechanism of the parasol 3000 includes plural ribs 320 (in this embodiment, seven ribs) and one lower arm 380 that are oscillatably supported at the upper end portion of the support cylinder 390 and radially extend therefrom, a sheet 340 stretched across the upper surfaces of the ribs, an upper arm 370 having one end 370*a* attached to the pole 300 and another end 370*b* attached to the sheet 340, struts 360 each of which having one end in its length direction that oscillatably supports a middle section of the lower arm 380 or a corresponding rib 320 in the length direction, a ring body 350 that pivotally supports the other end of the strut 360 in its length direction, and a string member 330 (e.g., rope) that has one end portion coupled to the ring body 350 and another end portion that is coupled to the handle operation unit 317 via the inside of the support cylinder 390 and the inside of the lower arm 380.

Specifically, the rope 330 having one end coupled to a winding member in the handle operation unit 317 via the inside of the support cylinder 390 and the inside of the lower arm 380 is wound by performing a forward rotation operation with the handle of the operation unit 317. Then, the ring body 350 is raised by winding the string member 330 having its other end coupled to the ring body 350. Thereby, the parasol 3000 is opened. Then, as shown in FIG. 40, the parasol 3000 becomes a fully open state when the ring body 350 reaches a position contacting the lower end of the support cylinder 390. On the other hand, performing a reverse operation of the handle of the operation unit 317 in this state allows the string member 330 to be released from the winding member inside the handle operation unit 317 and lower the ring body 350 with respect to the support cylinder 390. Accordingly, the parasol 3000 becomes closed by lowering the ring body 350.

In the state where the parasol 3000 of the present embodiment is opened, the top view shape of the sheet 340 is square, and the pole 300 is provided at a position corresponding to one of the vertices of the corners of the square. In the state where the parasol 3000 is opened as illustrated in FIG. 35, the other end 370*b* of the upper arm 370 extending from the pole 300 is attached to the surface of the sheet 340 at the vicinity of a midpoint on a predetermined radius line 395 of the square shape of the sheet 340. In the present embodiment, the "predetermined radius line" refers to a straight line extending from the center of the top view square of the sheet 340 to the vertex of a corner of the top view square. In the state where the parasol 3000 is opened as shown in FIG. 35 and FIG. 36, a portion 380*b* of the lower arm 380 located in the vicinity of the midpoint of the lower arm 380 extending from one end 380*a* coupled to the pole 300 to the other end 380*c* is provided on a rear surface side of the sheet 340 and attached so to be located in the vicinity corresponding to the position where the other end 370*b* of the upper arm 370 is attached to the surface of the sheet 340 on the opposite side of the sheet 340.

The method of connecting the upper arm 370 and the pole 300 is not limited in particular, and a commonly used connecting mechanism may be appropriately employed. For example, the upper arm 370 and the pole 300 may be connected with a ring-shaped clamp that is used for attachment to a seat post of a bicycle saddle or the like. Although other connecting methods can be used to connect the upper arm 370 and the pole 300, it is preferred to use the clamp for connection in view of the ability to connect without the use of any tools. Further, it is preferable to use a connecting component that can be adjusted according to the diameter and shape of the pipes constituting the pole, so that the upper arm 370 and the handle operation unit 317 can slide along the vertical direction of the pole 300. Alternatively, for example, a lever-type clamp, a hold-type clamp, a hand-tighten bolt, as shown in FIG. 40 of the below-described embodiment 8, can be used as a connecting component.

Further, although the height of the parasol 3000 can be adjusted with the pipes constituting the pole 300 such as the outer pipe 310*a*, the height of the parasol 3000 can also be adjusted by attaching the upper arm 370 and the lower arm 380 to the pole 300 in a slidable manner along the pole 300. Thereby, the upper arm 370 and the lower arm 380 not only enable height adjustment of the parasol 3000 but also enable adjustment of the tilt angle of the parasol 3000. That is, the parasol 3000 not only can be supported horizontally with respect to the ground (floor surface) as illustrated in FIG. 34 but can also be supported in a tilted (inclined) state.

As shown in FIGS. 37 to 40, seven ribs 320 and one lower arm 380 are provided to extend radially from the support cylinder 390 as their center, and eight struts 360 are provided in correspondence with the ribs 320 and the lower arm 380. The ribs 320 and the struts 360 are formed of, for example, stainless steel, aluminum, iron-plating or iron-coating or the like.

As shown in FIG. 36 and FIG. 37, the sheet 340 is square from a top view shape when the parasol 3000 is opened. However, while maintaining the same structure, it is also possible to adopt other shapes of the sheet from the top view, such as circular, rectangular, hexagonal, octagonal, dodecagonal shape or the like. Further, in the present embodiment, the length of one side of the square-shaped sheet 340 is 200 cm from the viewpoint of preventing the enlargement and cost increase of the packaging container in association with the enlargement of the above-described parasol. However, the area of the sheet 340 may be reduced or increased depending on, for example, the installation location and application of the parasol 3000.

Since the top view shape of the sheet 340 is a square, the ribs 320 formed on the diagonal lines of the square are orthogonal to each other and equal in length. Therefore, the ribs 320 extending in respective directions are formed with the same members. This contributes to simplifying the manufacturing thereof. Since the material and the number of plys of the sheet 340 are common to those of the sheet 40 of the above-described embodiments 1 to 5 and the sheet 240 of embodiment 6, a detailed description thereof will be omitted.

As shown in FIGS. 33 to 38, the handle operation unit 317 of the seventh embodiment has the same basic configuration as the handle operation unit 217 of the sixth embodiment. The handle operation unit 317 includes a lever portion 317*a* for performing a string winding operation by being rotated, a lock portion 317*b* (e.g., a handle bolt that can be tightened by hand) for fixing the position of the handle operation unit 317 that is slidable along the pole 300, and a grip portion 317*c* provided on the side below the sheet 340 for being gripped when performing a winding operation or an operation of adjusting the position of the handle operation unit 317. Because the handle operation unit 217 of the above-described embodiment 6 is substantially the same as the handle operation unit 317 of embodiment 7, detailed description thereof will be omitted.

Here, the usage of the parasol 3000 of the present embodiment is briefly described. Generally, in a case of opening the umbrella part of a parasol, the parasol is configured to have the umbrella portion open about the pole of the parasol. Therefore, the pole may sometimes obstruct a task performed below the umbrella portion or installment of a table or the like. In addition, parasols are often installed outdoors, such as in a veranda of a building or a courtyard. However, depending on the structure of the building and the shape and structure of the umbrella portion of the parasol, the parasol may need to be installed near an entrance of the building and could obstruct entry/exit due to, for example, the pole that supports the parasol. On the other hand, similar to the parasol of embodiment 6, the parasol 3000 of the present embodiment has a structure that opens away from the pole 300 as shown in FIG. 38. Because the parasol 3000 requires no weight component to support the pole 300 from the floor surface, the pole 300 can be prevented from obstructing the entry or exit from a building. This expands the locations at which the parasol 3000 can be installed. However, unlike embodiment 6, the pole 300 is provided at a position corresponding to the vertex of a corner of the top view square shape of the sheet 340. Therefore, even in a case where the parasol 3000 is installed at a corner of a building as illustrated in FIG. 38, the parasol 3000 can be installed to match the shape of the wall of the building, such that the corner of the top view square of the sheet 340 matches the corner area along the wall of the building. Therefore, the parasol 3000 can be installed at locations without the pole obstructing its use while maintaining the sunshade/rain shielding effect.

As described above, in addition to maintaining the advantages of the parasol 1 according to embodiments 1 to 5 such as the stability provided by tension force, the ease of installation, the adjustability of height, and the reduction of the packaging cost, the above-described parasol 3000 according to embodiment 7 enables the installation locations to be expanded owing to its structure of opening away from the pole 300.

Embodiment 8

Next, embodiment 8 is described. Details described above for embodiments 1 to 7 are similarly applied. With reference to FIGS. 40 to 47, the differences between a pole 500 of this embodiment and the poles 10, 100, 200, and 300 of embodiments 1 to 7 are mainly described. Detail description of parts similar to those of embodiments 1 to 7 will be omitted. Note that the pole 500 of the present embodiment may be applied to both the parasol 2000 of embodiment 6 and the parasol 3000 of embodiment 7.

The poles of embodiments 5 to 7 are divided into four pipes: a ceiling pipe, an outer pipe, an upper inner pipe, and a lower inner pipe. Similar to the above-described embodiments, the pole 500 of the present embodiment also uses the ceiling pipe to enable adjustment of the length of the pole in the vertical direction while preventing the position of the sheet from becoming too high and maintaining an easy-to-use height even when the parasol is installed at a location with a high ceiling. However, the pole 500 of the present embodiment is different in that the pole 500 is divided into an outer pipe 510*a*, a lower pipe 510*b* attached to the lower side of the outer pipe 510*a*, and a ceiling pipe 510*c* attached to the upper side of the outer pipe 510*a* and that the lower pipe 510*b* and the ceiling pipe 510*c* can be accommodated inside the outer pipe 510*a*.

Each of the poles of the above-described embodiments 5 to 7 requires a task of assembling the pole divided into four along with, for example, attaching the ceiling pipe to the outer pipe, attaching the lower inner pipe to the upper inner pipe, and re-attaching the upper pad attached to the upper end of the outer pipe to the upper end of the ceiling pipe depending on the height of the eaves of the building.

On the other hand, in the case of assembling the pole 500 and adjusting its length, the assembly begins from a state where the ceiling pipe and the lower pipe are accommodated in the outer pipe, the upper pad is attached to the upper end of the ceiling pipe, and the lower pad is attached to the lower end of the lower pipe. Therefore, the height of the pole can be adjusted by pulling out one or both of the ceiling pipe and the lower pipe from the outer pipe. Accordingly, fixation with tension force can be achieved at any place having a height within an installable range. That is, with the present embodiment, it is possible to omit the tasks such as attaching the ceiling pipe to the outer pipe, attaching the upper inner pipe to the lower inner pipe, and re-attaching the upper pad attached to the upper end of the outer pipe to the upper end of the ceiling pipe.

As shown in FIG. 40, one or more holes are provided in each of the upper end and the lower end of the outer pipe 510*a*, and one or more holes are also provided in the ceiling pipe 510*c* and the lower pipe 510*b*. As a result, the vertical length of the pole 500 can be adjusted by positioning the hole portions provided at the upper end and the lower end of the outer pipe 510*a* in accordance with the height of the eaves of a building between the ceiling pipe 510*c* and the hole portion provided in the lower pipe 510*b*. Similar to the embodiments described above, the positioning of the hole portions is performed by inserting a connecting member such as a bar into a desired hole. Therefore, a detailed description thereof will be omitted. Although the pipes constituting the pole of the present embodiment are different from the pipe constituting the pole of the above embodiments, the basic tasks for installing the pole of the tension rod-type are substantially the same as those of the above-described embodiments. That is, the tasks of adjusting the length of the pole to equal the distance between the floor surface and the ceiling surface of the eaves of a building by using the telescopic portions after adjusting the length of the pole to a desired length by adjusting the connecting position of, for example, the outer pipe and the inner pipe of the pole are substantially the same as the above-described embodiments.

With the pole 500 of the present embodiment, the hole portion at the upper end of the outer pipe 510*a* (in the case of plural hole portions, the hole portion located farthest from the floor) is matched and fixed to the hole portion of the ceiling pipe 510*c* (in the case of plural hole portions, the hole portion located nearest from the floor), and the hole portion at the lower end of the outer pipe 510*a* (in the case of plural hole portions, the hole portion located nearest from the floor) is matched and fixed to the hole portion of the lower pipe 510*b* (in the case of plural hole portions, the hole portion located farthest from the floor). Thereby, the pole 500 can become a longest state. In a state where the pole 500 has the ceiling pipe 510*c* attached to the upper pad and the lower pipe 510*b* attached to the lower pad, the longest length of the pole 500 is approximately 343.5 cm according to the example of FIG. 40.

On the other hand, the pole 500 can be kept in a shortest state by accommodating the ceiling pipe 510*c* and the lower pipe 510*b* inside the outer pipe 510*a*. In a state where the pole 500 has the ceiling pipe 510*c* attached to the upper pad and the lower pipe 510*b* attached to the lower pad, the shortest length of the pole 500 is approximately 197.5 cm according to the example of FIG. 40.

Because the upper arm and the handle operation unit 517 are coupled to the pole to slide throughout the pole in its vertical direction, it is possible to set the height of the seat within the range of the length of the outer pipe 510*a*. In the present embodiment, the ceiling pipe 510*c* and the lower pipe 510*b* are to be pulled out from the outer pipe 510*a* in order for the pole 500 to become the longest state. However, the pole 500 may also be used by pulling out only one of the ceiling pipe 510*c* and the lower pipe 510*b* from the outer pipe 510*a* while the other is accommodated in the outer pipe 510*a*. In this case, the pole 500 becomes shorter to the extent in which the pipe is accommodated in the outer pipe 510 relative to its longest state. Although the length of the pole can be set to be the same either in a case where the ceiling pipe is accommodated while the lower pipe is pulled out or a case where the ceiling pipe is pulled out while the lower pipe is accommodated. However, the position for installing the outer pipe 510 changes depending on the accommodation method is used. That is, the range in which the upper arm and the handle operation unit 517 can slide in the vertical direction of the pole can be adjusted depending on the accommodation method used.

However, if the length from the floor on which the pole 500 is installed to the ceiling is less than the length of the pole in the case where one pipe is accommodated in the outer pipe 510*a* and the other pipe is pulled out from the outer pipe 510*a*, it would be necessary to pull out the accommodated one pipe from the outer pipe 510*a* and adjust the length of the pole 500.

Figure 41:
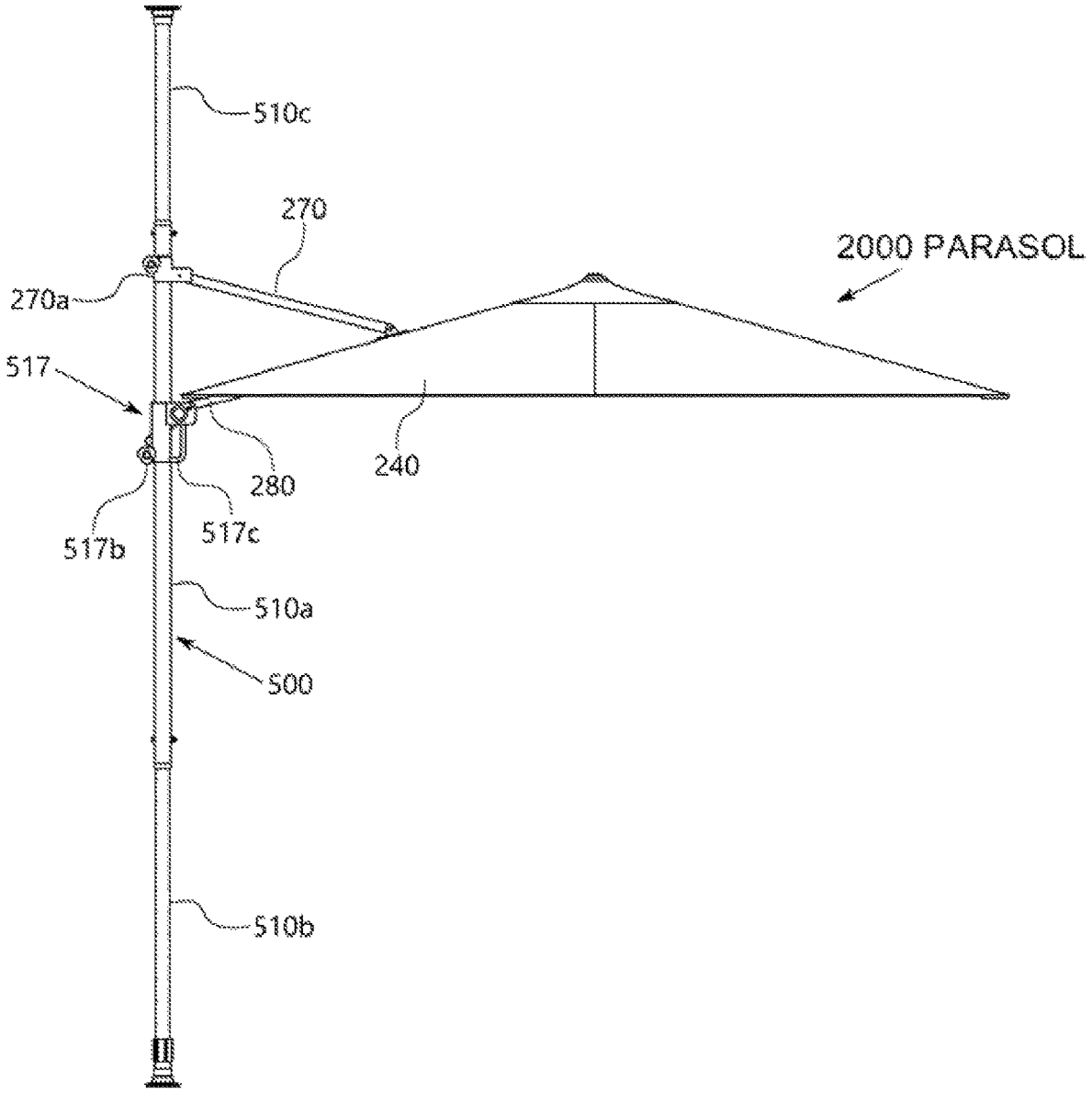
FIG. 41 is a front view of applying the pole of the present embodiment to the parasol of Embodiment 6 (Embodiment 8).
Figure 42:
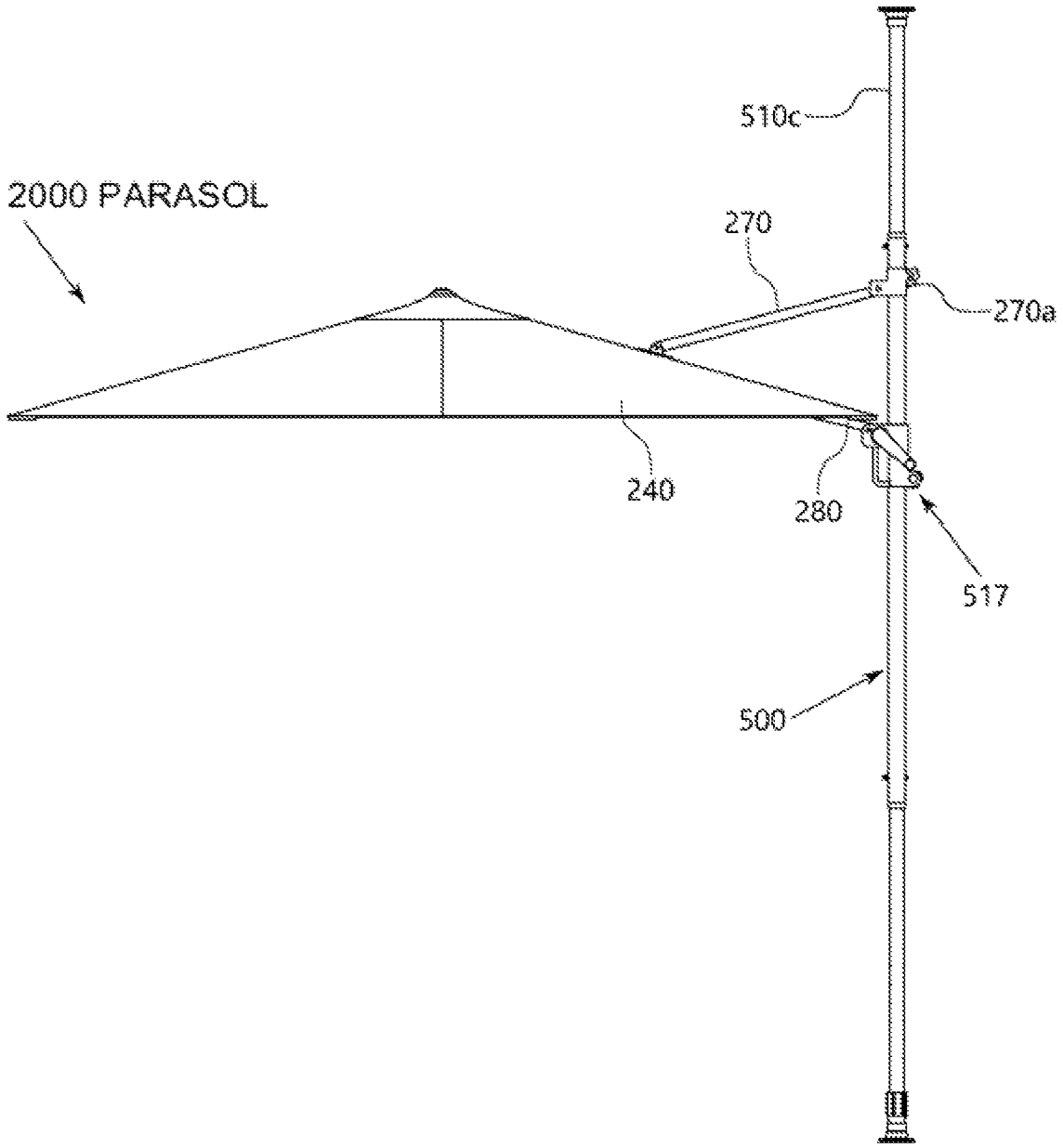
FIG. 42 is a rear view of applying the pole of the present embodiment to the parasol of Embodiment 6 (Embodiment 8).
Figure 43:
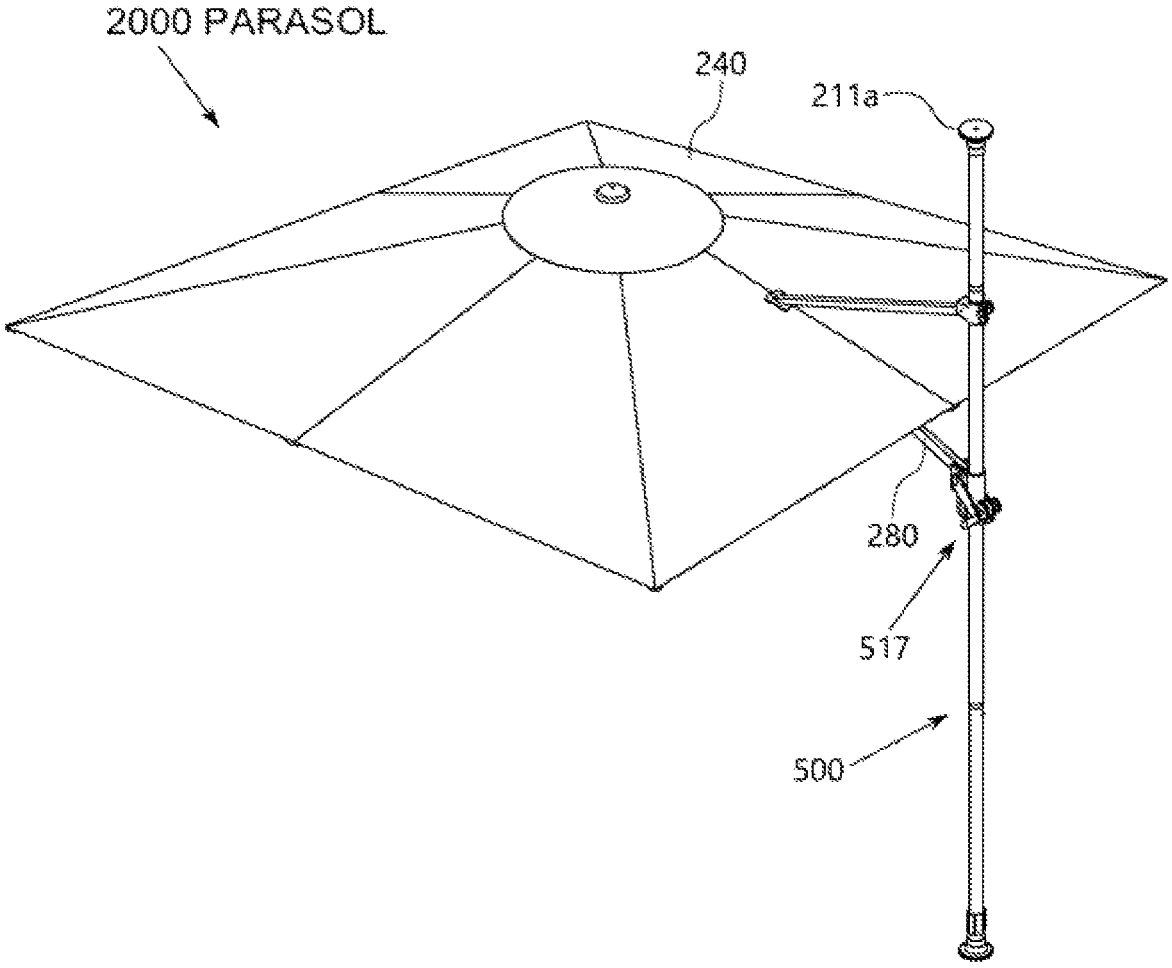
FIG. 43 is a perspective view of applying the pole of the present embodiment to the parasol of Embodiment 6 (Embodiment 8).
Figure 44:
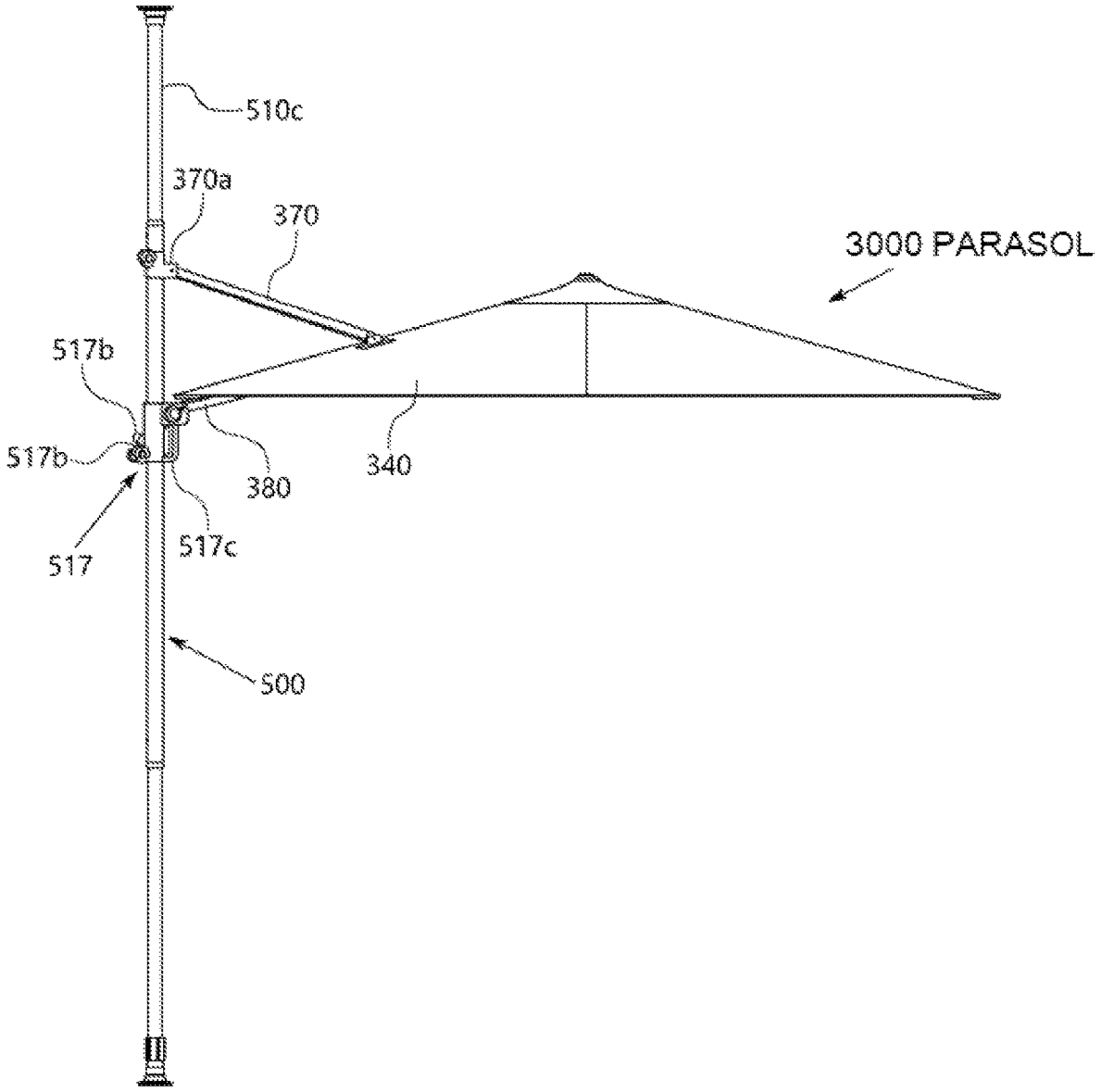
FIG. 44 is a front view of applying the pole of the present embodiment to the parasol of Embodiment 7 (Embodiment 8).
Figure 45:
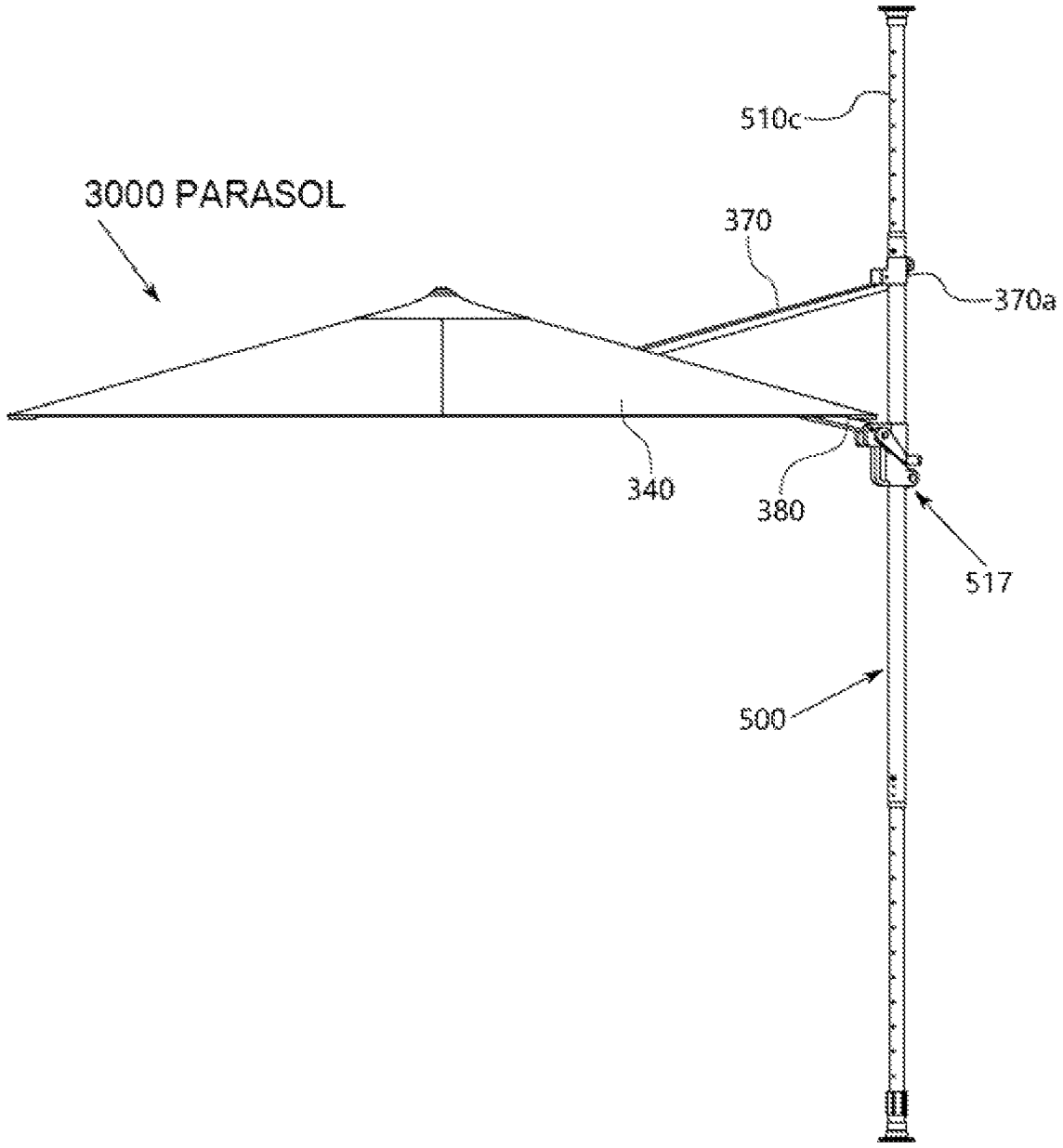
FIG. 45 is a rear view of applying the pole of this embodiment to the parasol of Embodiment 7 (Embodiment 8).
Figure 46:
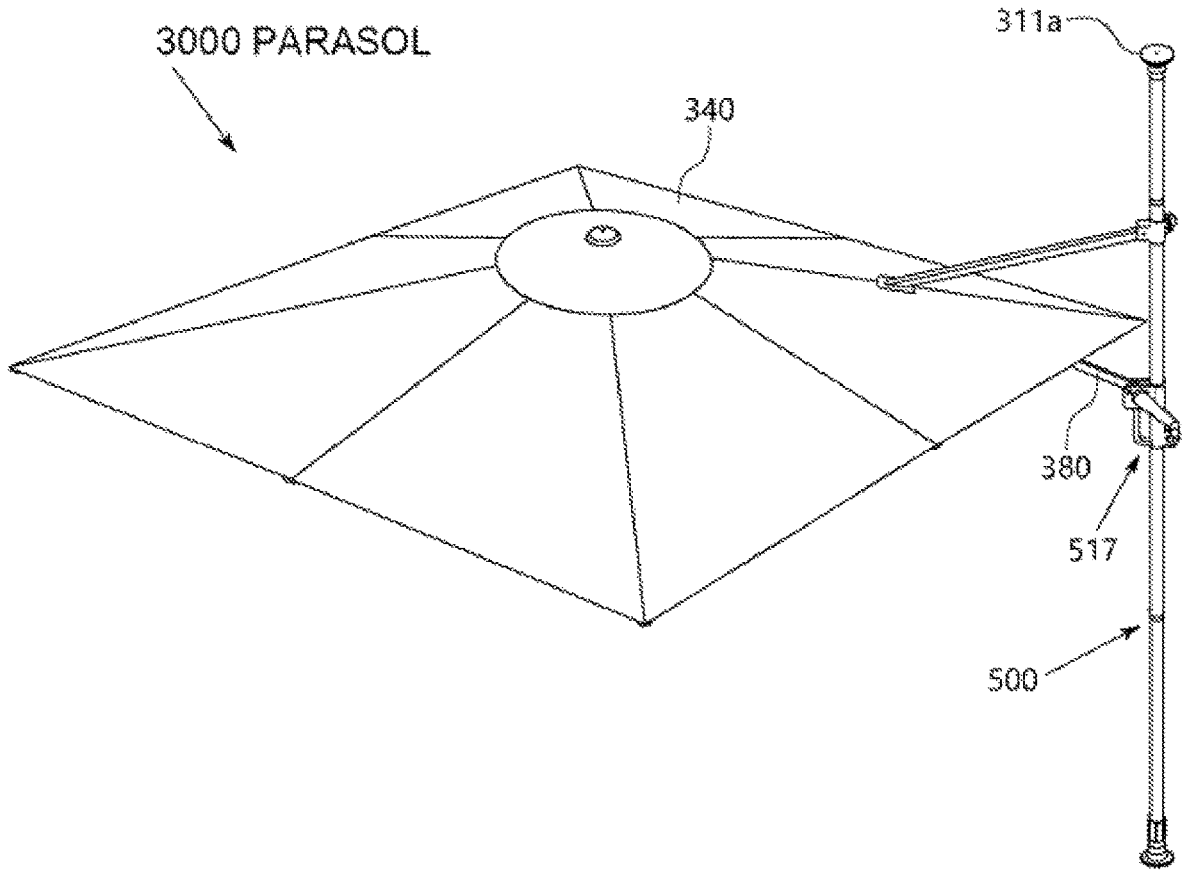
FIG. 46 is a perspective view of applying the pole of the present embodiment to the parasol of Embodiment 7 (Embodiment 8).
Figure 47:
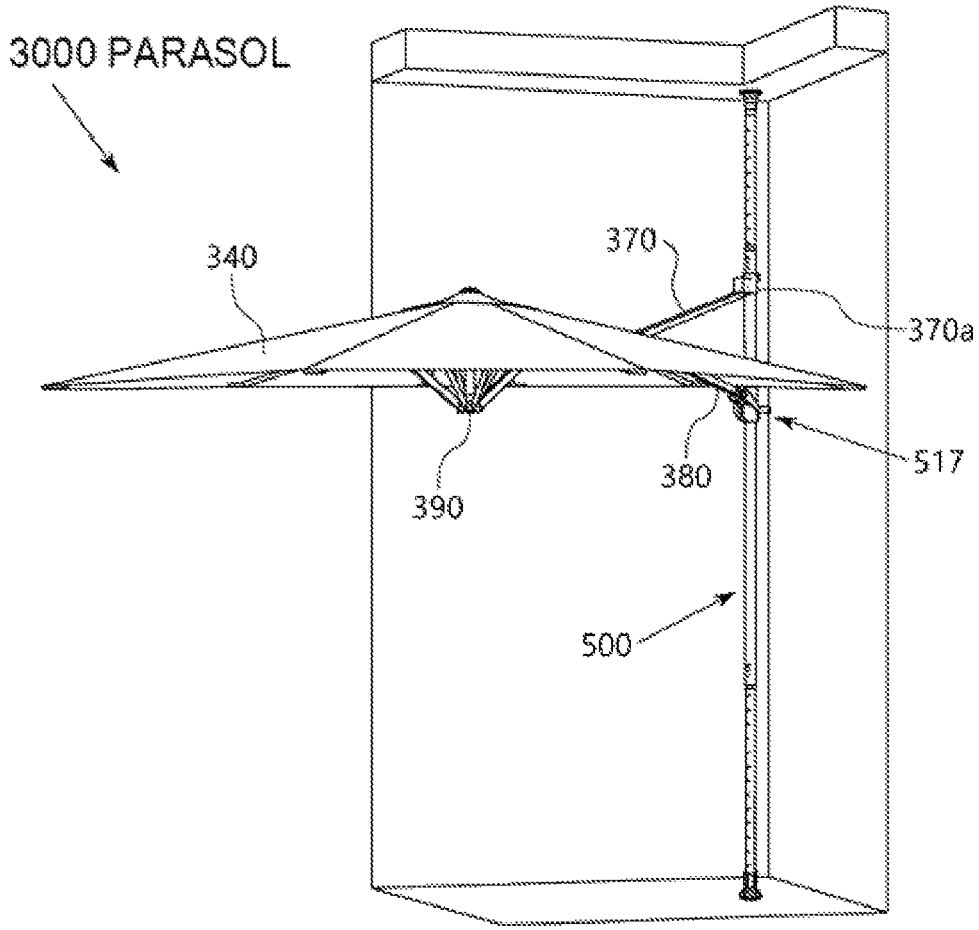
FIG. 47 is a reference diagram of the usage state of applying the pole of the present embodiment to the parasol of Embodiment 7 (Embodiment 8).

An example of applying the present embodiment to a center pole-type square parasol is shown in FIGS. 41-43, and an example of applying the present embodiment to a corner pole-type square parasol is shown in FIGS. 44-47. Because the parasol of the present embodiment is substantially the same as the parasol 2000 of embodiment 6 and the parasol 3000 of embodiment 7 except for difference of the poles, detailed description thereof will be omitted.

Accordingly, with the above-described parasol 5000 of embodiment 8, the adjustability of the length of the pole and the adjustability of the height of the sheet can be simplified while maintaining the advantages of the parasol of the above-described embodiments such as the stability provided by tension force, the ease of installation, the adjustability of height, and the reduction of packaging cost. Further, with the parasol 5000 of embodiment 8, even if the space between the pole and the building is installed in a narrow position, it is possible to easily perform the position adjustment of the winding operation and the handle operation unit.

INDUSTRIAL APPLICABILITY

The parasol of the present invention can be easily installed not only at the eaves but locations in-between a ceiling surface and a floor surface, and used as a sunshade or rain shield.

DESCRIPTION OF REFERENCE NUMERALS

1, 1*a*, 1*b*, 2000, 3000, 5000 parasol
10, 100, 200, 300, 500 pole
101, 102 telescopic part
101*a*, 102*a* pad
11 upper hub
12 lower hub
20 rib
30 strut
117*c*, 217, 317, 517 handle operation unit
40, 40*a*, 41, 240, 340 sheet
outer pipe 10*a*, 110*a*, 210*a*, 310*a*, 510*a*
10*b*, 110*b* partial inner pipe
10*c*, 110*c* partial inner pipe
110*d* ceiling pipe
510*b* lower pipe
510*c* ceiling pipe

The invention claimed is:

1. A parasol comprising:

a single pole of a tension rod-type between a ceiling surface and a floor surface of a building;

a lower hub penetrated by the pole and configured to move in the vertical direction along the pole;

an upper hub fixed to a predetermined position of the pole;

two or more ribs joined to the upper hub;

struts provided with respect to each of the ribs and connecting the ribs and the lower hub;

a handle operation unit for moving the lower hub along the pole; and a sheet provided between the ribs;

wherein the pole is divided into at least an outer pipe, a ceiling pipe attached to an upper side of the outer pipe, and a lower side pipe attached to a lower side of the outer pipe, wherein the length of the pole in the vertical direction is adjustable while the position of the sheet is maintained at a height within a certain range from the floor surface, wherein a pad having a convex connection surface is provided on an upper end of the pole, wherein an upper end surface of the pole has a concave connection surface, wherein the rotation of the pole is restricted by connecting and engaging the convex connection surface and the concave connection surface.

2. The parasol according to claim 1, wherein the lower side pipe is further divided into an upper inner pipe, and a lower inner pipe attached to the lower side of the upper inner pipe, wherein the handle operation unit is attached to the outer pipe, wherein at least one of the ceiling pipe, the upper inner pipe, and the lower inner pipe is detachably attached to the outer pipe depending on the distance between the ceiling surface and the floor surface, wherein the ceiling pipe is provided between the ceiling surface and the outer pipe in a case where the distance between the ceiling surface and the floor surface is a predetermined distance.

3. The parasol according to claim 1, wherein the distance from the sheet to the ceiling surface is regulated to a length equivalent to the length of the ceiling pipe.

4. The parasol according to claim 1, wherein one or more hole portions are provided in each of an upper end of the outer pipe and a lower end of the ceiling pipe, wherein the outer pipe and the ceiling pipe are connected with a connecting member via the hole portion provided in the outer pipe and the hole portion provided in the ceiling pipe, wherein the distance from the ceiling surface to the ceiling pipe is adjustable by positioning the hole portion provided in the outer pipe and the hole portion provided in the ceiling pipe.

5. A parasol comprising:

a single pole of a tension-rod-type for exerting force between a ceiling surface and a floor surface of a building;

a sheet that is foldable and has a top view shape of a polygon when in an open state;

a handle operation unit coupled to the pole;

an upper arm coupled to the pole and supporting the sheet from an upper side;

a lower arm having one end attached to the handle operation unit and supporting the sheet from a lower side;

a support cylinder provided at a center of the sheet on a lower side of the sheet;

a plurality of ribs extending radially and oscillatably supported by an upper end part of the support cylinder;

struts having an end in its length direction that oscillatably support an intermediate portion of the lower arm in the length direction and an intermediate portion of the ribs in the length direction;

a ring member provided at a lower end of the support cylinder, and a string member that has one end part coupled to the ring member and another end part coupled to the handle operation unit via the inside of the support cylinder and the inside of the lower arm;

wherein the sheet is configured to be opened and closed by moving the ring member coupled to the string member upward and downward by performing a winding operation of the string member with the handle operation unit, wherein the pole is divided into at least an outer pipe, a ceiling pipe attached to the upper side of the outer pipe, and a lower side pipe attached to the lower side of the outer pipe, wherein the length of the pole in the vertical direction is adjustable while the position of the sheet is maintained at a height within a certain range from the floor surface, wherein the handle operation unit has a first side surface, a second side surface on the opposite side of the first side surface, a lever portion provided on the first side surface, a lock portion provided on the second side surface for fixing the position of the handle operation unit, and a grip portion interposed between the first side surface and the second side surface, wherein the grip portion is configured to be gripped when performing the winding operation, wherein the grip portion is provided below the sheet on the side of the sheet.

6. The parasol according to claim 5, wherein the pole is located at a midpoint of one side of the polygon.

7. The parasol according to claim 5, wherein the pole is located at a vertex of one of the corners of the polygon.

8. The parasol according to claim 5, further provided with upper and lower pads that press against the ceiling surface and the floor surface at the upper and lower ends of the pole, wherein the upper arm and the handle operation unit are coupled to slide between the upper pad and the lower pad in the vertical direction of the pole.

9. The parasol according to claim 5, further provided with upper and lower pads that press against the ceiling surface and the floor surface at the upper and lower ends of the pole, wherein the upper arm and the handle operation unit are coupled to slide throughout the entire length of the outer pipe between the upper pad and the lower pad in the vertical direction of the pole.

10. The parasol according to claim 5, wherein the polygon is a square.

11. The parasol according to claim 5, wherein the winding operation is an operation of rotating the lever portion while gripping the grip portion, wherein the sheet is opened by rotating the lever portion in a forward direction, wherein the sheet is closed by rotating the lever portion in a direction opposite to the forward direction.

12. The parasol according to claim 5, wherein the length of the pole in the vertical direction is adjustable by pulling out one of the ceiling pipe or the lower side pipe from the outer pipe in a state where the other is accommodated in the outer pipe.

13. The parasol according to claim 12, wherein when the length of the pole in the vertical direction does not satisfy the predetermined length in a case where the other pipe is pulled out from the outer pipe while the one pipe is in a state accommodated in the outer pipe, the length of the pole in the vertical direction can be adjusted to satisfy the predetermined length by pulling out the one pipe from the outer pipe.

14. The parasol according to claim 5, wherein one or more hole portions are provided in each of the upper and lower ends of the outer pipe, wherein one or more hole portions are provided in the ceiling pipe, wherein one or more hole portions are provided in the lower side pipe, wherein the length of the pole in the vertical direction is adjustable by positioning the hole portion provided in at least one of the upper lower ends of the outer pipe with the hole portion provided on one of the ceiling pipe or the lower side pipe.

* * * * *